US007006096B2

(12) United States Patent
Koyama

(10) Patent No.: US 7,006,096 B2
(45) Date of Patent: Feb. 28, 2006

(54) CHARACTER DISPLAY APPARATUS, CHARACTER DISPLAY METHOD, AND RECORDING MEDIUM

(75) Inventor: Noriyuki Koyama, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 230 days.

(21) Appl. No.: 10/040,462

(22) Filed: Jan. 9, 2002

(65) Prior Publication Data

US 2002/0093502 A1 Jul. 18, 2002

(30) Foreign Application Priority Data

Jan. 15, 2001 (JP) ..... 2001-007096

(51) Int. Cl.
*G09G 5/24* (2006.01)

(52) U.S. Cl. ..... 345/469.1; 345/613

(58) Field of Classification Search ..... 345/690, 345/695, 87–89, 613, 589, 214, 600, 469.1, 345/471, 947, 687

See application file for complete search history.

(56) References Cited

U.S. PATENT DOCUMENTS

| | | | | |
|---|---|---|---|---|
| 4,484,347 A | * | 11/1984 | Kashioka | 382/296 |
| 4,837,562 A | | 6/1989 | Nishiura et al. | |
| 4,959,801 A | * | 9/1990 | Apley et al. | 345/469 |
| 5,222,208 A | | 6/1993 | Matsuhira | |
| 5,390,289 A | | 2/1995 | Beitel et al. | |
| 5,565,886 A | * | 10/1996 | Gibson | 345/611 |
| 5,574,842 A | | 11/1996 | Takakura et al. | |
| 5,796,409 A | * | 8/1998 | Hersch et al. | 345/468 |
| 6,236,390 B1 | * | 5/2001 | Hitchcock | 345/694 |
| 6,542,161 B1 | * | 4/2003 | Koyama et al. | 345/589 |

FOREIGN PATENT DOCUMENTS

| | | |
|---|---|---|
| EP | 0 313 329 | 4/1989 |
| EP | 435 391 A2 | 7/1991 |
| EP | 1 026 659 A2 | 8/2000 |
| JP | A59-60474 | 4/1984 |
| JP | 62-007558 | 1/1987 |

* cited by examiner

*Primary Examiner*—Patrick N. Edouard
*Assistant Examiner*—Duc Q Dinh
(74) *Attorney, Agent, or Firm*—Birch, Stewart, Kolasch & Birch, LLP

(57) ABSTRACT

A character display apparatus includes: a display device having a plurality of pixels; and a control section for controlling the display device, wherein each of the plurality of pixels includes a plurality of sub-pixels, one of a plurality of color elements being pre-assigned to each of the plurality of sub-pixels; the control section: acquires a first bit map which represents a basic portion of a character, performs predetermined conversion of the first bit map so as to generate a second bit map which represents a basic portion of an italic character, and sets the intensity of a color element of at least one specific sub-pixel corresponding to the basic portion of the italic character to a predetermined value so as to display the italic character on the display device; dots which form each of the first and second bit maps correspond to the plurality of sub-pixels in a one-to-one manner.

7 Claims, 42 Drawing Sheets

FIG. 27

92

Brightness table

| | | Brightness level | | |
|---|---|---|---|---|
| | | R | G | B |
| Color element level | 7 | 0 | 0 | 0 |
| | 6 | 36 | 36 | 36 |
| | 5 | 73 | 73 | 73 |
| | 4 | 109 | 109 | 109 |
| | 3 | 146 | 146 | 146 |
| | 2 | 182 | 182 | 182 |
| | 1 | 219 | 219 | 219 |
| | 0 | 255 | 255 | 255 |

FIG. 28

90

Correction table

| | | Correction pattern |
|---|---|---|
| Color element level | Sub-pixel 1 | 5 |
| | Sub-pixel 2 | 2 |
| | Sub-pixel 3 | 1 |

*FIG. 34*

Correction table

94

| | | Correction pattern 1 | Correction pattern 2 |
|---|---|---|---|
| Color element level | Sub-pixel 1 | 5 | 6 |
| | Sub-pixel 2 | 2 | 3 |
| | Sub-pixel 3 | 1 | 1 |

CHARACTER DISPLAY APPARATUS, CHARACTER DISPLAY METHOD, AND RECORDING MEDIUM

BACKGROUND OF THE INVENTION

1. Field of the Invention

The present invention relates to a character display apparatus and a character display method capable of displaying an italic character with high quality using a color display device, and a recording medium for use with such apparatus and method.

2. Description of the Related Art

Italic characters are widely used for the purpose of displaying characters in an emphasized manner.

In a conventionally-known display technique for displaying characters on a display device, such as a liquid crystal display device, a cathode ray tube display device, etc., a bit map which represents the shape of a character is displayed by units of a pixel. The bit map which represents the shape of a character is, for example, a dot font.

The bit map defines the shape of a character by units of a dot. In the bit map, a dot corresponding to a portion of the character is represented by a bit having a value "1", and a dot not corresponding to a portion of the character is represented by a bit having a value "0". In this way, in the bit map, one dot is represented by information of one bit. The bit map includes bits which represent corresponding dots. In the present specification, dots represented by bits included in a bit map are referred to as "dots which form the bit map".

As a conventional technique for displaying an italic character on a display device, a technique for displaying an italic character on a display device based on a bit map stored in a memory of a character display apparatus (e.g., computer) which represents the italic character is known.

FIG. 41 shows an example of an italic character displayed on a display device based on a bit map which represents an italic character of a character "A" of the English language alphabet. In FIG. 41, each hatched box represents a pixel displaying black and each open box represents a pixel displaying white.

In this conventional technique, it is necessary to store bit maps which represent italic characters in a memory of a character display apparatus in addition to bit maps of normal (non-italic) characters which are usually stored in the character display apparatus.

Another conventional technique for displaying an italic character on a display device is disclosed in Japanese Laid-Open Publication No. 59-60474. In this conventional technique, the shape of a non-italic character is represented by a bit map, and dots which form a bit map correspond to pixels of the display device in a one-to-one manner. In this technique, a bit map which represents the shape of a character is deformed by units of a dot (i.e., by units of a pixel) so as to generate a bit map which represent an italic version of the character, and each pixel of the display device is controlled between black and white based on the bit map which represent the italic character, whereby an italic character is displayed. Thus, it is not necessary to previously store bit maps which represent italic characters in a memory.

Since dots which form a bit map that represents the shape of a non-italic character correspond to pixels of the display device in a one-to-one manner. The shape of a non-italic character is defined by units of a pixel.

Hereinafter, in the present specification, a bit map which defines the shape of a non-italic character or an italic character by units of a pixel is referred to as a "bit map defined by units of a pixel". A non-italic character is simply referred to as a "character".

FIG. 42A shows an example of a character "H" of the English language alphabet displayed on a display plane 900 of 16 pixels×16 pixels based on a bit map defined by units of a pixel. In FIG. 42A, each hatched box represents a pixel displaying black and each open box represents a pixel displaying white.

FIG. 42B shows an example of an italic character "H" of the English language alphabet displayed on the display plane 900 based on a bit map obtained by deforming the bit map of FIG. 42A defined by units of a pixel.

In the examples illustrated in FIGS. 42A and 42B, a bit map defined by units of a pixel is deformed according to the technique disclosed in Japanese Laid-Open Publication No. 59-60474 such that each of the dots which form the bit map are shifted along the X direction by a number of dots determined based on a distance from the bottom of the character. In this deformation example, as the distance from the bottom of the character is increased by 3 dots, the number of dots by which dots are shifted is increased by 1.

In this way, a bit map which defines the shape of a character by units of a pixel is deformed so as to generate a bit map which represents an italic character, whereby an italic character can be displayed on a display device without previously storing bit maps which represent italic characters in a memory.

In the conventional technique disclosed in Japanese Laid-Open Publication No. 59-60474 where a bit map which defines the shape of a character by units of a pixel is deformed so as to generate a bit map which represents an italic version of the character, "jaggedness" becomes more conspicuously in a character, especially in an italic character including an oblique line as a component of the character. As a result, the display quality of the italic character is deteriorated. In such a case, characters are difficult and unpleasant to read, which imposes eye strain on an observer of the display device.

FIG. 43A shows an example of a character "A" of the English language alphabet displayed on a display plane 900 of 16 pixels×16 pixels based on a bit map defined by units of a pixel. In FIG. 43A, each hatched box represents a pixel displaying black and each open box represents a pixel displaying white.

FIG. 43B shows an example of an italic character "A" of the English language alphabet displayed on the display plane 900 based on a bit map obtained by deforming the bit map of FIG. 43A defined by units of a pixel. As shown in FIG. 43B, the display quality of the italic character "A" is deteriorated in an oblique line of the character "A" (e.g., a portion 4201).

FIG. 44A shows another example of a character "A" of the English language alphabet displayed on a display plane 900 of 16 pixels×16 pixels based on another bit map defined by units of a pixel.

FIG. 44B shows another example of an italic character "A" of the English language alphabet displayed on the display plane 900 based on a bit map obtained by deforming the bit map of FIG. 44A. In FIG. 44B also, the display quality of the italic character "A" is deteriorated in the oblique lines of the character "A" (e.g., portions 4301 and 4302).

It is understood from FIGS. 43B and 44B that, according to the conventional technique, the display quality of a character is decreased also when the slant angle of an oblique line included in the character is changed.

Thus, the conventional technique includes the above-described problem of deterioration in the display quality of an italic character.

SUMMARY OF THE INVENTION

According to one aspect of the present invention, a character display apparatus includes: a display device having a plurality of pixels; and a control section for controlling the display device, wherein each of the plurality of pixels includes a plurality of sub-pixels arranged along a predetermined direction, one of a plurality of color elements being pre-assigned to each of the plurality of sub-pixels; the control section: acquires a first bit map which represents a basic portion of a character, performs predetermined conversion of the first bit map so as to generate a second bit map which represents a basic portion of an italic character, and sets the intensity of a color element of at least one specific sub-pixel corresponding to the basic portion of the italic character to a predetermined value based on the second bit map so as to display the italic character on the display device; dots which form the first bit map correspond to the plurality of sub-pixels in a one-to-one manner; and dots which form the second bit map correspond to the plurality of sub-pixels in a one-to-one manner.

In one embodiment of the present invention, the intensity of each of the plurality of color elements is represented by a plurality of color element levels in a stepwise fashion; each of the plurality of sub-pixels has one of the plurality of color element levels; the control section sets a color element level of the at least one specific sub-pixel corresponding to the basic portion of the italic character to a predetermined color element level; and the control section sets a color element level of at least one sub-pixel adjacent to the at least one specific sub-pixel corresponding to the basic portion of the italic character to a color element level different from the predetermined color element level.

In another embodiment of the present invention, the second bit map is generated from the first bit map by shifting each dot forming the first bit map by a shift amount which is in proportion to a distance from a reference line running along the predetermined direction set in the first bit map to a dot.

In still another embodiment of the present invention, the shift amount for each dot forming the first bit map is determined such that the shift amount is increased by 1 dot every time the distance from the reference line to a dot is increased by 1 dot.

According to another aspect of the present invention, a character display method for displaying a character on a display device having a plurality of pixels wherein each of the plurality of pixels includes a plurality of sub-pixels arranged along a predetermined direction, and one of a plurality of color elements is pre-assigned to each of the plurality of sub-pixels, the character display method comprising steps of: acquiring a first bit map which represents a basic portion of a character; performing predetermined conversion on the first bit map so as to generate a second bit map which represents a basic portion of an italic character; and setting the intensity of a color element of at least one specific sub-pixel corresponding to the basic portion of the italic character to a predetermined value based on the second bit map so as to display the italic character on the display device, wherein dots which form the first bit map correspond to the plurality of sub-pixels in a one-to-one manner, and dots which form the second bit map correspond to the plurality of sub-pixels in a one-to-one manner.

According to still another aspect of the present invention, a recording medium which can be read by an information display apparatus including a display device having a plurality of pixels and a control section for controlling the display device wherein each of the plurality of pixels includes a plurality of sub-pixels arranged along a predetermined direction, and one of a plurality of color elements is pre-assigned to each of the plurality of sub-pixels, the recording medium storing a program which allows the control section to execute a process including steps of: acquiring a first bit map which represents a basic portion of a character; performing predetermined conversion on the first bit map so as to generate a second bit map which represents a basic portion of an italic character; and setting the intensity of a color element of at least one specific sub-pixel corresponding to the basic portion of the italic character to a predetermined value based on the second bit map so as to display the italic character on the display device, wherein dots which form the first bit map correspond to the plurality of sub-pixels in a one-to-one manner, and dots which form the second bit map correspond to the plurality of sub-pixels in a one-to-one manner.

Hereinafter, functions of the present invention will be described.

According to the present invention, a bit map (basic portion data) which represents a basic portion of a character is acquired, and conversion (italicization processing) is performed on the bit map so as to acquire a bit map which represents a basic portion of an italic version of the character. Dots which form the basic portion data of the italic character correspond to sub-pixels of a display device in a one-to-one manner. The italicization processing itself is achieved with high definition. Thus, the italic character can be displayed with high quality.

According to the present invention, the color element level of at least one specific sub-pixel corresponding to a basic portion of an italic character is set to a predetermined color element level, and the color element level of at least one sub-pixel adjacent to the at least one specific sub-pixel corresponding to the basic portion of the italic character is appropriately controlled. In this way, colors of the italic character other than black can be made less conspicuous to the human eye, and accordingly, jaggedness which may be generated in the basic portion of the italic character can be made less conspicuous to the human eye.

Thus, the invention described herein makes possible the advantages of (1) providing a character display apparatus and a character display method which can display italic characters with high definition, and (2) providing a recording medium for use with such a character display apparatus and character display method.

These and other advantages of the present invention will become apparent to those skilled in the art upon reading and understanding the following detailed description with reference to the accompanying figures.

BRIEF DESCRIPTION OF THE DRAWINGS

FIG. 27 shows a standard brightness table 92 which is an example of a brightness table 42*c* stored in an auxiliary storage apparatus 40 of the character display apparatus 1*b*.

FIG. 28 illustrates a correction table 90 as an example of a correction table 42*b* stored in the auxiliary storage apparatus 40.

FIG. 34 shows a correction table 94 as another example of the correction table 42*b* stored in the auxiliary storage apparatus 40.

DESCRIPTION OF THE PREFERRED EMBODIMENTS

First, the character deformation principle of the present invention will be described. In the present invention, "deformation of a character" means performing a predetermined conversion on a bit map which represent a non-italic character so as to acquire a bit map which represents an italic version of the character. The character deformation principle is commonly used in all embodiments to be described below. In this specification, a "character" includes a pictorial symbol, a symbol, a numerical character, etc.

Figure 1:
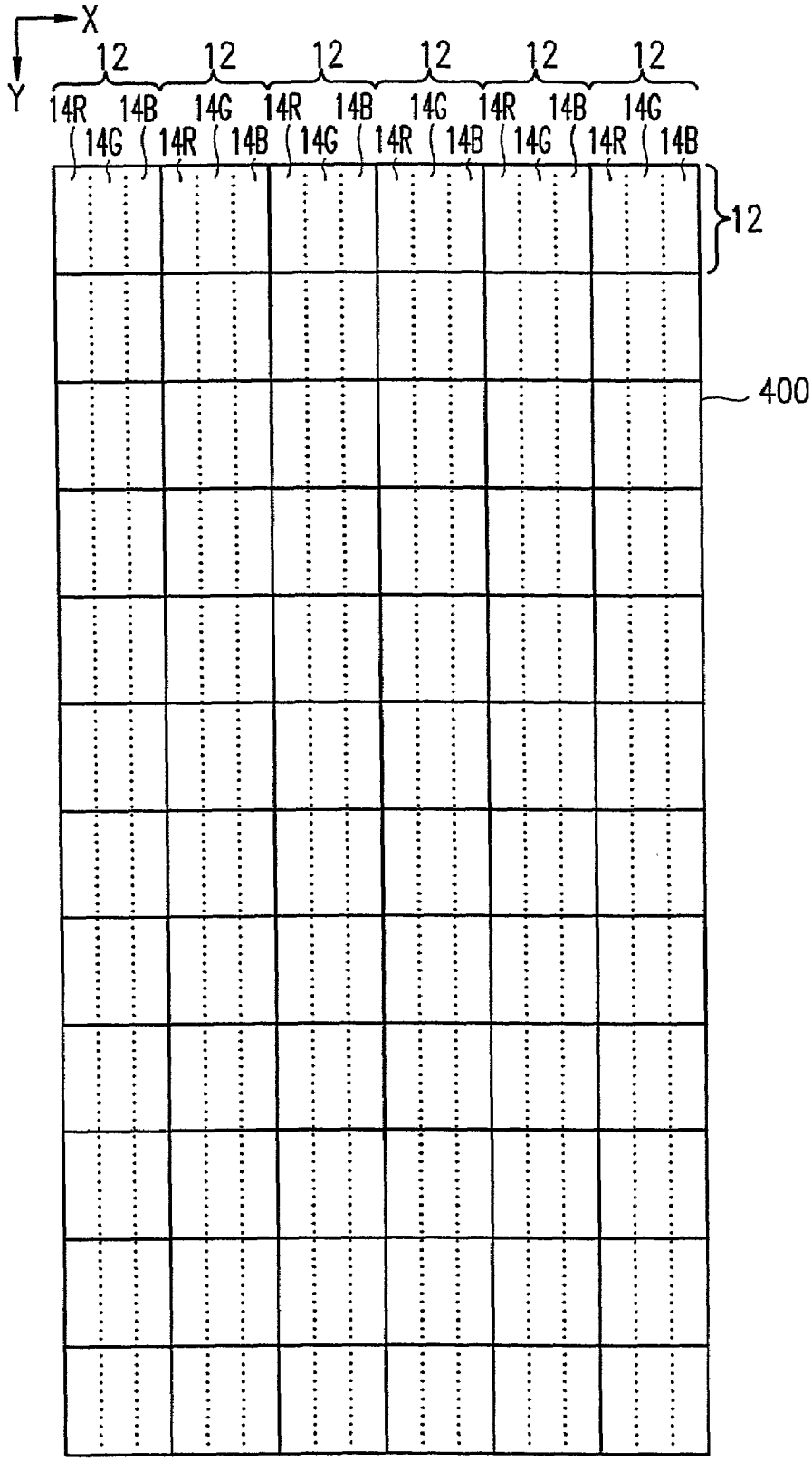
FIG. 1 schematically illustrates a display plane 400 of a display device 10 (FIGS. 3 and 30) which can be used with a character display apparatus of the present invention.

FIG. 1 schematically illustrates a display plane 400 of a display device 10 (FIGS. 3 and 30) which can be used with the character display apparatus of the present invention. The display device 10 includes a plurality of pixels 12 which are arranged along the X and Y directions. Each of the pixels 12 includes a plurality of sub-pixels which are arranged along the X direction. In the example illustrated in FIG. 1, each pixel 12 includes three sub-pixels 14R, 14G and 14B.

The sub-pixel 14R is pre-assigned to a color element R so as to output color R (red). The sub-pixel 14G is pre-assigned to a color element G so as to output color G (green). The sub-pixel 14B is pre-assigned to a color element B so as to output color B (blue).

The brightness of each of the sub-pixels 14R, 14G and 14B is represented by a value ranging from 0 to 255, for example. When each of the sub-pixels 14R, 14G and 14B may independently take a value ranging from 0 to 255 which represents a brightness level, it is possible to display about 16,700,000(=256×256×256) different colors.

In the above-described conventional technique, dots of a bit map which defines a character by units of a pixel correspond to pixels of a display device in a one-to-one manner. Thus, deformation of the bit map is performed by units of a pixel in order to generate a bit map which represents an italic character.

On the other hand, according to the present invention, dots of a bit map correspond to sub-pixels of a display device in a one-to-one manner. Thus, deformation of the bit map is performed by units of a sub-pixel in order to generate a bit map which represents an italic character. In a bit map used in the present invention, one dot corresponds to one sub-pixel. In such a bit map, a basic portion of the character is defined by units of a sub-pixel. Hereinafter, a bit map which defines a basic portion of a character by units of a sub-pixel is referred to as "basic portion data".

Figure 2A:
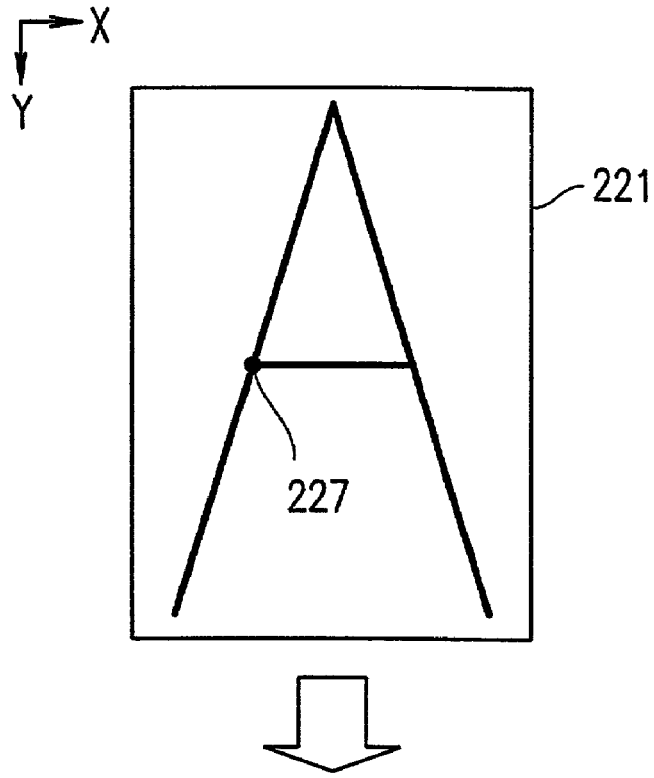
FIG. 2A shows a rectangular box 221 enclosing a character "A".

FIG. 2A shows a rectangular box 221 enclosing a character "A". The rectangular box 221 circumscribes a group of all the dots which form a bit map that represents the character "A".

Figure 2B:
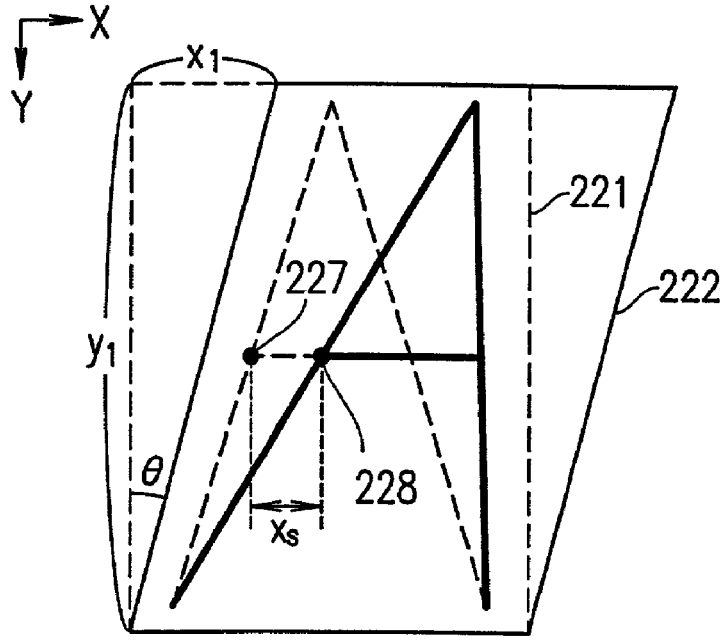
FIG. 2B shows a parallelogramic box 222 containing an italic version of the character "A".

FIG. 2B shows a parallelogramic box 222 containing an italic version of the character "A". The parallelogramic box 222 circumscribes a group of all the dots which form a bit map that represents the italic character "A".

According to the present invention, each dot included in a bit map which represents a character is shifted along the X-direction by a certain amount, in order to generate a bit map which represents an italic version of the character. For example, a dot 227 of the bit map which represents the character "A" corresponds to a dot 228 of the bit map which represents an italic version of the character "A". The shifted amount of the dot 227 is $x_s$. Since both the character "A" and the italic version thereof are represented by the bit maps, the value of the shift amount $x_s$ can be set by units of one dot. In the present invention, one dot corresponds to one sub-pixel, whereas in the conventional technique, one dot corresponds to one pixel.

As shown in FIG. 1, the display plane 400 includes the plurality of pixels 12. Each of the pixels 12 includes the plurality of sub-pixels (14R, 14G and 14B) which are arranged along the X direction (a predetermined direction). That is, the direction along which the sub-pixels are arranged and the direction along which each dot is shifted for generating a bit map that represents an italic character are the same direction (X-direction). Thus, the resolution for determining the shift amount $x_s$ is high in comparison to the conventional technique. Thus, in the present invention, the shift amount $x_s$ can be determined with high resolution, and an italic character can be displayed with high quality.

The slant of an italicized character is defined according to a expression, $\tan\theta = x_1/y_1$ (FIG. 2B). As the degree of the slant of the character becomes larger, the degree of deformation of the italicized character becomes larger. In consideration of the readability of an italic character, a preferable slant of the italic character is ⅓.

Hereinafter, embodiments of the present invention will be described with reference to the drawings.

(Embodiment 1)

Figure 3:
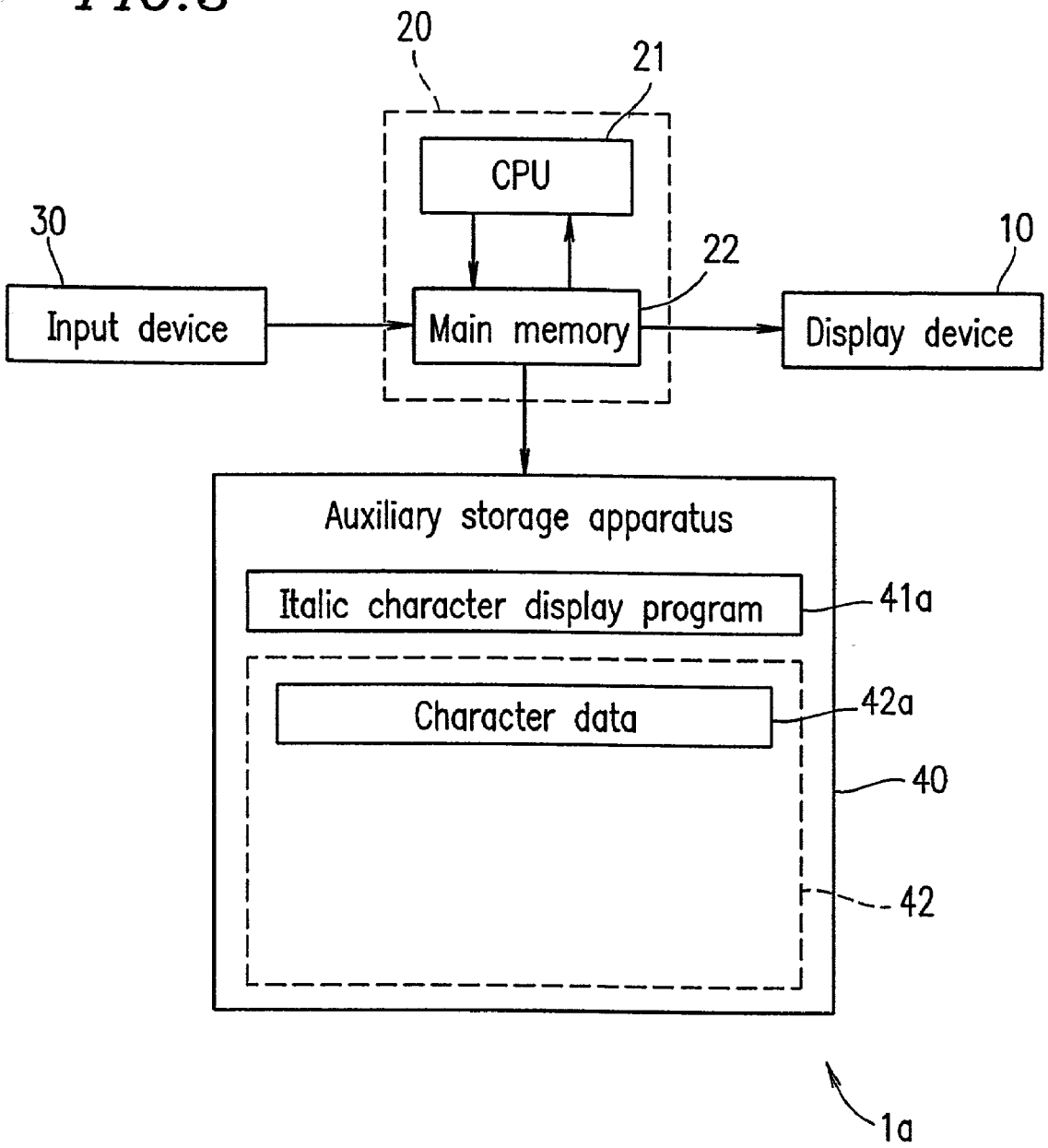
FIG. 3 illustrates a structure of a character display apparatus 1*a* according to embodiment 1 of the present invention.

FIG. 3 illustrates a structure of a character display apparatus 1*a* according to Embodiment 1 of the present invention. The character display apparatus 1*a* may be, for example, a personal computer. Such a personal computer may be of any type such as a desktop type or lap top type computer. Alternatively, the character display apparatus 1*a* may be a word processor.

Moreover, the character display apparatus 1*a* may alternatively be any other information display apparatus incorporating a color display device, such as an electronic apparatus or information apparatus. For example, the character display apparatus 1*a* may be an electronic apparatus incorporating a color liquid crystal display device, a portable information terminal which is a portable information tool, a portable phone including a PHS, a general-purpose communication apparatus such as a telephone/FAX, or the like.

The character display apparatus 1*a* includes the display device 10 capable of performing a color display, and a control section 20 for independently controlling a plurality of color elements respectively corresponding to a plurality of sub-pixels included in the display device 10. The control section 20 is connected to the display device 10, an input device 30 and an auxiliary storage apparatus 40.

The input device 30 is used to input to the control section 20 character information representing a character to be displayed on the display device 10, including character information representing a character to be displayed as an italic character. For example, the character information may include: a character code for identifying the character; a character size indicating the size of the character; and the slant of the character. The input device 30 may be any type of input device through which the character code, the character size, and the character slant can be input. For example, a keyboard, a mouse or a pen-type input device may suitably be used as the input device 30.

The auxiliary storage apparatus 40 stores an italic character display program 41*a* and data 42 which is required to execute the italic character display program 41*a*. The data 42 includes character data 42*a* which defines the shape of a character. The character data 42*a* includes, for example, a bit map (basic portion data) which defines a basic portion of a character by units of a sub-pixel. The auxiliary storage apparatus 40 may be any type of storage apparatus capable of storing the italic character display program 41*a* and the data 42. Any type of recording medium may be used in the auxiliary storage apparatus 40 for storing the italic character display program 41*a* and the data 42. For example, a hard disk, CD-ROM, MO, MD, DVD, IC card, optical card, etc., may suitably be used as the auxiliary storage apparatus 40.

The present invention is not limited to applications where the italic character display program 41*a* and the data 42 are stored on a recording medium in the auxiliary storage apparatus 40. For example, the italic character display program 41*a* and the data 42 may alternatively be stored in a main memory 22 or in a ROM (not shown). For example, such a ROM may be a mask ROM, EPROM, EEPROM, flash ROM, or the like. In such a ROM-based system, it is possible to realize various types of processing only by switching one ROM to another. For example, the ROM-based system may suitably be used when the character display apparatus 1*a* is a portable terminal apparatus or a portable phone.

The recording medium for storing the italic character display program 41*a* and the data 42 may be those which carry a program and/or data in a fixed manner such as the disk or card type storage apparatus or a semiconductor memory, as well as those which carry a program and/or data in a flexible manner such as a communication medium used for transferring a program and/or data in a communication network. When the character display apparatus 1*a* is provided with means for connecting to a communication line, including the Internet, the italic character display program 41*a* and the data 42 may be downloaded from the communication line. In such a case, a loader program required for the download may be either pre-stored in a ROM (not shown) or installed from the auxiliary storage apparatus 40 into the control section 20.

An italic character display program 41*b*, which will be described later, is processed in the same manner as the italic character display program 41*a*.

The control section 20 includes a CPU 21 and the main memory 22.

The CPU 21 controls and monitors the entire character display apparatus 1*a*, and also executes the italic character display program 41*a* stored in the auxiliary storage apparatus 40.

The main memory 22 temporarily stores data which has been input through the input device 30, data to be displayed on the display device 10, or data which is required to execute the character display program 41*a*. The main memory 22 is accessed by the CPU 21.

The CPU 21 generates a character pattern by executing the character display program 41*a* based on various data stored in the main memory 22. The generated character pattern is once stored in the main memory 22 and then output to the display device 10. The timing at which the character pattern is output to the display device 10 is controlled by the CPU 21.

The display device 10 may be a color liquid crystal display device, for example. The color liquid crystal display device may be a transmission type liquid crystal display device, which is widely used in personal computers, or the like, as well as a reflection type or rear projection type liquid crystal display device. However, the display device 10 is not limited to those color liquid crystal display devices. The display device 10 may be any color display apparatus including a plurality of pixels which are arranged along the X and Y directions (so-called "X-Y matrix display apparatus").

Moreover, the number of sub-pixels included in each pixel 12 is not limited to three. The pixel 12 may include a plurality of sub-pixels arranged in a predetermined direction. For example, when N color elements are used to represent a color, each pixel 12 may include N sub-pixels.

The order of arrangement of the sub-pixels 14R, 14G and 14B is not limited to that illustrated in FIG. 1. For example, the sub-pixels may be arranged in the order of B, G, R along the X direction.

Furthermore, the group of color elements for use with the present invention is not limited to R (red), G (green), B (blue). Alternatively, the color elements may be C (cyan), Y (yellow), M (magenta).

Figure 4:
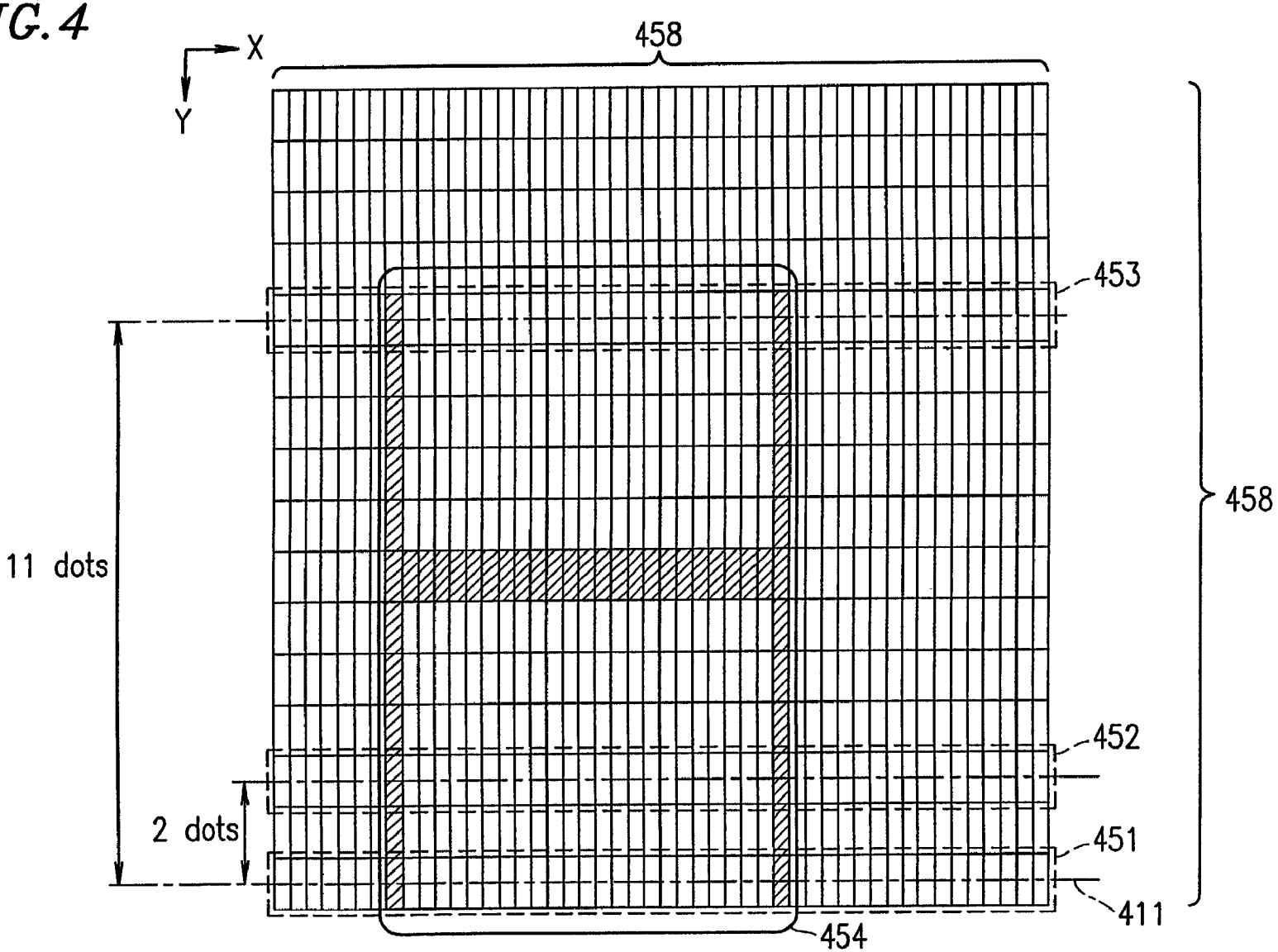
FIG. 4 shows an example of basic portion data included in character data 42*a*.

FIG. 4 shows an example of basic portion data included in the character data 42*a*. In the example illustrated in FIG. 4, each hatched box represents a dot corresponding to a basic portion of a character "H" of the English language alphabet. Each of the hatched boxes and open boxes represents one of the dots which form the basic portion data, and corresponds to one sub-pixel on the display plane 400.

The "basic portion" of a character or italic character refers to a portion of the character (or italic character) which must be necessarily displayed when the character (or italic character) is displayed on the display device. The basic portion of the character is, for example, a portion corresponding to a core of the character.

Figure 5:
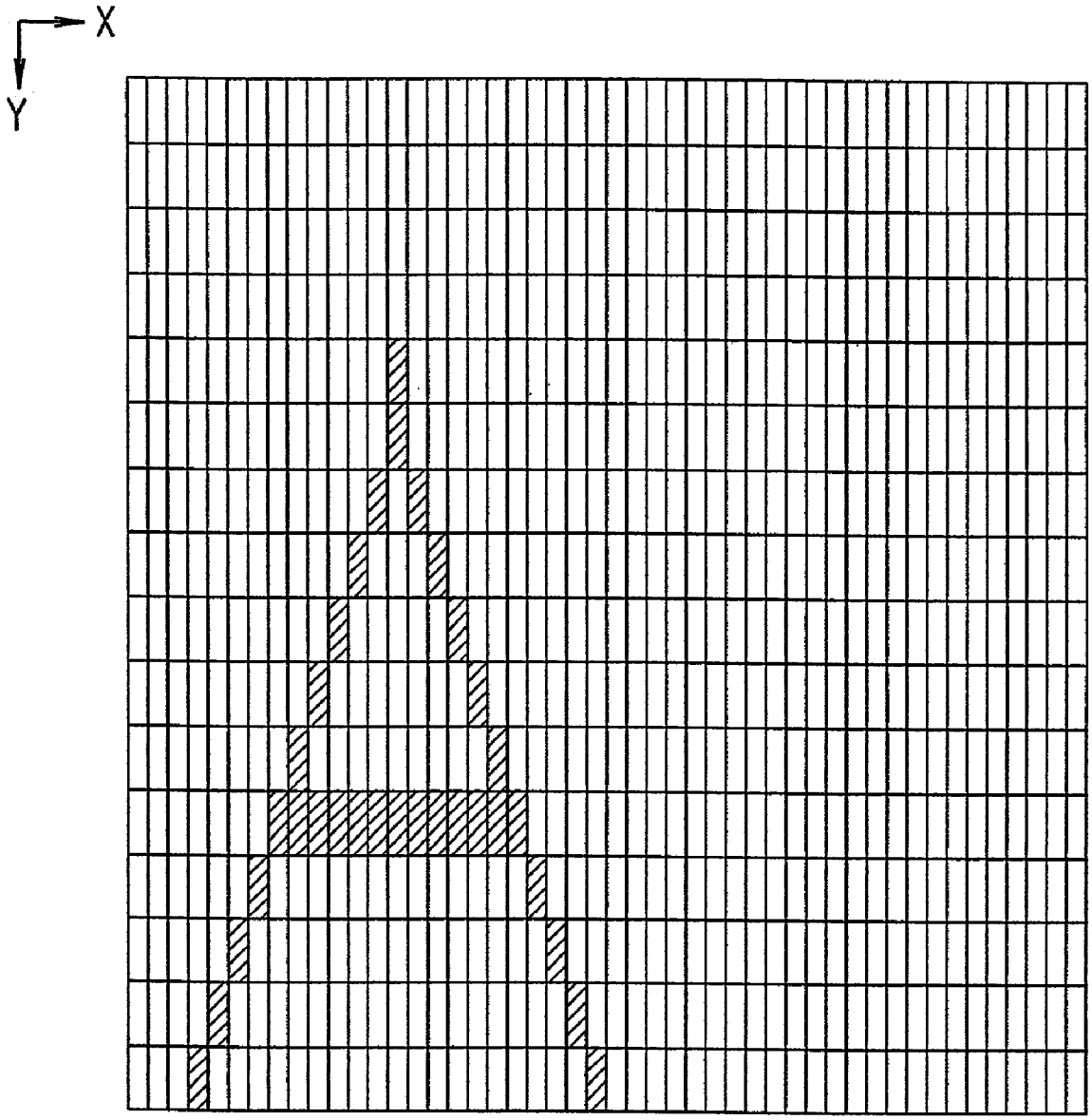
FIG. 5 shows another example of the basic portion data included in the character data 42*a*.

FIG. 5 shows another example of the basic portion data included in the character data 42*a*. In the example illustrated in FIG. 5, each hatched box represents a dot corresponding to a basic portion of a character "A" of the English language alphabet.

Figure 6:
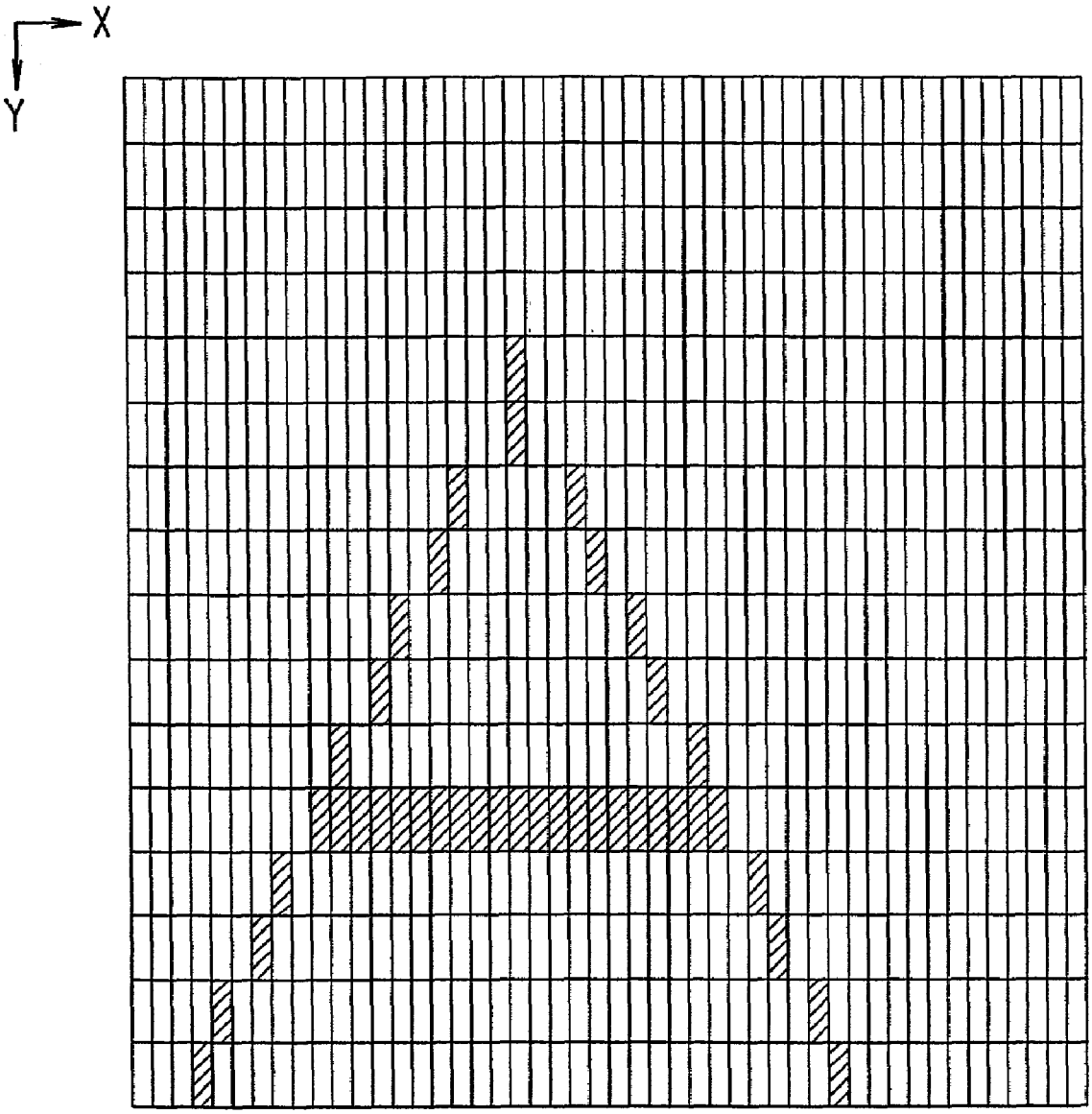
FIG. 6 shows still another example of the basic portion data included in the character data 42*a*.

FIG. 6 shows still another example of the basic portion data included in the character data 42*a*. In the example illustrated in FIG. 6, each hatched box represents a dot corresponding to a basic portion of a character "A" of the English language alphabet.

Figure 7:
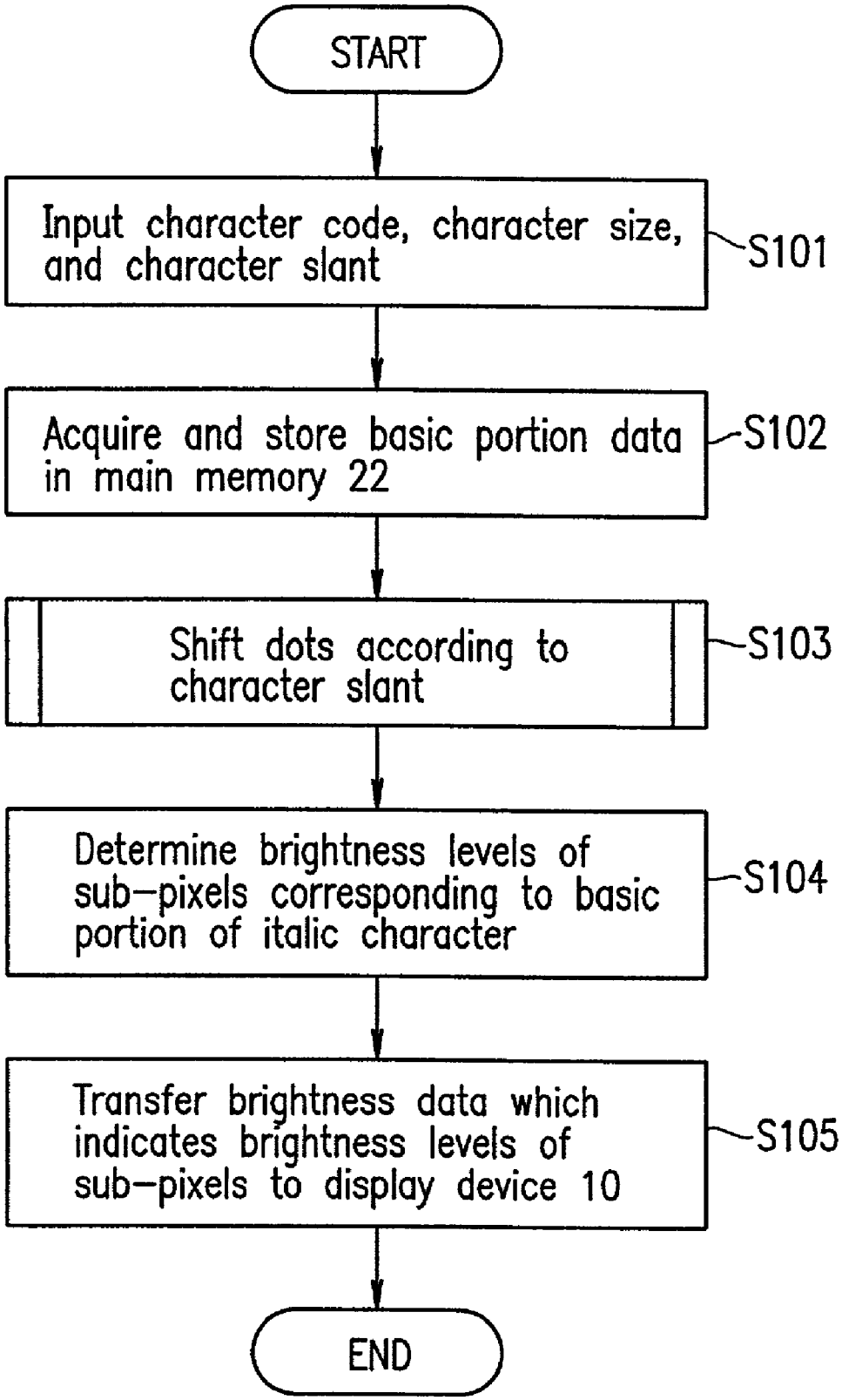
FIG. 7 illustrates a procedure for processing an italic character display program 41*a*.

FIG. 7 illustrates a procedure for processing the italic character display program 41*a*. The italic character display program 41*a* is executed by the CPU 21. Each step in the procedure for processing the display program 41*a* will now be described with reference to FIG. 7 in conjunction with FIG. 3.

Step S101: A character code, a character size, and a character slant are input from the input device 30 to the main memory 22. For example, in order to display a character "A" on the display device 10, a character code "0x41" is input.

Such an input is achieved, for example, by a user depressing an "A" key on a keyboard, for example. For example, the character size is represented by the number of pixels along the horizontal direction and the number of pixels along the vertical direction of a character to be displayed. The character size is, for example, 16 pixels×16 pixels. The degree of the slant is, for example, ⅓.

Step S102: Basic portion data (first bit map) for one character corresponding to the input character code and character size is acquired, and stored in the main memory 22. When the number of pixels specified in the character size input at step S101 is 16 pixels both along the X-direction and Y-direction, the number of sub-pixels along the X-direction is 48, and the number of sub-pixels along the Y-direction is 16. Since the dots which form the basic portion data correspond to the sub-pixels in a one-to-one manner, the basic portion data acquired at step S102 has a size of 48 dots (X-direction)×16 dots (Y-direction).

The basic portion data is included in the character data 42*a,* and acquired by reading from the auxiliary storage apparatus 40.

Step S103: The basic portion data is subjected to predetermined conversion (italicization processing) according to the slant degree of the character so as to obtain italicized basic portion data (second bit map). Details of step S103 will be described later with reference to FIG. 8. The italicized basic portion data represents a basic portion of an italic character. The dots which form the italicized basic portion data correspond to the sub-pixels in a one-to-one manner.

Step S104: The brightness level of a sub-pixel corresponding to the basic portion of the italic character is set to a predetermined brightness level. The predetermined brightness level is, for example, brightness level "0". The brightness level of a sub-pixel not corresponding to the basic portion of the italic character is set to a default brightness level (for example, brightness level "255").

Step S105: Brightness data (character pattern) which indicates the brightness levels of the sub-pixels is transferred to the display device 10. Based on the brightness data, the brightness level on the display device 10 is controlled by units of a sub-pixel.

Figure 8:
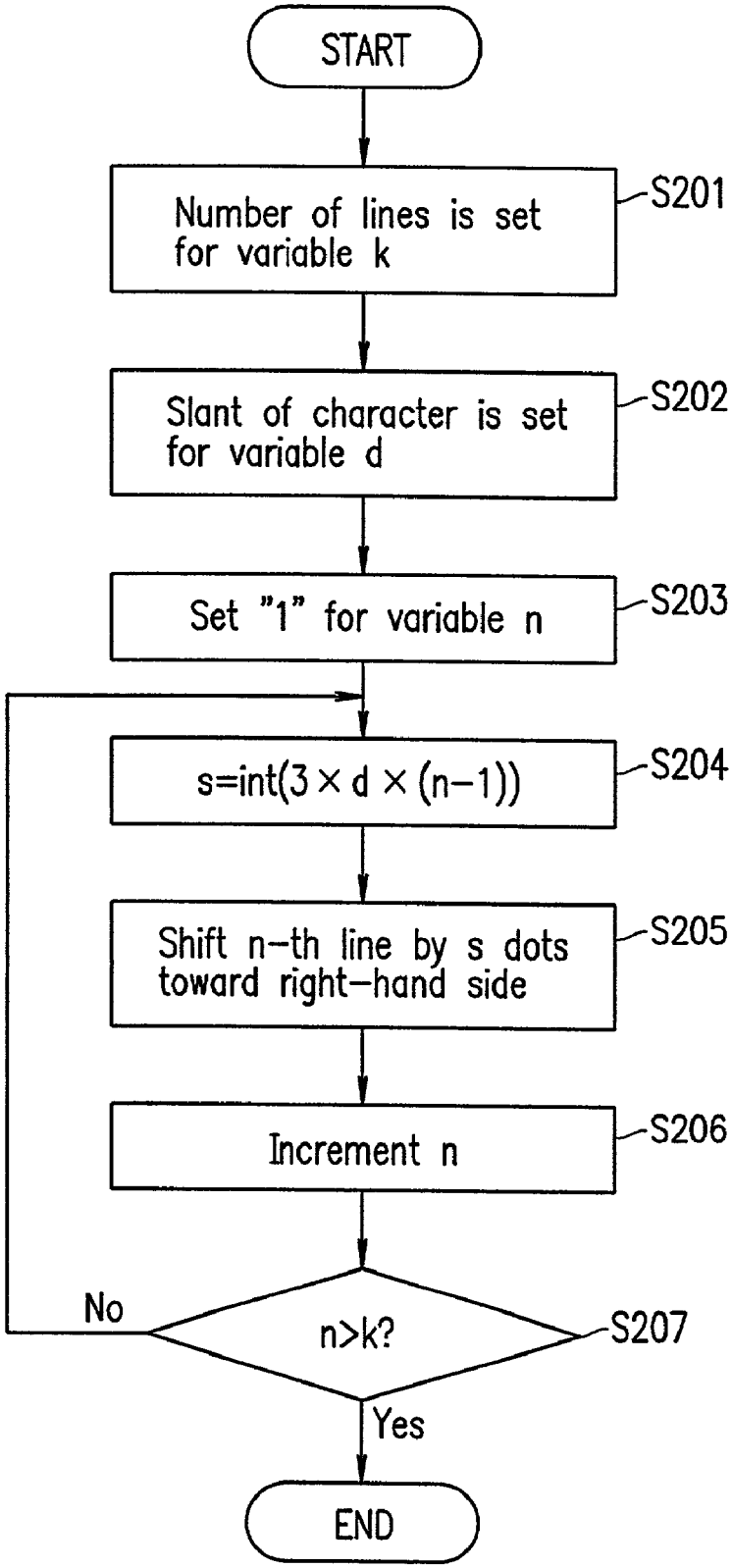
FIG. 8 is a flowchart illustrating the details of italicization processing at step S103 of FIG. 7.

FIG. 8 is a flowchart illustrating the details of the italicization processing at step S103. Each step in the italicization processing will now be described with reference to FIG. 8.

Step S201: The number of lines is set for a variable k. Herein, the "number of lines" means the number of dots of the basic portion data of a character along the vertical direction (Y-direction). "Line" means a one-dimensional arrangement of dots along the horizontal direction (X-direction). The number of lines is, for example, 16.

Step S202: The slant degree of the character is set for a variable d.

Step S203: A value "1" is set for a variable n. The variable n indicates that the n-th line from the bottom of the character is to be subjected to shift processing for italicization.

Step S204: A value obtained using following expression (1) is set for a variable s, $$s=\mathrm{int}(3\times d\times(n-1)) \quad (1),$$

where the function "int(x)" represents a number obtained by removing a decimal part from an argument x. The coefficient "3" in expression (1) corresponds to the number of sub-pixels included in the pixel 12 (FIG. 1) in this exemplary case.

Step S205: Each dot included in the n-th line from the bottom of the character is shifted by s dots along the X-direction towards the right-hand side (of FIG. 4, for example).

As apparent from expression (1), the variable s is an integer. The number of dots by which each dot is shifted can be set by units of one dot. Since one dot of the basic portion data corresponds to one sub-pixel, the number of dots by which each dot is shifted can be set by units of one sub-pixel.

Step S206: The value of the variable n is incremented by 1.

Step S207: Whether or not the value of the variable n is greater than the value of the variable k is determined. If the determination at step S207 is "Yes", the processing terminates. Determination of "Yes" at step S207 means that the processing from step S204 to step S207 has been performed on all of the lines of the basic portion data. If the determination at step S207 is "No", the processing returns to step S204.

Figure 9:
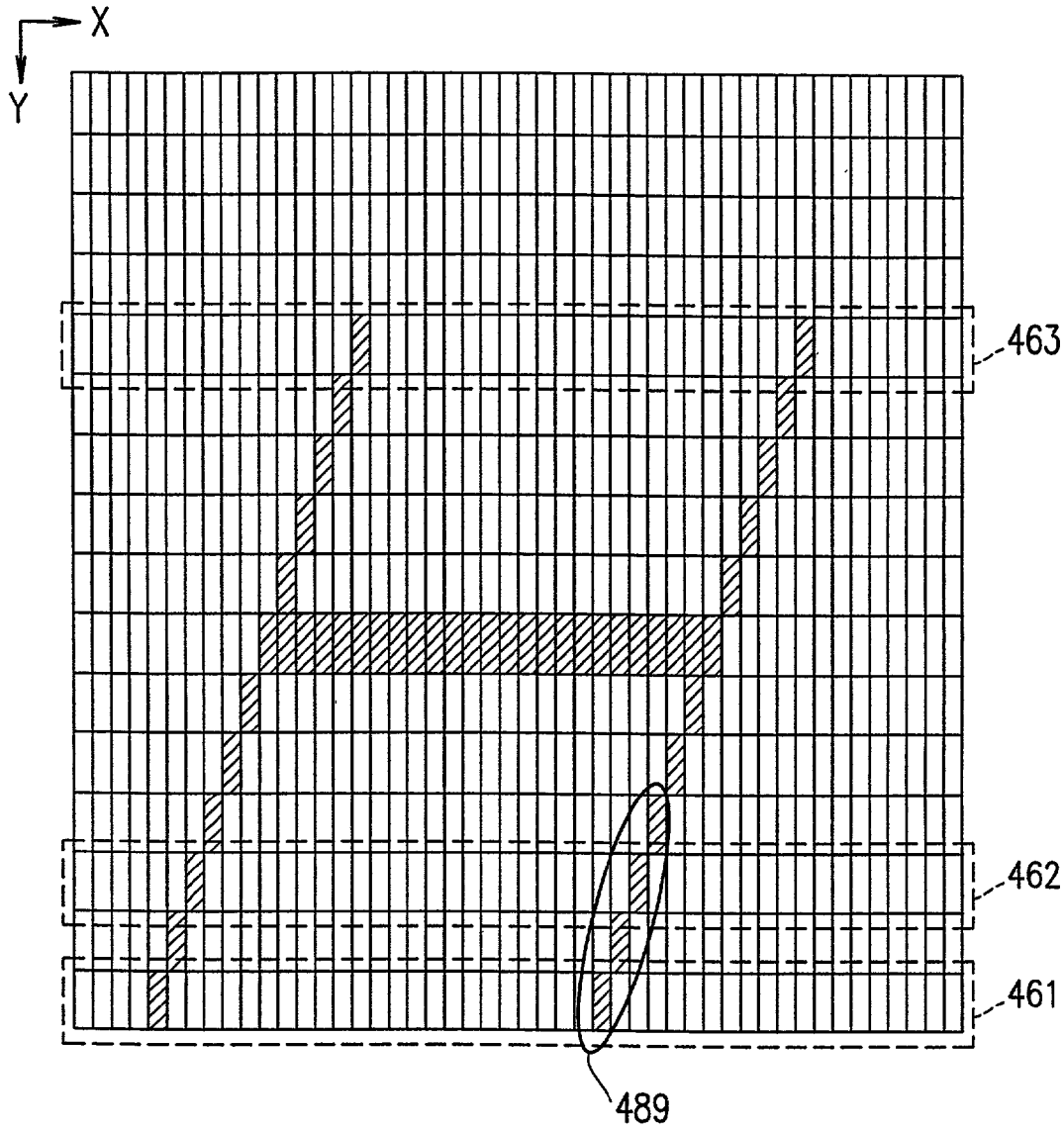
FIG. 9 shows italicized basic portion data obtained by performing italicization processing on the basic portion data shown in FIG. 4.

FIG. 9 shows italicized basic portion data obtained by performing the above italicization processing on the basic portion data shown in FIG. 4. In the example illustrated in FIG. 9, each hatched box represents a dot corresponding to a basic portion of an italic character "H".

The arrangement of dots in a line 461 is the same as that in a line 451 in FIG. 4 (i.e., the shift amount is 0). The arrangement of dots in a line 462 is obtained by shifting each of the dots in a line 452 of FIG. 4 by 2 dots along the X-direction towards the right-hand side (positive X-direction). The arrangement of dots in a line 463 is obtained by shifting each of the dots in a line 453 of FIG. 4 by 11 dots along the X-direction towards the right-hand side.

In the basic portion data (first bit map) shown in FIG. 4, a line 411 running through a center of the dots in the line 451, in which the shift amount is 0, along the X-direction is a reference line. In this example, it is understood that each of the dots which form the basic portion data is shifted by a shift amount determined in proportion to the distance between the reference line 411 and each dot, whereby the italicized basic portion data (second bit map) shown in FIG. 9 can be obtained.

In the example illustrated in FIGS. 4 and 9, the shift amount for each dot included in the basic portion data shown in FIG. 4 increases by 1 dot every time the distance from the reference line 411 increases by 1 dot.

For example, the distance between a dot included in the line 452 (FIG. 4) and the reference line 411 is 2 dots. Accordingly, the shift amount of the dot included in the line 452 is 2 dots. The distance between a dot included in the line 453 (FIG. 4) and the reference line 411 is 11 dots. Accordingly, the shift amount of the dot included in the line 453 is 11 dots. Herein, the distance between a dot and the reference line means a distance between the center of the dot and the reference line.

In the example illustrated in FIG. 4, the reference line 411 runs through a center of the dots in the lowermost line of the basic portion data, but the position of the reference line is not limited thereto. The reference line can be set to any position so long as it runs along the X-direction.

Figure 10:
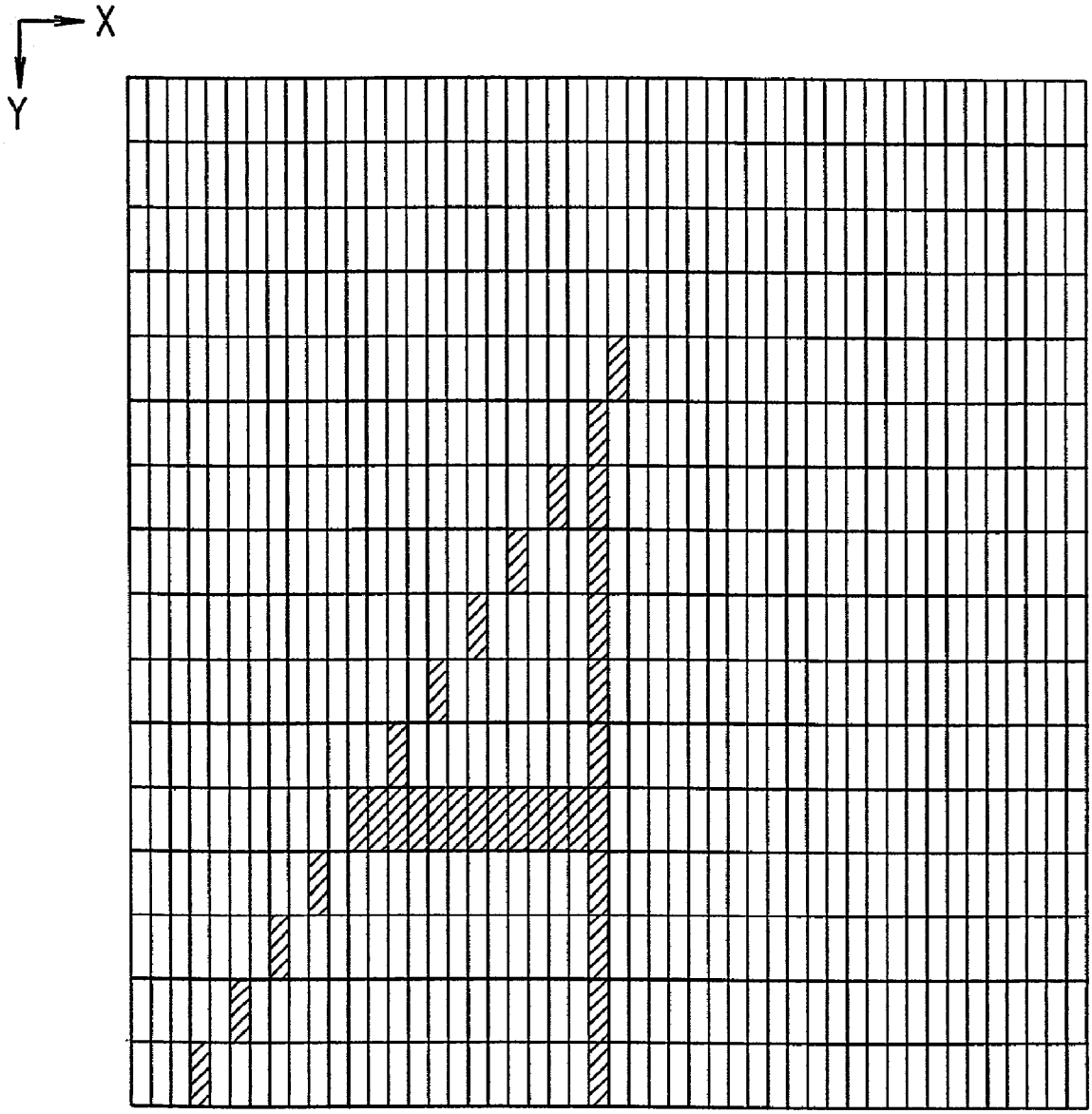
FIG. 10 shows italicized basic portion data obtained by performing italicization processing on the basic portion data shown in FIG. 5.

FIG. 10 shows italicized basic portion data obtained by performing the italicization processing on the basic portion data shown in FIG. 5. In the example illustrated in FIG. 10, each hatched box represents a dot corresponding to a basic portion of an italic character "A".

Figure 11:
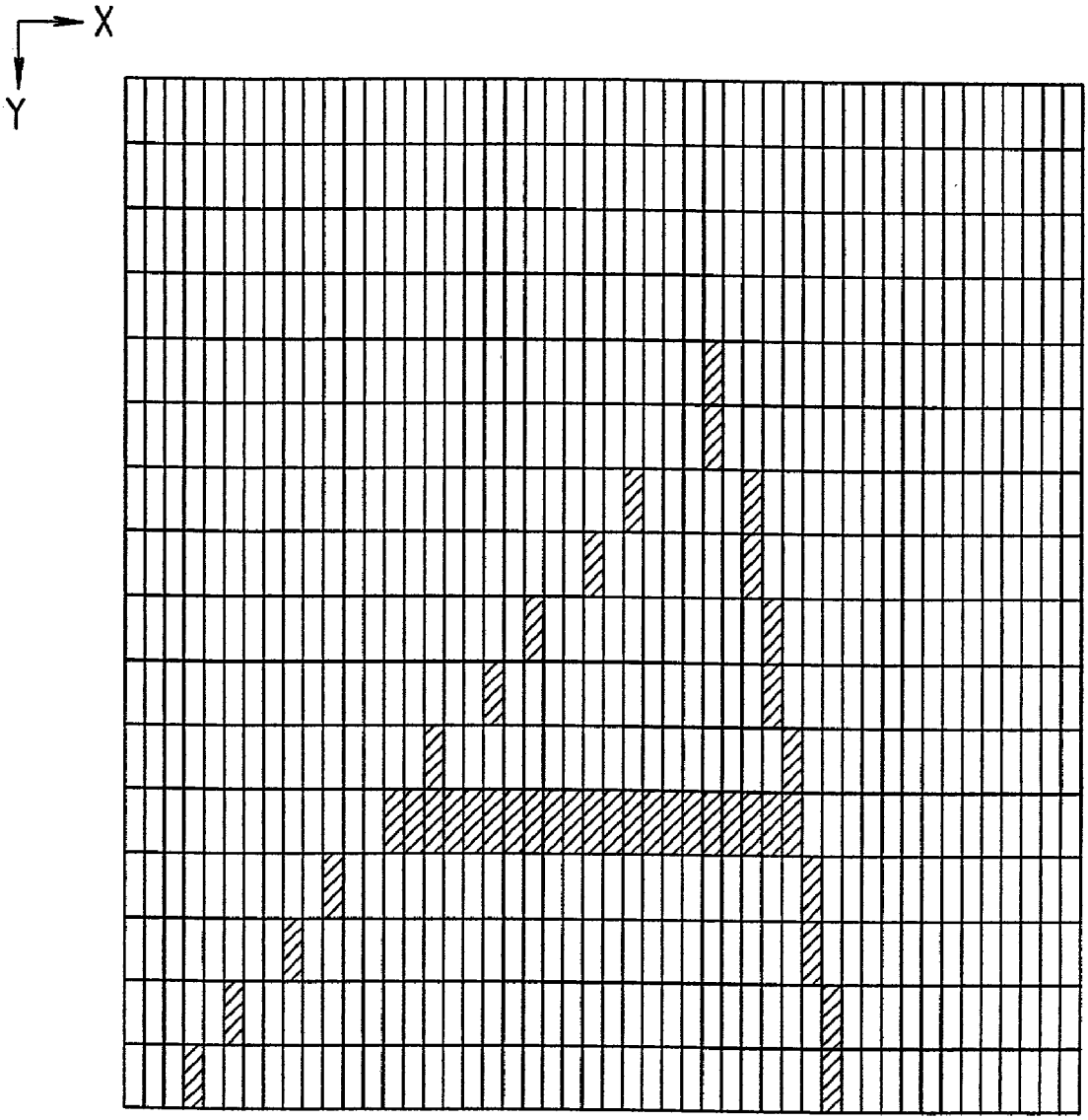
FIG. 11 shows italicized basic portion data obtained by performing italicization processing on the basic portion data shown in FIG. 6.

FIG. 11 shows italicized basic portion data obtained by performing the italicization processing on the basic portion data shown in FIG. 6. In the example illustrated in FIG. 11, each hatched box represents a dot corresponding to a basic portion of an italic character "A". The example of FIG. 11 is different from the example of FIG. 10 in the degree of the oblique lines of the character "A".

The results of the brightness level on the display device 10 controlled based on the italicized basic portion data shown in FIGS. 9 through 11 are not shown. This is because one dot of each of the italicized basic portion data shown in FIGS. 9 through 11 corresponds to one sub-pixel of the display device 10, and thus, the results of the brightness level on the display device 10 controlled based on the italicized basic portion data shown in FIGS. 9 through 11 are the same as the illustrations of the italicized basic portion data shown in FIGS. 9 through 11, respectively.

Figure 42A:
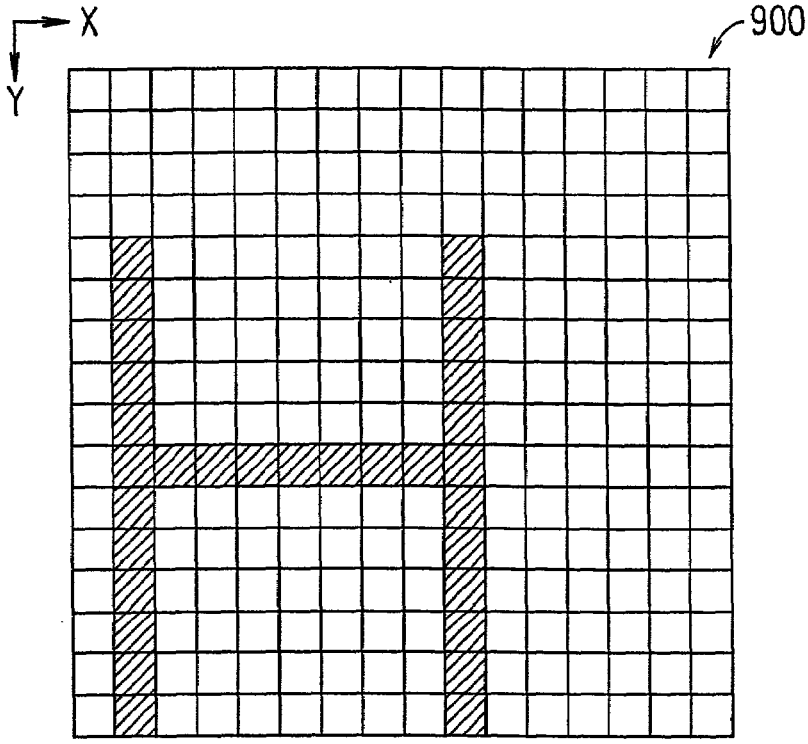
FIG. 42A shows an example of a character "H" of the English language alphabet displayed on a display plane 900 of 16 pixels×16 pixels based on a bit map defined by units of a pixel.
Figure 42B:
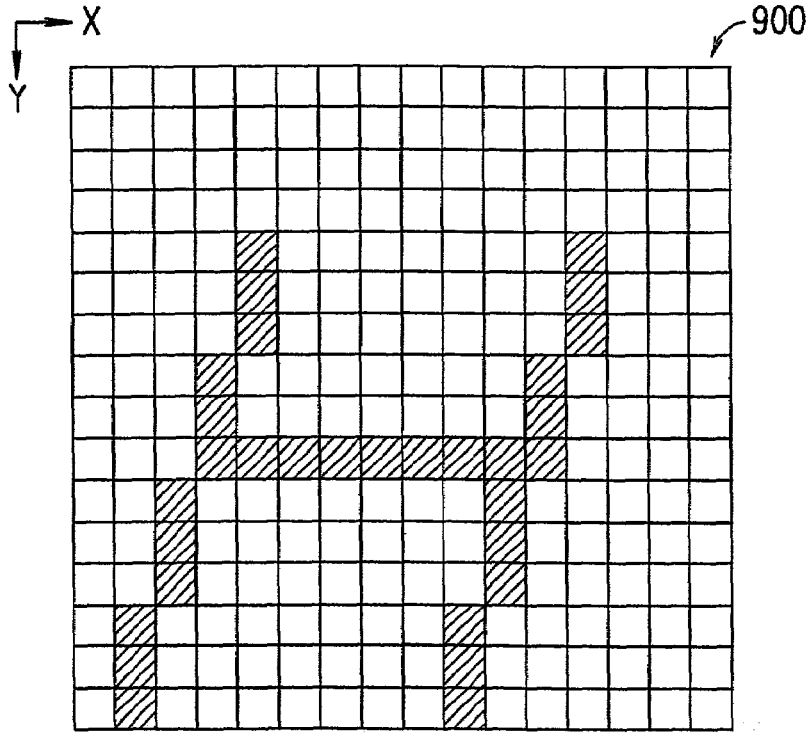
FIG. 42B shows an example of an italic character "H" displayed on the display plane 900 based on a bit map obtained by deforming the bit map of FIG. 42A defined by units of a pixel.
Figure 43A:
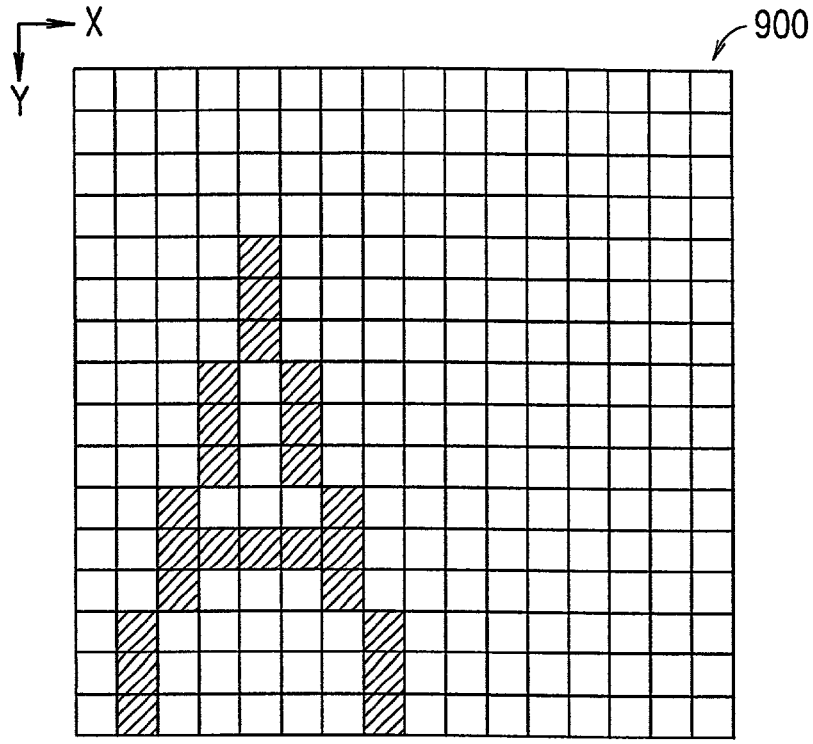
FIG. 43A shows an example of a character "A" of the English language alphabet displayed on a display plane 900 of 16 pixels×16 pixels based on a bit map defined by units of a pixel.
Figure 43B:
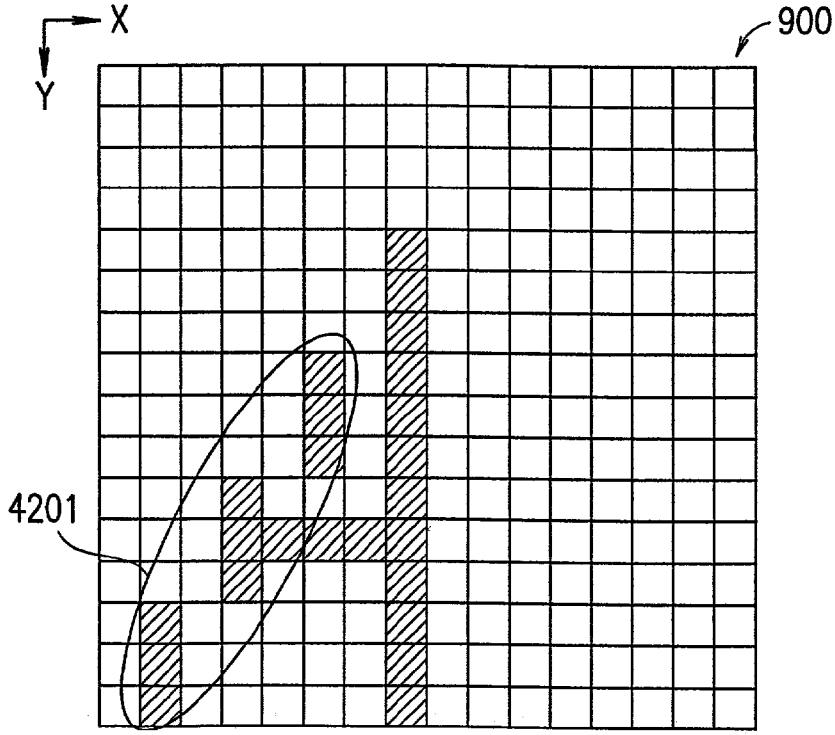
FIG. 43B shows an example of an italic character "A" displayed on the display plane 900 based on a bit map obtained by deforming the bit map of FIG. 43A defined by units of a pixel.
Figure 44A:
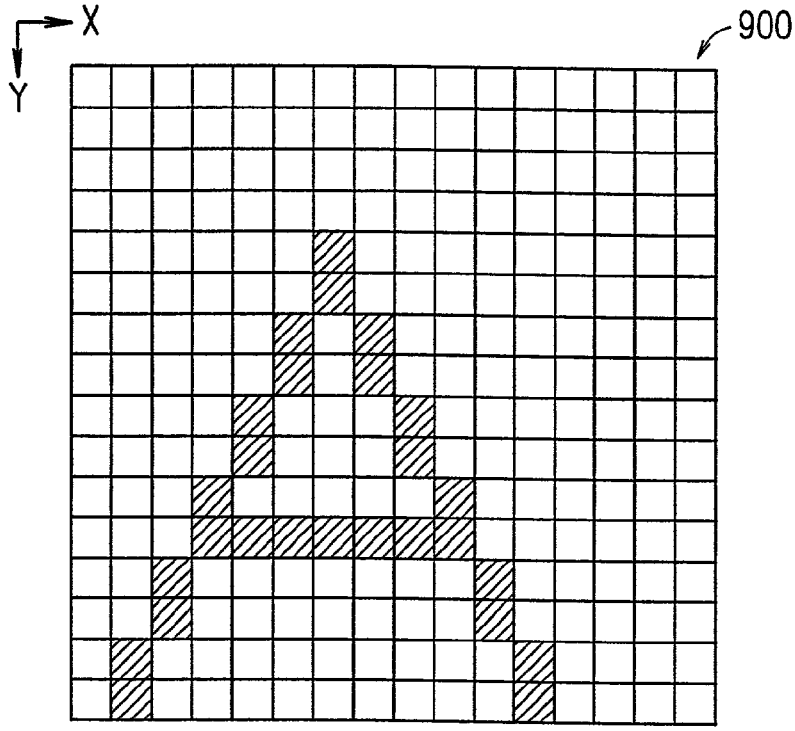
FIG. 44A shows another example of the character "A" displayed on a display plane 900 of 16 pixels×16 pixels based on another bit map defined by units of a pixel.
Figure 44B:
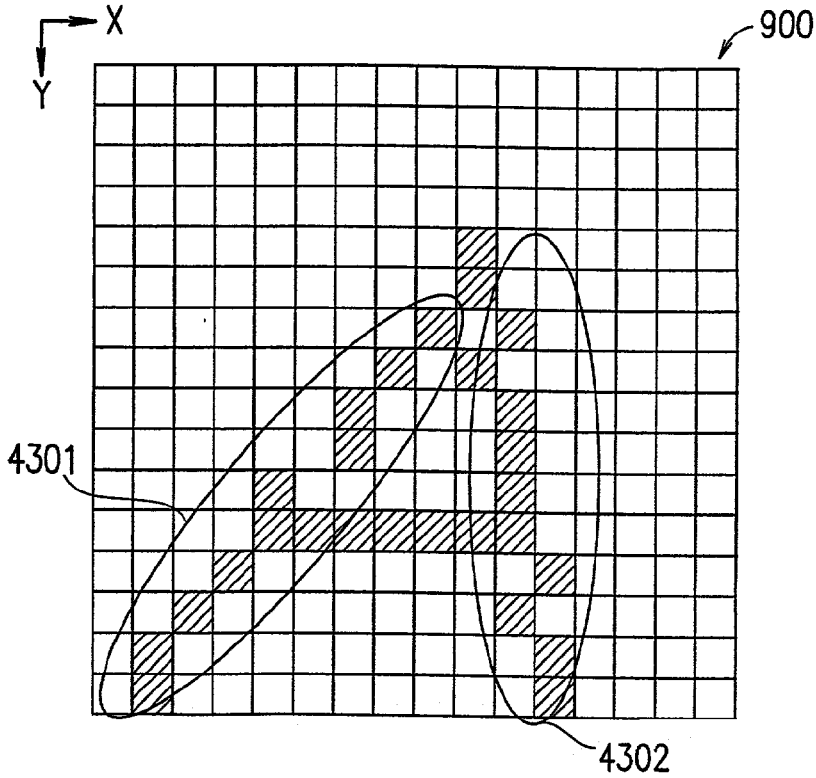
FIG. 44B shows another example of the italic character "A" displayed on the display plane 900 based on a bit map obtained by deforming the bit map of FIG. 44A.

Comparing FIGS. 9 through 11 with FIGS. 42B, 43B, and 44B, it is understood that the present invention provides an effect of displaying an italic character with high quality. From FIGS. 10 and 11, it is understood that such an effect of the present invention can be similarly obtained even when the slant degree of the oblique lines of the character "A" are changed. In the example illustrated in FIGS. 9 through 11, the character slant is set to ⅓.

Each of the basic portion data shown in FIGS. 4 through 6 has a blank space at the right-hand side in consideration of italicization processing. However, the basic portion data does not need to have a blank space in consideration of italicization processing. For example, the basic portion data shown in FIG. 4 demarcates a region 458, and the region 458 includes a large blank space. However, the basic portion data may demarcate its area such that the blank portion is minimized. For example, the basic portion data may demarcate a region 454 (FIG. 4). By demarcating the region such that the blank space is minimized, the number of dots which form the basic portion data is reduced, and accordingly, the amount of data can be reduced. After the italicization processing has been performed on the basic portion data, if a demarcated region of the italicized basic portion data does not have a sufficient size such that the basic portion of an italic character can be defined within the demarcated region, the demarcated region is expanded such that the basic portion of the italic character can be defined within the expanded demarcated region.

In the example illustrated in FIG. 7, the acquisition of the basic portion data at step S102 is achieved by reading the basic portion data included in the character data 42*a* stored in the auxiliary storage apparatus 40. However, a method for acquiring the basic portion data is not limited to such an example. As well as the method for reading from the auxiliary storage apparatus 40, the acquisition of the basic portion data can be achieved by using, for example, any of the following acquisition methods (1) to (3):

(1) A method for generating basic portion data from a bit map defined by units of a pixel;
(2) A method for generating basic portion data from character contour information which represents the outline of a character; and
(3) A method for generating basic portion data from stroke data which represents stroke information of a character.

Hereinafter, each of methods (1) to (3) is described.

First, method (1) for generating basic portion data from a bit map defined by units of a pixel is described with reference to FIGS. 12 through 18.

Figure 12:
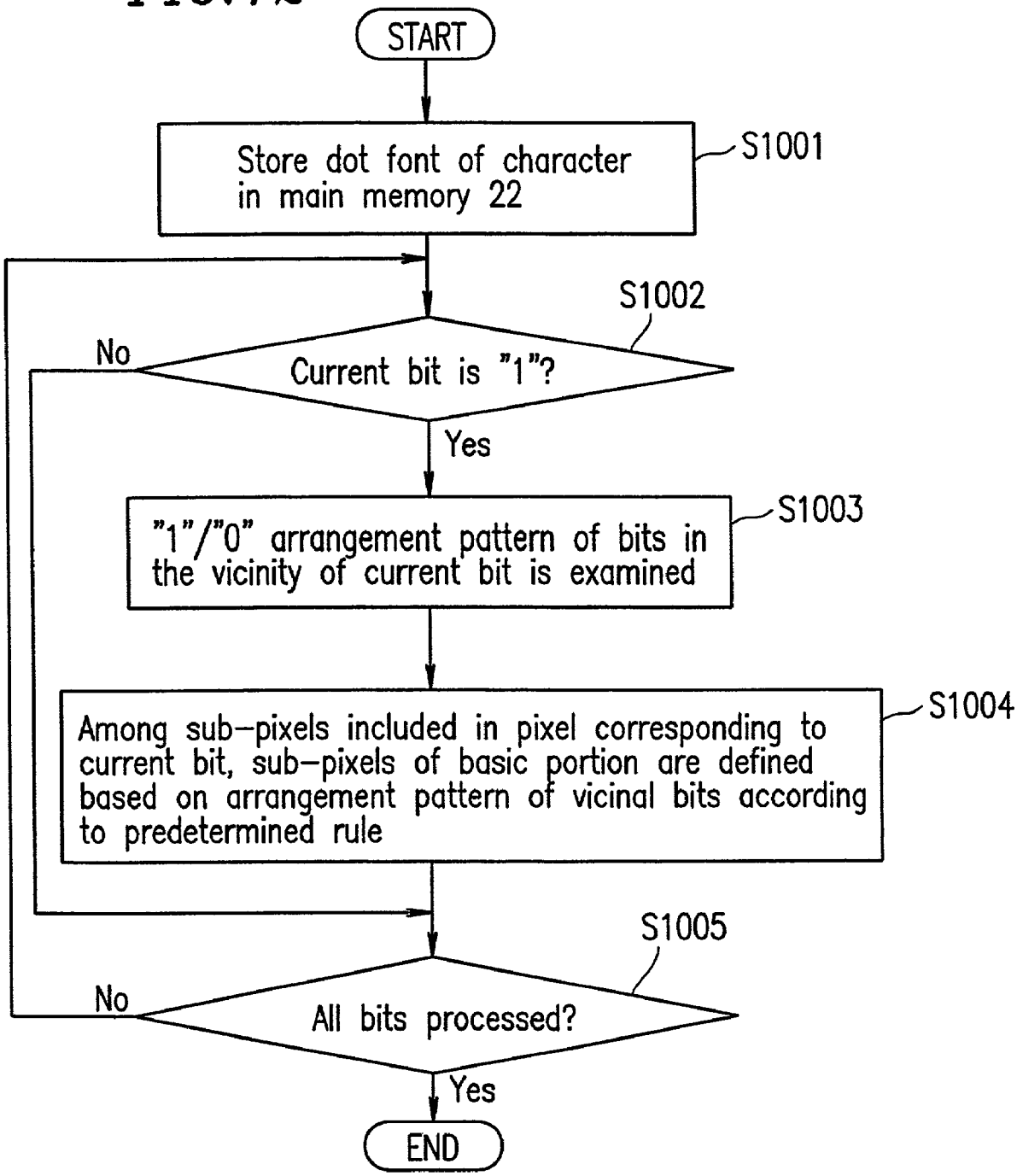
FIG. 12 illustrates a procedure for generating basic portion data from a bit map defined by units of a pixel.

FIG. 12 illustrates a procedure for generating basic portion data from a bit map defined by units of a pixel. This processing is executed by the CPU 21 during the processing at step S102 (FIG. 7). Each step in the procedure for generating basic portion data from a bit map defined by units of a pixel will now be described. For example, the bit maps previously described with reference to FIGS. 42A, 43A, and 44A may be used.

Step S1001: A bit map for one character defined by units of a pixel which corresponds to the character code and character size of the character input at step S101 (FIG. 7) is stored in the main memory 22. This bit map defined by units of a pixel is included in the character data 42*a* stored in the auxiliary storage apparatus 40.

Step S1002: It is determined whether or not each bit which forms the bit map defined by units of a pixel is "1". If "Yes" at Step S1002, the process proceeds to Step S1003. If "No" at Step S1002, the process proceeds to Step S1005.

Step S1003: A "1"/"0" arrangement pattern of bits located in the vicinity of a current bit is examined.

Step S1004: Among sub-pixels included in the pixel corresponding to the current bit, a sub-pixel corresponding to a basic portion of the character is defined based on the "1"/"0" arrangement pattern of the bits located in the vicinity of the current bit. This determination of a sub-pixel corresponding to a basic portion is achieved according to a predetermined basic portion definition rule. This basic portion definition rule will be described later with reference to FIGS. 15A, 15B, 16A, 16B, 17A, and 17B.

Step S1005: It is determined whether steps S1002–S1004 have been performed for all of the bits which form the bit map defined by units of a pixel. If "No" at step S1005, the process returns to step S1002. If "Yes" at step S1005, the process terminates.

Figure 13:
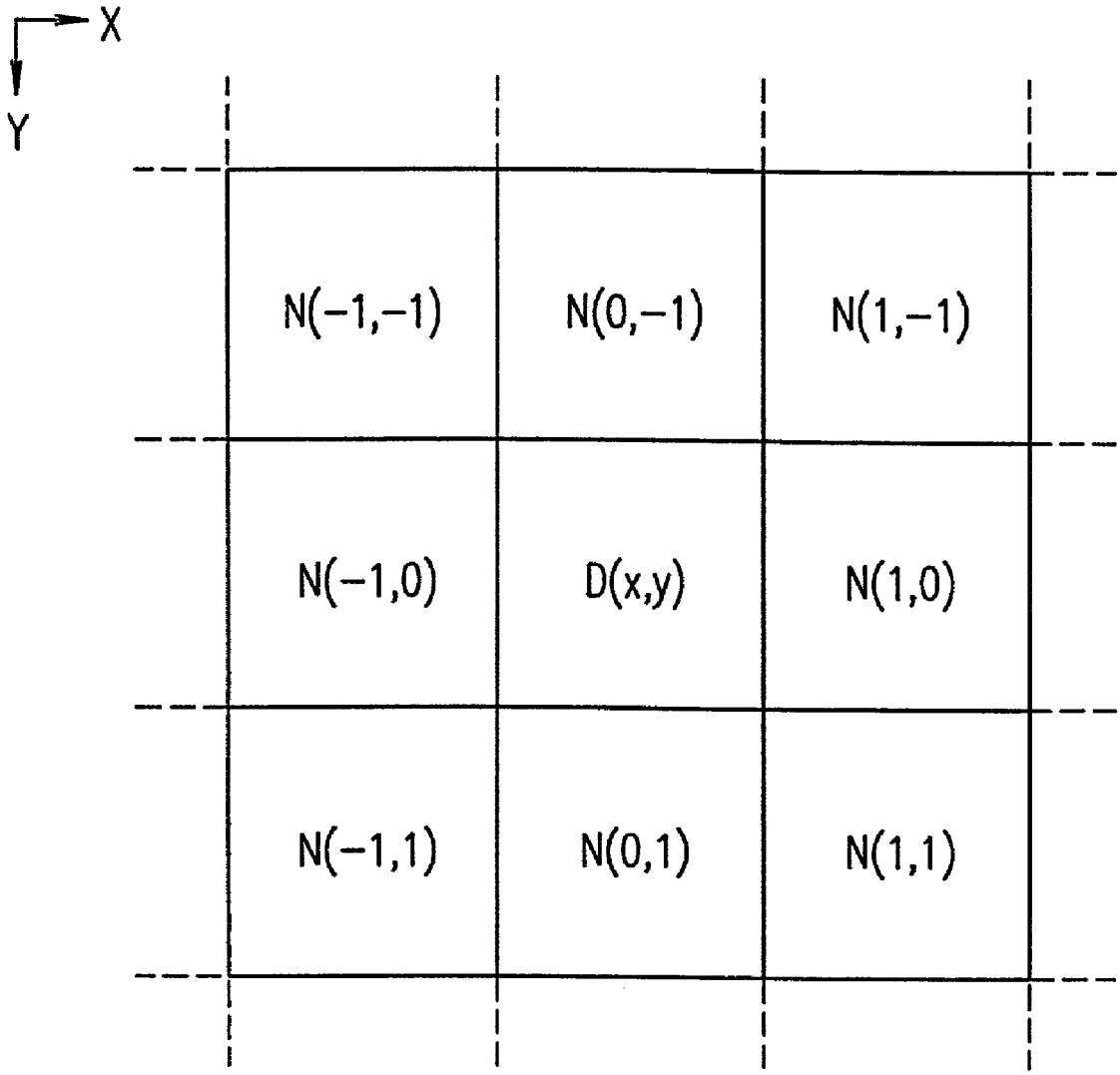
FIG. 13 shows a portion of a bit map defined by units of a pixel which represents a character.

FIG. 13 shows a portion of a bit map defined by units of a pixel which represents a character. D(x,y) is a current bit. In this example, a bit in the vicinity of the current bit, D(x+a,y+b), is represented as N(a,b). FIG. 13 shows eight vicinal bits which are vertically, horizontally, or diagonally adjacent to the current bit D(x,y), i e., N(−1,−1), N(0,−1), N(1,−1), N(−1,0), N(1,0), N(−1,1), N(0,1), and N(1,1). These eight vicinal bits are referred to as "eight neighborhoods". It should be noted that the bit map defined by units of a pixel which is used in the present invention contains binary data, i.e., each bit which forms the bit map defined by units of a pixel has a value of "1" or "0". A bit having a value of "1" corresponds to a black area of a character. A bit having a value of "0" corresponds to a white area of the character. The bits N(a,b) and D(x,y) each have a value of "1" or "0".

Figure 14:
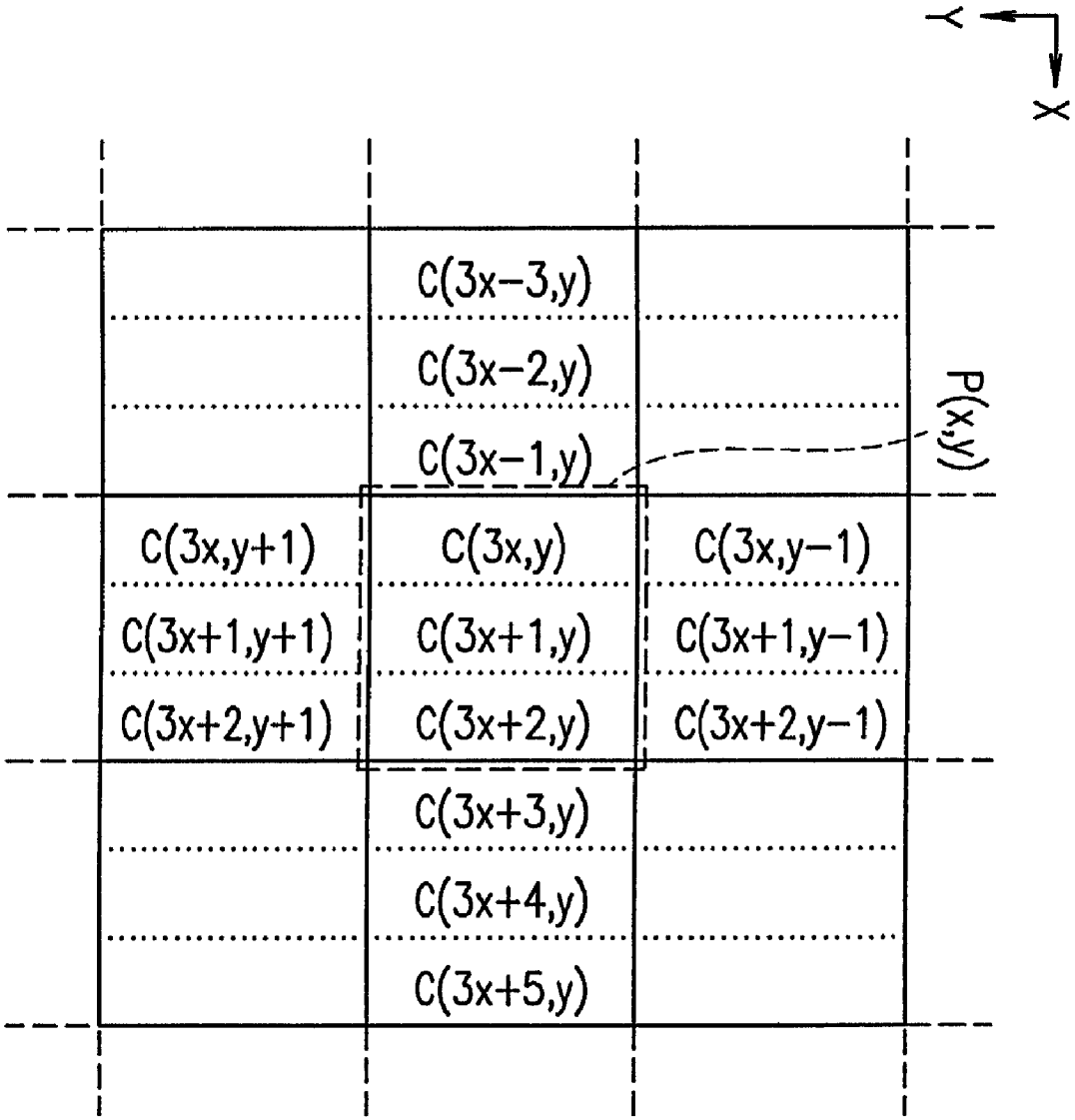
FIG. 14 shows a portion of a display plane of the display device 10.

FIG. 14 shows a portion of a display plane of the display device 10. P(x,y) is a pixel on the display plane. The bit D(x,y) of FIG. 13 is assigned to the pixel P(x,y). The pixel P(x,y) includes three sub-pixels, C(3x,y), C(3x+1,y), and C(3x+2,y). When the bit D(x,y) has a value of "1", among the three sub-pixels, C(3x,y), C(3x+1,y), and C(3x+2,y), a sub-pixel for the basic portion is defined according to the basic portion definition rule. When the bit D(x,y) has a value of "0", none of the three sub-pixels is defined as a sub-pixel for the basic portion.

According to the basic portion definition rule, whether or not each of the three sub-pixels included in the pixel P(x,y) is defined as a sub-pixel for the basic portion depends on the "0"/"1" arrangement of the bits N(a, b) in the vicinity of the bit D(x,y) assigned to the pixel P(x,y). The basic portion definition rule is now described. In the below description, it is assumed that the bit D(x,y) has a value of "1".

Figure 15A:
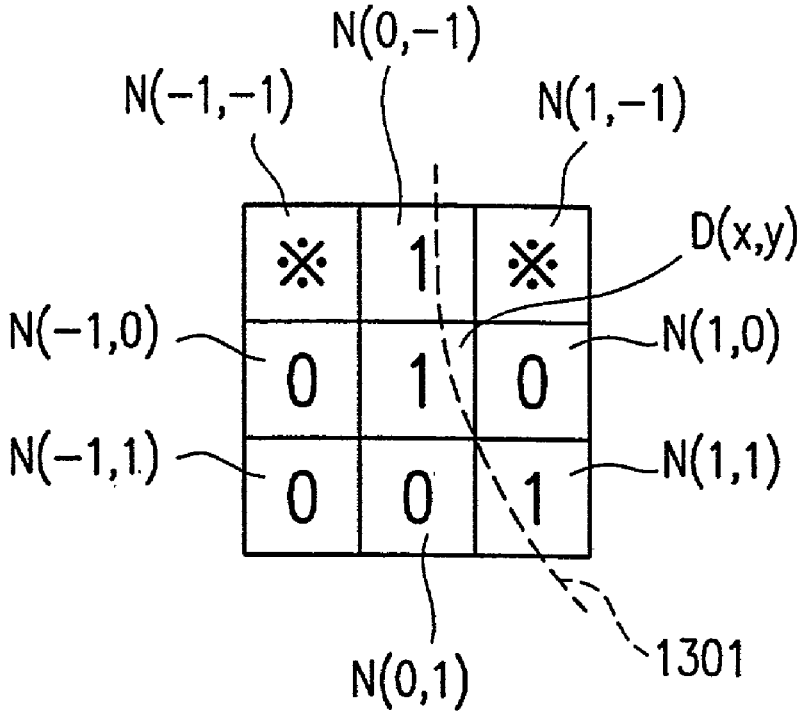
FIG. 15A shows an example of eight neighborhoods around a current bit D(x,y) in the bit map defined by units of a pixel.

FIG. 15A shows an example of eight neighborhoods around the current bit D(x,y) in the bit map defined by units of a pixel. In the following description, a bit N(a,b) which has a value of "1" is represented as "N(a,b)=1". For example, in FIG. 15A, N(0,−1)=N(1,1)=1, and N(1,0)=N(0, 1)=N(−1,1)=N(−1,0)=0. In FIG. 15A, bits N(−1,−1) and N(1,−1) indicated by "X" each have any value of "0" and "1". Similarly in FIGS. 16A and 17A, a bit indicated by "X" has any value of "0" and "1". These bits are not considered in the basic portion definition rule.

Figure 15B:
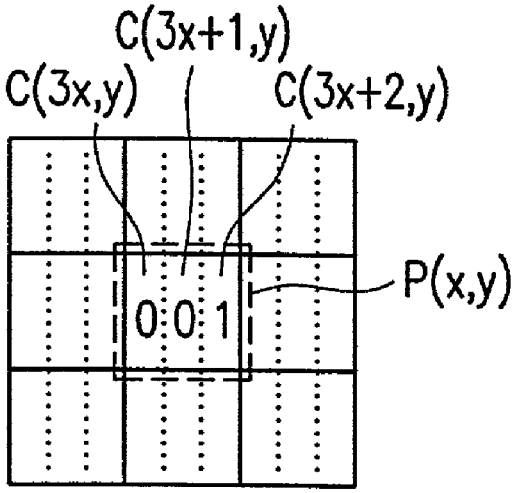
FIG. 15B shows sub-pixels defined as sub-pixels for the basic portion based on a basic portion definition rule when the eight neighborhood bits around the bit D(x,y) have the values shown in FIG. 15A.

FIG. 15B shows sub-pixels defined as sub-pixels for the basic portion based on the basic portion definition rule when the eight neighborhood bits around the bit D(x,y) have values shown in FIG. 15A. A pixel P(x,y) on the display screen which is assigned to the bit D(x,y) includes three sub-pixels, C(3x,y), C(3x+1,y), and C(3x+2,y). Among these sub-pixels shown in FIG. 15B, a sub-pixel labeled with "1" is defined as a sub-pixel for the basic portion, and sub-pixels labeled with "0" are not defined as a sub-pixel for the basic portion. That is, the sub-pixel C(3x+2,y) is defined as a sub-pixel for the basic portion, and the sub-pixels C(3x,y) and C(3x+1,y)are not defined as a sub-pixel for the basic portion.

The basic portion definition rule described with reference to FIGS. 15A and 15B can be represented by using logical expressions.

In the following description, when logical values A and B are given, for example, "A*B" denotes a logical AND of the logical values A and B, "!A" denotes a logical NOT of the logical value A. When this rule is applied, in the case where the eight neighborhood bits around the bit D(x,y) have the values shown in FIG. 15A, logical expression (2) is satisfied:

$$N(0,-1)*!N(-1,0)*!N(1,0)*!N(-1,1)*!N(0,1)*!N(1,1)=1 \quad (2).$$

Furthermore, the above process in which the sub-pixel C(3x+2,y) (FIG. 15B) is defined as a sub-pixel for the basic portion and the sub-pixels C(3x,y) and C(3x+1,y) are not defined as a sub-pixel for the basic portion can be represented by expressions (3):

$$C(3x,y)=0,\ C(3x+1,y)=0,\ C(3x+2,y)=1 \quad (3).$$

The "basic portion" of a character refers to a portion of a character which must be necessarily displayed when the character is displayed on the display device. If a central portion of each stroke included in the character is a portion which must be necessarily displayed when the character is displayed, the basic portion must be defined by an estimation because the bit map defined by units of a pixel does not include information about the strokes. The basic portion cannot be estimated from only information on the current bit D(x,y) but can be estimated from information on the bits located in the vicinity of the current bit D(x,y). For example, from the bit map defined by units of a pixel which is shown in FIG. 15A, it is estimated that the stroke is a curve which passes through a region corresponding to the bits N(0,−1), D(x,y), and N(1,1) (shown by a broken line 1301 in FIG. 15A). As indicated, this curve is considered to pass through the right side of the region corresponding to the bit D(x,y). Thus, referring to FIG. 15B, the sub-pixel C(3x+2,y) included in the right side of the pixel P(x,y) assigned to the bit D(x,y) is defined as a sub-pixel of the basic portion.

The basic portion definition rule is generated based on the above estimation. The generated basic portion definition rule is represented by the above logical expressions, and used at step S1004 in the process shown in FIG. 12.

Figure 16A:
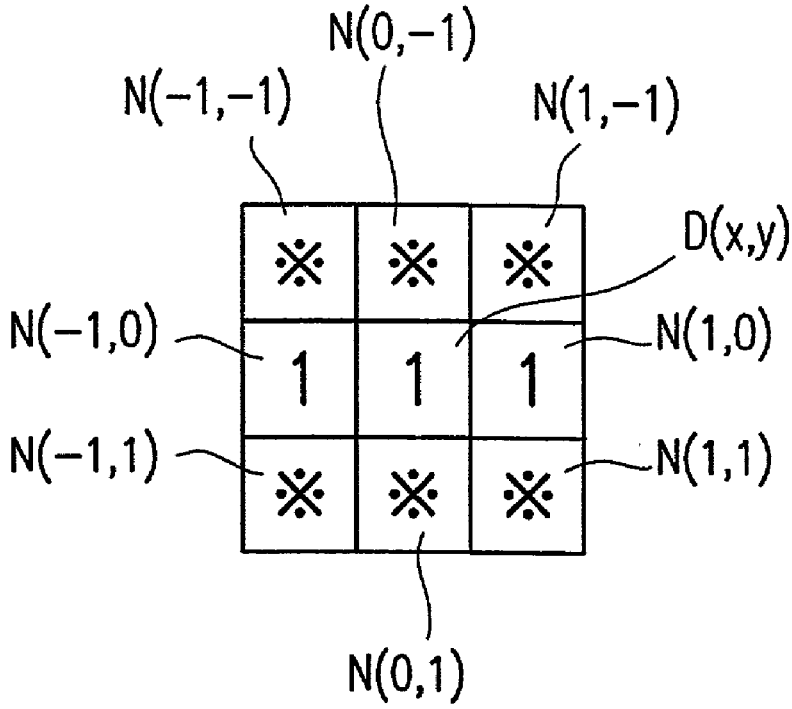
FIG. 16A shows another example of eight neighborhoods around a current bit D(x,y) in the bit map defined by units of a pixel.

FIG. 16A shows another example of eight neighborhoods around the current bit D(x,y) in the bit map defined by units of a pixel.

Figure 16B:
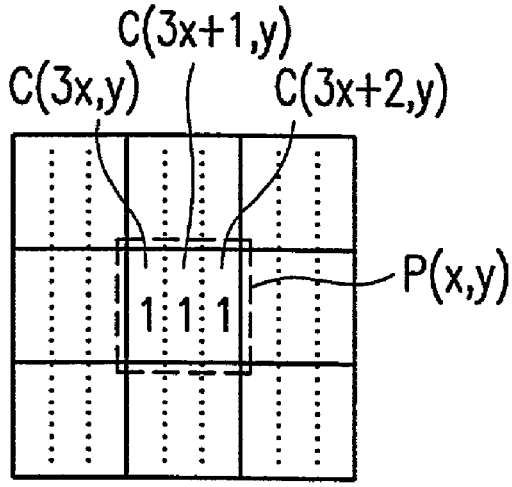
FIG. 16B shows sub-pixels defined as sub-pixels for the basic portion based on a basic portion definition rule when the eight neighborhood bits around the bit D(x,y) have the values shown in FIG. 16A.

FIG. 16B shows sub-pixels defined as sub-pixels for the basic portion based on the basic portion definition rule when the eight neighborhood bits around the bit D(x,y) have values shown in FIG. 16A. The basic portion definition rule represented by FIGS. 16A and 16B can be represented by using the following logical expressions (4):

$$\text{when } N(-1,0)*N(1,0)=1,$$

$$C(3x,y)=1,\ C(3x+1,y)=1,\ C(3x+2,y)=1 \quad (4).$$

Figure 17A:
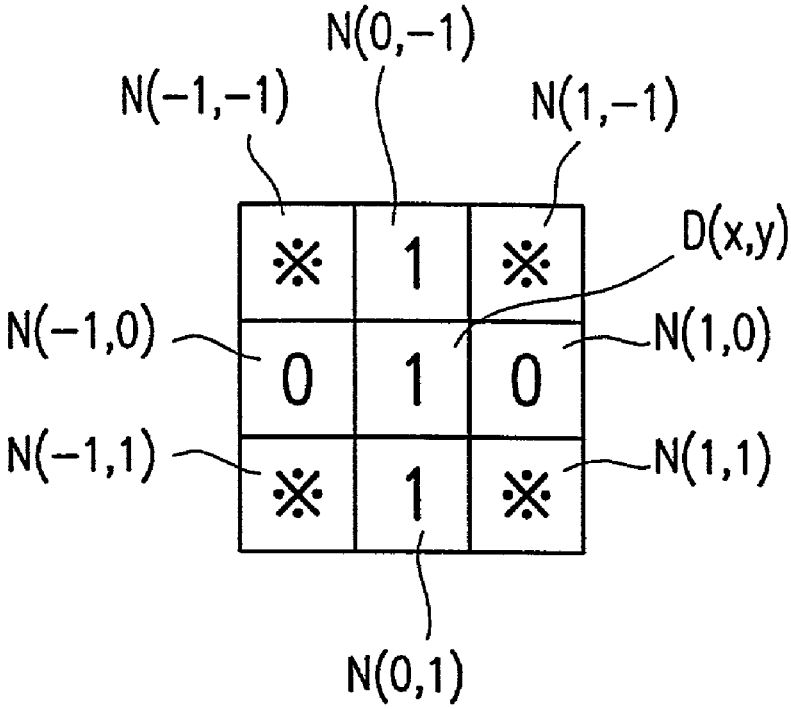
FIG. 17A shows still another example of eight neighborhoods around a current bit D(x,y) in the bit map defined by units of a pixel.

FIG. 17A shows still another example of eight neighborhoods around the current bit D(x,y) in the bit map defined by units of a pixel.

Figure 17B:
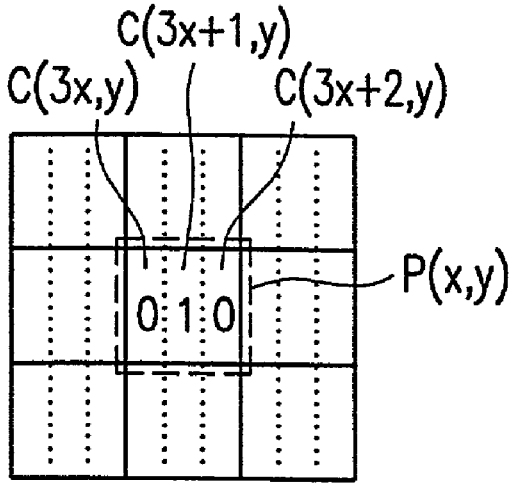
FIG. 17B shows sub-pixels defined as sub-pixels for the basic portion based on a basic portion definition rule when the eight neighborhood bits around the bit D(x,y) have the values shown in FIG. 17A.

FIG. 17B shows sub-pixels defined as sub-pixels for the basic portion based on the basic portion definition rule when the eight neighborhood bits around the bit D(x,y) have values shown in FIG. 17A. The basic portion definition rule represented by FIGS. 17A and 17B can be represented by using the following logical expressions (5):

$$\text{when } N(0,-1)*!N(-1,0)*!N(1,0)*N(0,1)=1,$$

$$C(3x,y)=0,\ C(3x+1,y)=1,\ C(3x+2,y)=0 \quad (5).$$

The above basic portion definition rule is applied to each of the eight neighborhood bits around the current bit D(x,y) so as to select "1" or "0" for the bit, whereby a basic portion of a character to be italicized is defined by units of a sub-pixel.

In this way, basic portion data which defines a basic portion of a character by units of a sub-pixel is generated.

Figure 18:
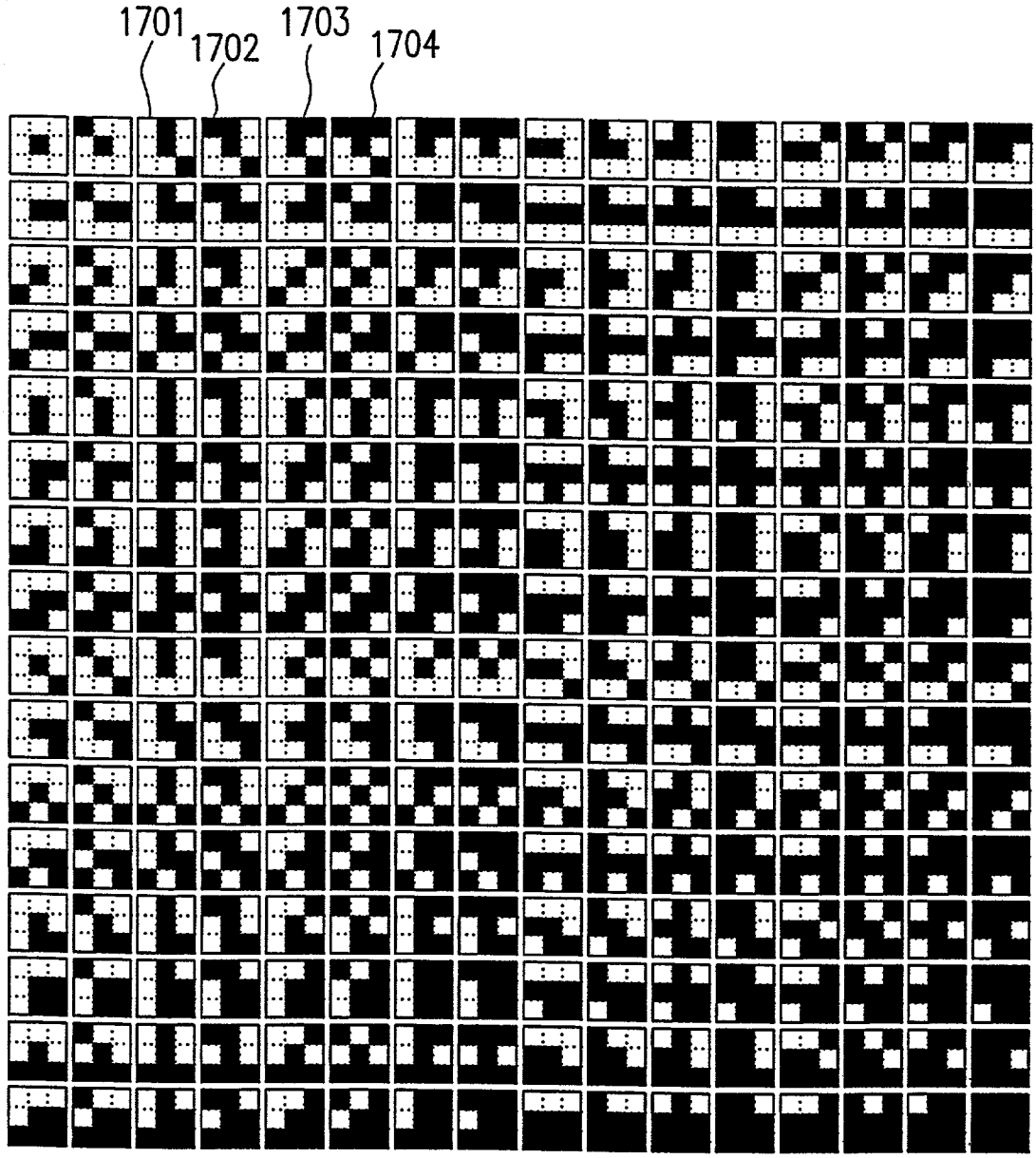
FIG. 18 shows all "1"/"0" arrangement patterns of the eight neighborhood dots around the current bit D(x,y).

FIG. 18 shows all "1"/"0" arrangement patterns of the eight neighborhood bits around the current bit D(x,y). Each box shown in FIG. 18 includes the current bit D(x,y) and the eight neighborhood bits therearound. Each box is divided into nine regions. Each black region corresponds to a bit having a value of "1", and each white region corresponds to a bit having a value of "0". FIG. 18 shows 256 boxes. This is because each neighborhood bit has a value of "1" or "0", and accordingly, the number of the "1"/"0" arrangement patterns results in $2^8$=256 patterns. However, the number of basic portion definition rules is not necessarily required to be the same as the number of the "1"/"0" arrangement patterns, i.e., 256. As previously described, in FIGS. 15A, 16A, and 17A, bits indicated by "X" each have any value of "0" and "1" and are not considered in the basic portion definition rule. Since the basic portion definition rule includes bits which are not considered therein, one basic portion definition rule can cover a plurality of "1"/"0" arrangement patterns among those shown in FIG. 18. For example, the basic portion definition rule represented by FIGS. 15A and 15B covers the "1"/"0" arrangement patterns shown in the boxes 1701, 1702, 1703, and 1704 of FIG. 18. Thus, when the basic portion definition rule includes a bit which takes any value of "1" or "0", the number of the basic portion definition rules required for the present invention can be reduced.

The basic portion definition rule may be described in the form of a group of logical expressions as described above or in the form of table data.

By applying the above basic portion definition rule to the bit map which defines the character "H" by units of a pixel (previously described with reference to FIG. 42A), the basic portion data shown in FIG. 4 can be generated. Similarly, by applying the above basic portion definition rule to the bit maps which define the character "A" by units of a pixel (previously described with reference to FIGS. 43A and 44A), the basic portion data shown in FIGS. 5 and 6 can be generated, respectively.

By using the method described above with reference to FIGS. 12 through 18 where basic portion data is generated from a bit map defined by units of a pixel, an italic character can be displayed with high quality based on dot fonts which are widely used in the applications of a computer, a portable phone, etc. The dot fonts are bit maps defined by units of a pixel, each of which defines the shape of a character by units of a pixel. Thus, the method described with reference to FIGS. 12 through 18 can be applied to the dot fonts.

The basic portion definition rule is not limited to the above example. As the basic portion definition rule, any rule based on which a bit map (basic portion data) for defining a basic portion of a character by units of a sub-pixel is generated from a bit map defined by units of a pixel can be adopted. For example, according to one of the possible rules, "if the bit D(x,y) is 1, the sub-pixels are set such that C(3x,y)=1, C(3x+1,y)=1, C(3x+2,y)=1, regardless of the values of the eight neighborhood bits around the current bit D(x,y)". The basic portion rule is selected among the various possible definition rules according to which portion of a character is required when the character is displayed on the display device.

Next, method (2) for generating basic portion data from character contour information which represents the outline of a character is described with reference to FIGS. 19 through 21.

Figure 19:
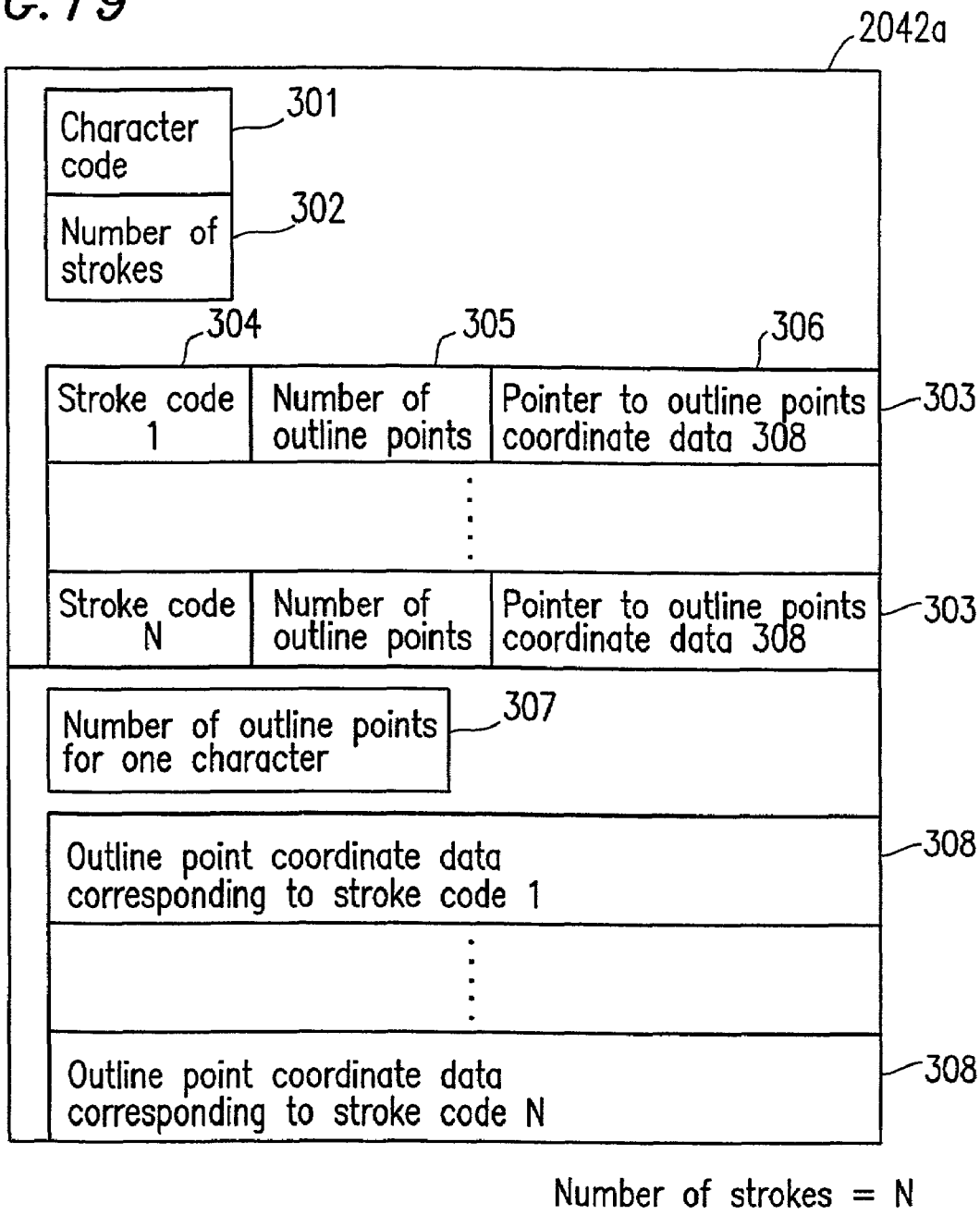
FIG. 19 illustrates a structure of character outline information.

FIG. 19 illustrates a structure of character outline information.

The character outline information 2042*a* includes a character code 301 for identifying the character, data 302 indicating the number of strokes included in the character, and stroke information 303 for each stroke.

The stroke information 303 for each stroke includes a stroke code 304 for identifying the stroke, data 305 indicating the number of outline points included in the stroke, and a pointer 306 to outline points coordinate data 308 which indicates the coordinates of the outline points included in the stroke. The pointer 306 indicates the location in the auxiliary storage apparatus 40 where the outline points coordinate data 308 is stored. By referencing the stroke information 303, the coordinates of each of the outline points included in the stroke can be obtained. It is assumed herein that in the outline points coordinate data 308, the coordinates of the outline points included in the stroke are arranged in the counterclockwise direction.

The number of the stroke information 303 is equal to the number of strokes 302. Therefore, when the number of strokes 302 is N (N is an integer equal to or greater than 1), the character outline information 2042*a* includes N stroke information 303 respectively corresponding to stroke code 1 to stroke code N.

Methods for approximating the outline of a character include, for example: (i) a method for approximating the outline of the character with straight lines; (ii) a method for approximating the outline of the character with a combination of straight lines and arcs; and (iii) a method for approximating the outline of the character with a combination of straight lines and curves (e.g., spline curves).

The character outline information 2042*a* may include as the outline points coordinate data 308 coordinates of a plurality of outline points which are obtained by any of the above methods (i)–(iii). In view of the quality of the character display and the data capacity, the character outline information 2042*a* preferably includes the outline points coordinate data 308 obtained based on method (iii).

Figure 20:
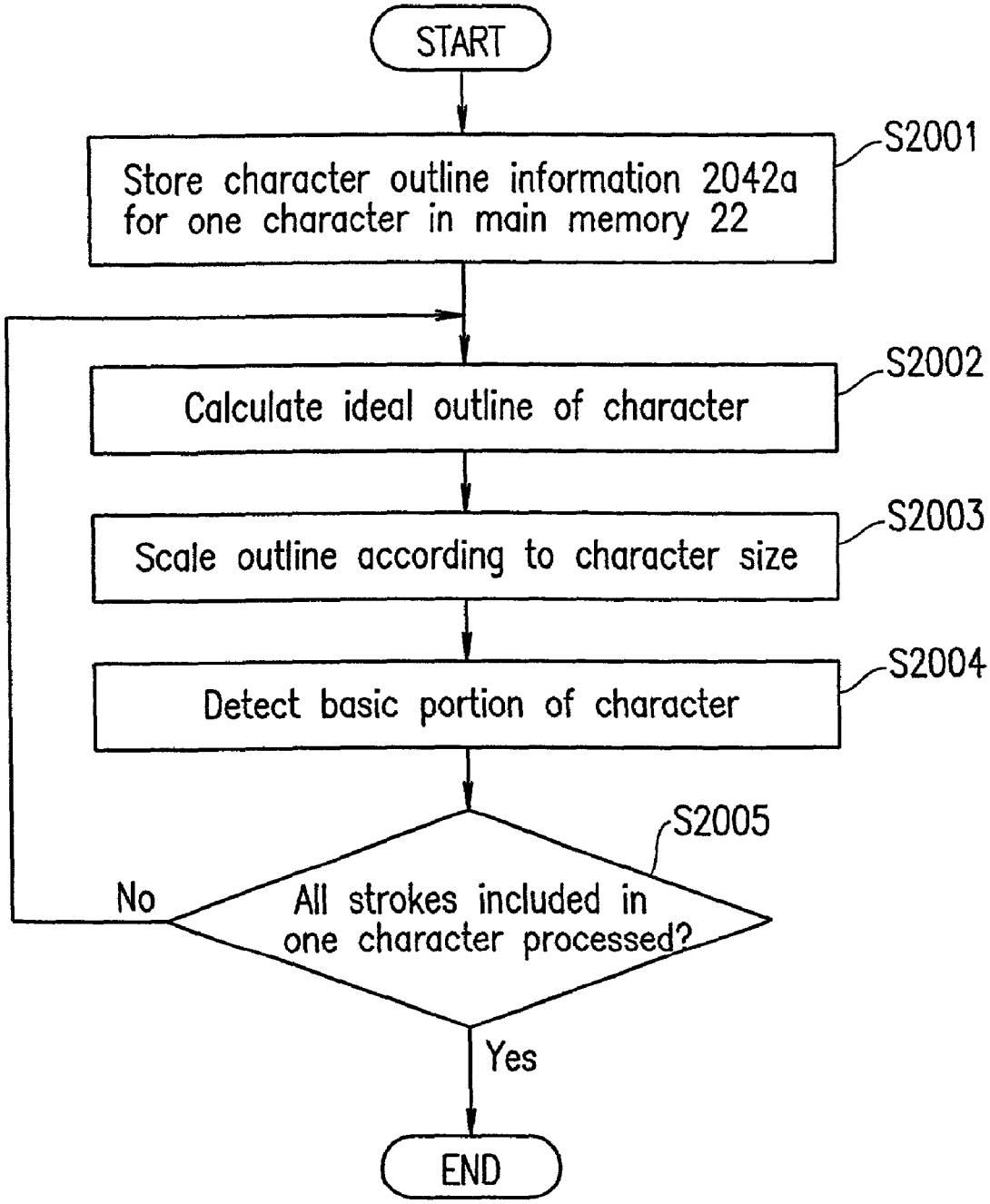
FIG. 20 is a flowchart illustrating a procedure for generating basic portion data from character outline information.

FIG. 20 illustrates a procedure for generating basic portion data from character outline information. This processing is executed by the CPU 21 during the processing at step S102 (FIG. 7). Each step in the procedure for generating basic portion data from character outline information will now be described.

Step S2001: The character outline information 2042*a* for the character corresponding to the character code of the character which has been input at step S101 (FIG. 7) is stored in the main memory 22. The character outline information 2042*a* is included in the character data 42*a* stored in the auxiliary storage apparatus 40.

Step S2002: Based on the outline points coordinate data 308 for one of the strokes included in the character outline information 2042*a,* the ideal outline of the character is calculated. The ideal outline of the character is approximated with straight lines or curves according to a known method.

Step S2003: The ideal outline of the character calculated at step S202 is scaled according to the character size input at step S101 (FIG. 7). This scaling operation converts the predetermined coordinate system for the outline points coordinate data 308 into the coordinate system for the display device 10.

Step S2004: The basic portion of the character is detected according to the area over which the inside of the ideal outline of the character which has been scaled at step S2003 overlaps sub-pixels of the display device 10. For example, when the area over which the inside of the ideal outline of the scaled character overlaps a sub-pixel of the display device 10 is equal to or greater than a predetermined reference area, the sub-pixel is defined as corresponding to the basic portion of the character. The value of the predetermined reference area may be a fixed value or a variable value which may be varied according to an input from the input device 30.

Step S2005: It is determined whether steps S2002–S2004 have been performed for all of the strokes included in the character. If the determination at step S2005 is "No", the process returns to step S2002. If the determination at step S2005 is "Yes", the process terminates.

Through the process illustrated in FIG. 20, the basic portion of the character to be italicized is defined by units of a sub-pixel, whereby basic portion data for defining the basic portion of the character by units of a sub-pixel is generated.

Figure 21:
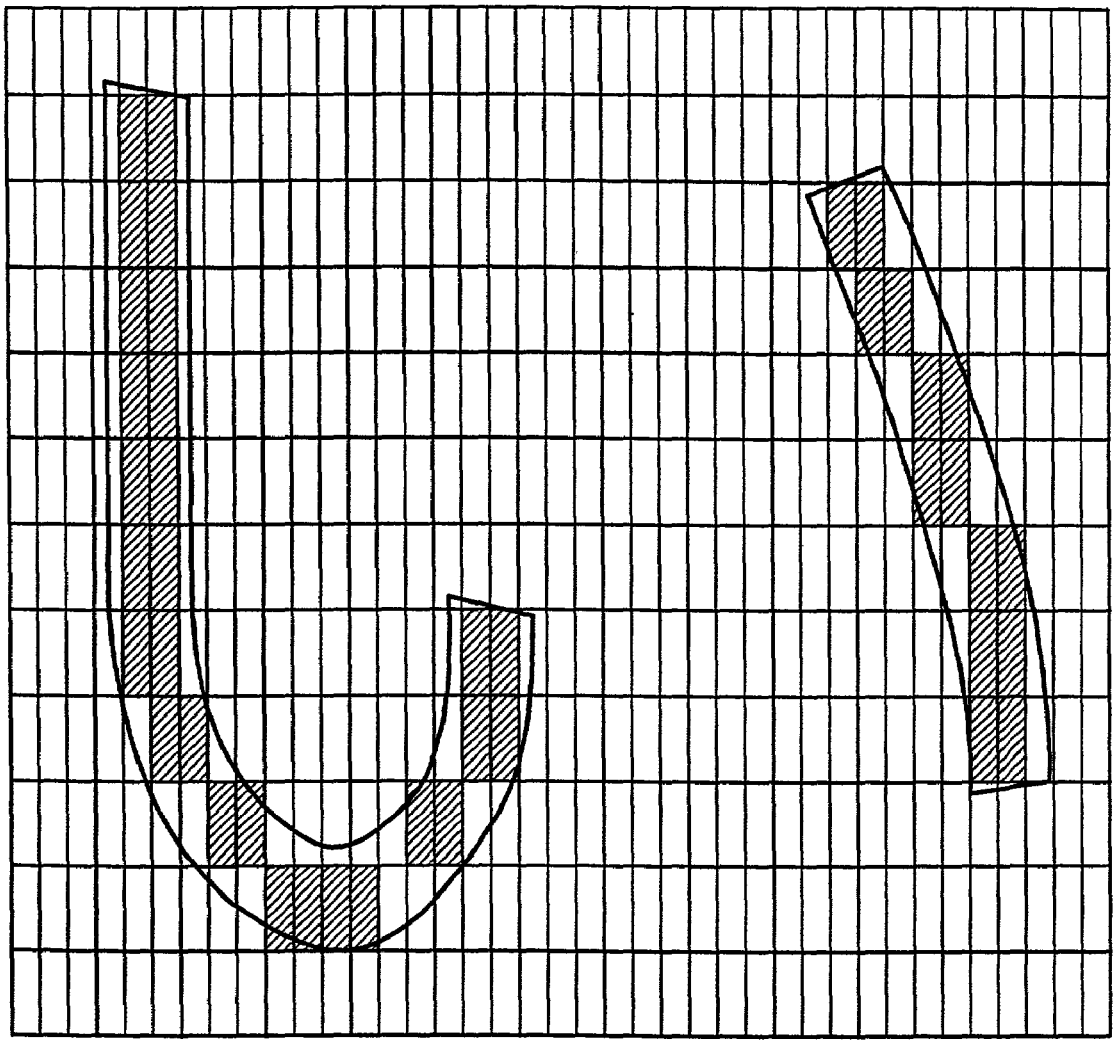
FIG. 21 illustrates font data of a Japanese character "ゐ" which is designed based on the basic portion of the character "ゐ" with the ideal outline of the character "ゐ" being superimposed thereon.

FIG. 21 illustrates font data of a Japanese character "ゐ" which is designed based on the basic portion of the character "ゐ" with the ideal outline of the character "ゐ" being superimposed thereon. In FIG. 21, each hatched box indicates a dot corresponding to the basic portion of the character.

Next, method (3) for generating basic portion data from skeleton data which represents a skeleton shape of a character is described with reference to FIGS. 22 through 25.

Figure 22:
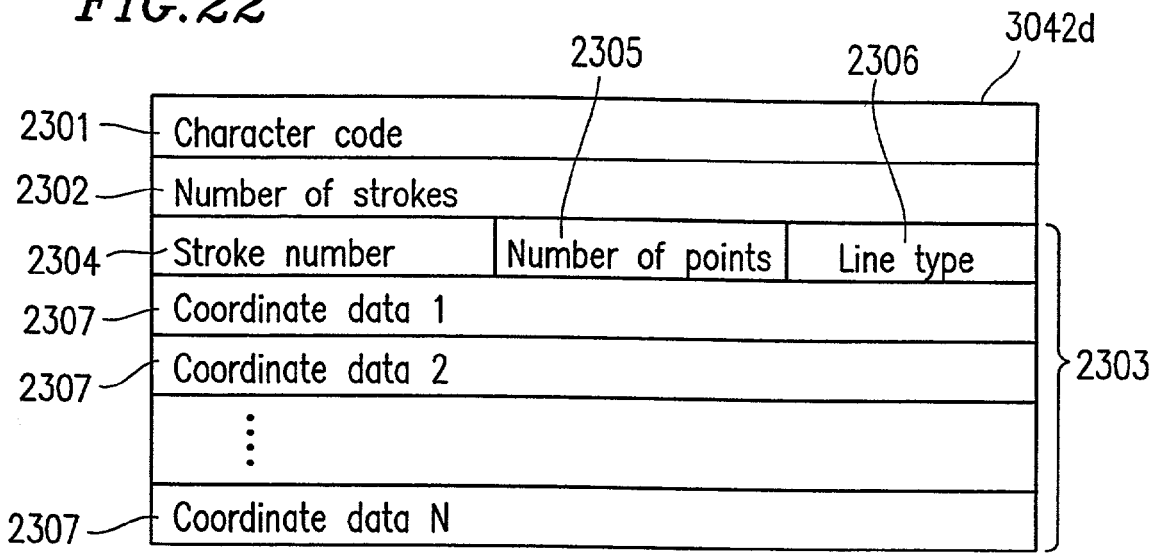
FIG. 22 shows a structure of skeleton data.

FIG. 22 shows a structure of skeleton data 3042*d*.

The skeleton data 3042*d* represents the skeleton shape of a character. The skeleton data 3042*d* includes a character code 2301 for identifying the character, data 2302 indicating the number M of strokes included in the character (M is an integer equal to or greater than 1), and stroke information 2303 for each stroke.

The stroke information 2303 for each stroke includes a stroke number 2304 for identifying the stroke, data 2305 indicating the number N of points included in the stroke (N is an integer equal to or greater than 1), a line type 2306 indicating the line type of the stroke, and a plurality of coordinate data 2307 respectively indicating the coordinates of the plurality of points included in the stroke. Since the number of coordinate data 2307 is equal to the number of points 2305, a number N of coordinate data sets are stored for each stroke.

Since the number of stroke information 2303 is equal to the number of strokes 2302, the skeleton data 3042*d* includes a number M of stroke information 2303 for stroke code No. 1 to stroke code No. M.

The line type 2306 may include, for example, a line type "straight line" and a line type "curve". When the line type 2306 is "straight line", the plurality of points included in the stroke are approximated with a straight line. When the line type 2306 is "curve", the points included in the stroke are approximated with a curve (e.g., a spline curve).

Figure 23:
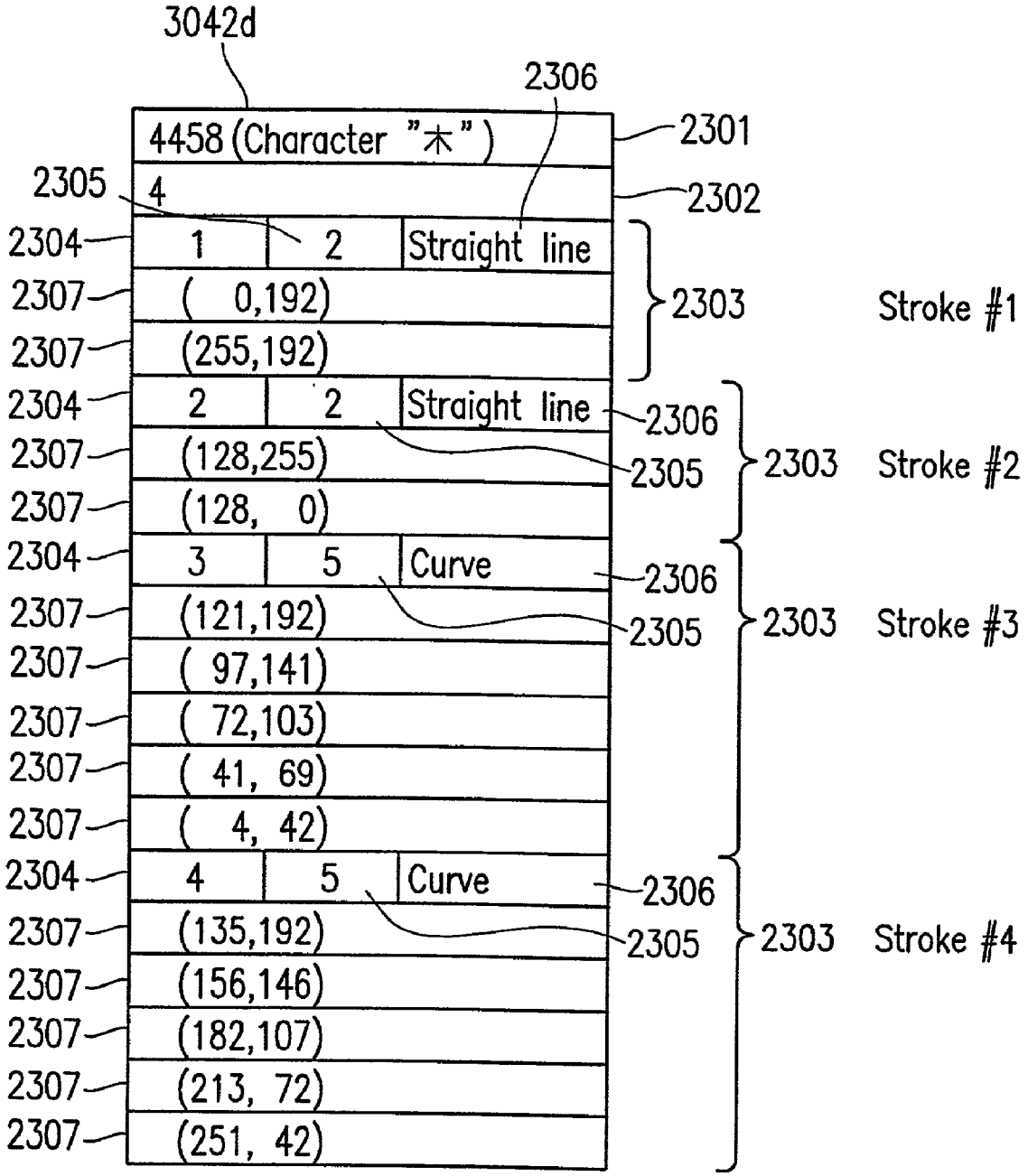
FIG. 23 illustrates an example of skeleton data 3042*d* representing the skeleton shape of a Chinese character "* ".

FIG. 23 illustrates an example of the skeleton data 3042*d* representing the skeleton shape of a Chinese character "* ". The skeleton data 3042*d* representing the skeleton shape of the Chinese character "* " includes four strokes, i.e., stroke #1 to stroke #4 respectively corresponding to stroke code 1 to stroke code 4.

Stroke #1 is defined as a straight line between a starting point (0, 192) and an end point (255, 192). Stroke #2 is defined as a straight line between a starting point (128, 255) and an end point (128, 0). Stroke #3 is obtained by approximating five points (121, 192), (97, 141), (72, 103), (41, 69), (4, 42) with a curve. Stroke #4 is obtained by approximating five points (135, 192), (156, 146), (182, 107), (213, 72), (251, 42) with a curve.

Figure 24:
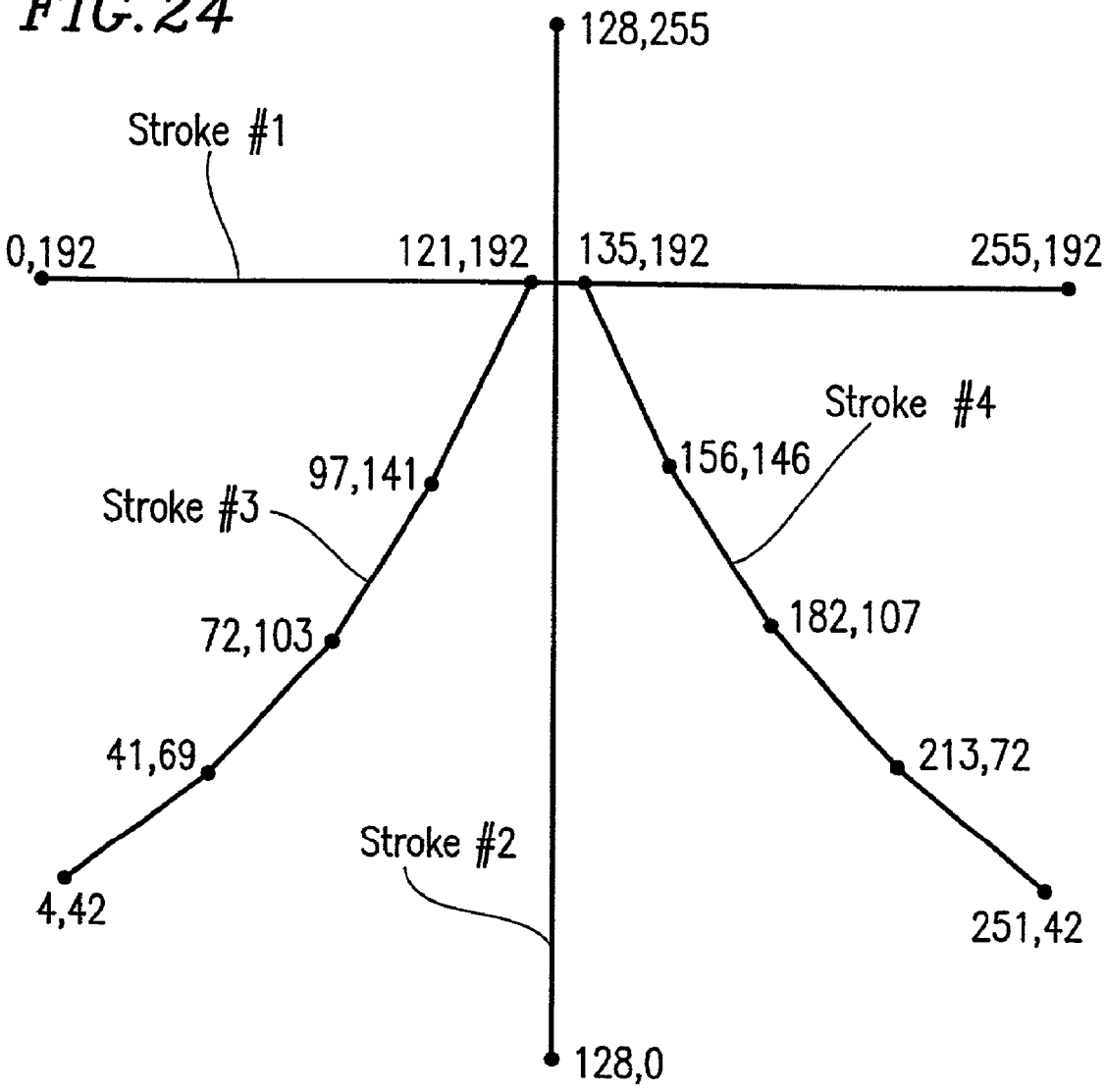
FIG. 24 illustrates an example of the skeleton data 3042*d* representing the skeleton shape of the Chinese character " * " as shown on a coordinate plane.

FIG. 24 illustrates an example of the skeleton data 3042*d* representing the skeleton shape of the Chinese character " * " as shown on a coordinate plane. In the example illustrated in FIG. 24, stroke #3 and stroke #4 are approximated with straight lines for the sake of simplicity.

Figure 25:
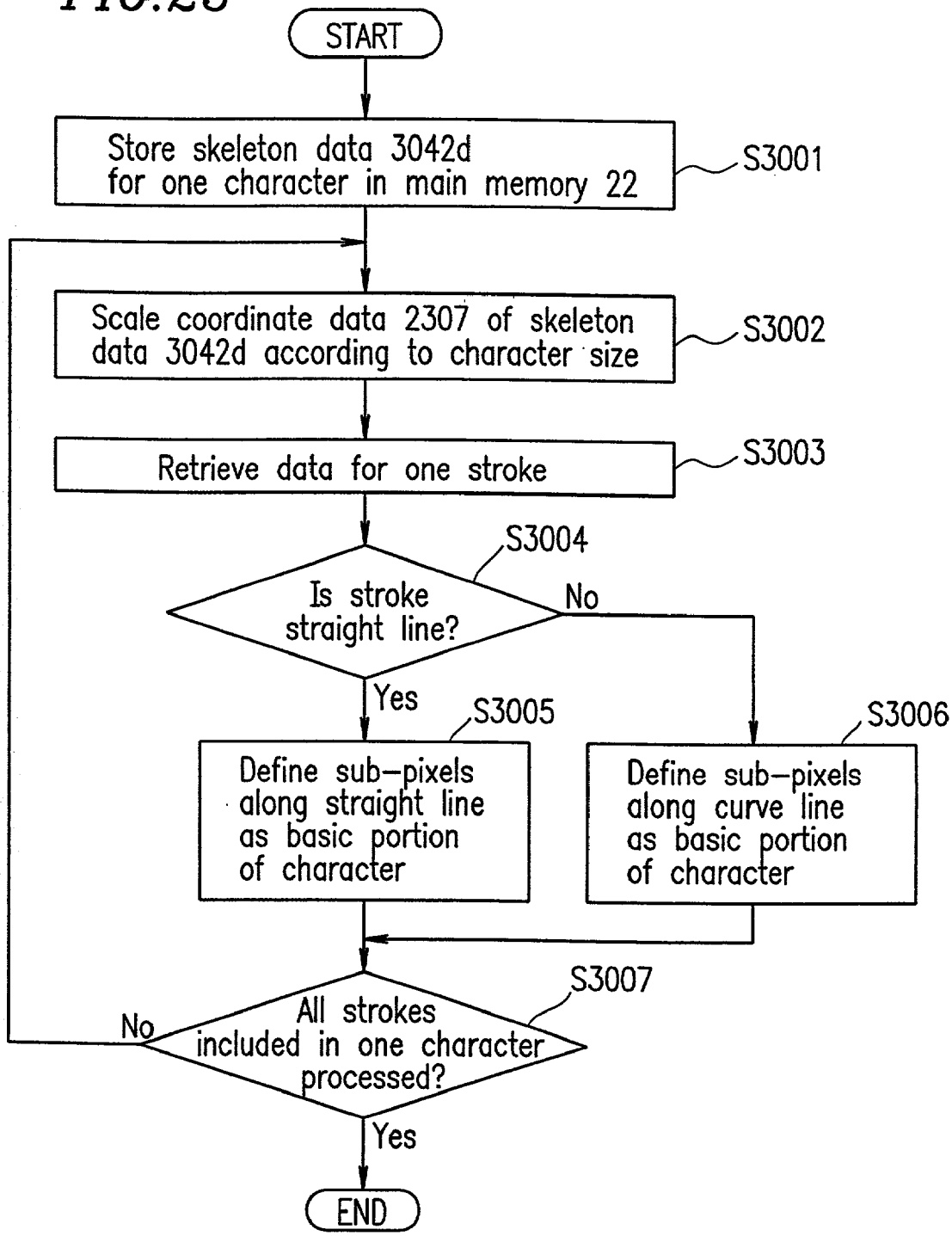
FIG. 25 illustrates a procedure for generating basic portion data from skeleton data.

FIG. 25 illustrates a procedure for generating basic portion data from skeleton data. This procedure is executed by the CPU 21 during the processing performed at step S102 (FIG. 7). Each step in the procedure for generating basic portion data from skeleton data will now be described.

Step S3001: The skeleton data 3042*d* for the character corresponding to the character code of a character input at step S101 (FIG. 7) is stored in the main memory 22. The skeleton data 3042*d* is included in the character data 42*a* stored in the auxiliary storage apparatus 40.

Step S3002: The coordinate data 2307 of the skeleton data 3042*d* is scaled according to the character size input at step S101 (FIG. 7). The scaling operation converts the predetermined coordinate system for the coordinate data 2307 of the skeleton data 3042*d* into the actual pixel coordinate system for the display device 10.

Step S3003: Data (stroke information 2303) for one stroke is retrieved from the skeleton data 3042*a*.

Step S3004: It is determined whether the stroke is a straight line based on the data (stroke information 2303) for the stroke which has been retrieved in Step S3003. Such a determination is done by referencing the line type 2306 included in the stroke information 2303. If the determination of step S3004 is "Yes", the process proceeds to step S3005. If the determination of step S3004 is "No", the process proceeds to step S3006.

Step S3005: The points defined by the scaled coordinate data 2307 are connected together with a straight line. The sub-pixels arranged along the straight line are defined as corresponding to the basic portion of the character.

Step S3006: The points defined by the scaled coordinate data 2307 are approximated with a curve. The curve may be, for example, a spline curve. The sub-pixels arranged along the curve are defined as corresponding to the basic portion of the character.

Step S3007: It is determined whether steps S3002–S3006 have been performed for all of the strokes included in the character. If "No" at Step S3007, the process returns to step S3002. If "Yes" at Step S3007, the process terminates.

Through the process illustrated in FIG. 25, the basic portion of the character to be italicized is defined by units of a sub-pixel, whereby basic portion data for defining the basic portion of the character by units of a sub-pixel is generated.

As described above, as a method for acquiring basic portion data, (1) a method for generating basic portion data from a bit map defined by units of a pixel; (2) a method for generating basic portion data from character outline information which represents the outline of a character; or (3) a method for generating basic portion data from stroke data which represents stroke information of a character can be employed as well as the method for reading data from the auxiliary storage apparatus 40.

The method for acquiring the basic portion data is selected according to how the character data 42*a* defines the shape of a character.

Each of the above acquisition methods may be used solely. Alternatively, a combination of the acquisition methods may be used. In a possible example, if the basic portion data of a character is stored in the auxiliary storage apparatus 40 as a portion of the character data 42*a*, the basic portion data of the character is acquired by reading from the auxiliary storage apparatus 40. If the basic portion data of a character is not stored in the auxiliary storage apparatus 40, the basic portion data of the character is acquired by using any of the above methods (1) to (3).

(Embodiment 2)

In embodiment 1, the brightness level of sub-pixels corresponding to a basic portion of a deformed character is set to a predetermined brightness level (e.g., brightness level 0, i.e., "off"), and the brightness level of the other sub-pixels is set to a default brightness level (e.g., brightness level 255, i.e., "on"). In such a display method, high contrast is generated between a sub-pixel corresponding to the basic portion and a sub-pixel adjacent thereto and not corresponding to the basic portion. As a result, "color noise"is observed by the human eye. In particular, colors other than black can be observed in the italic character by the human eye.

In embodiment 2, in order to prevent generation of color noise, the brightness level of the sub-pixels is controlled not between "on" and "off", but in a stepwise manner over a plurality of brightness levels.

Thus, the present invention independently controls, in a stepwise fashion, a plurality of color elements (R, G, B) which respectively correspond to the sub-pixels 14R, 14G and 14B included in one pixel 12. In this way, a character can be displayed in a virtual black color with high definition. The term "virtual black color" as used herein refers to a color which is not black in a chromatically strict sense but which can be observed by the human eye to be black.

Figure 26:
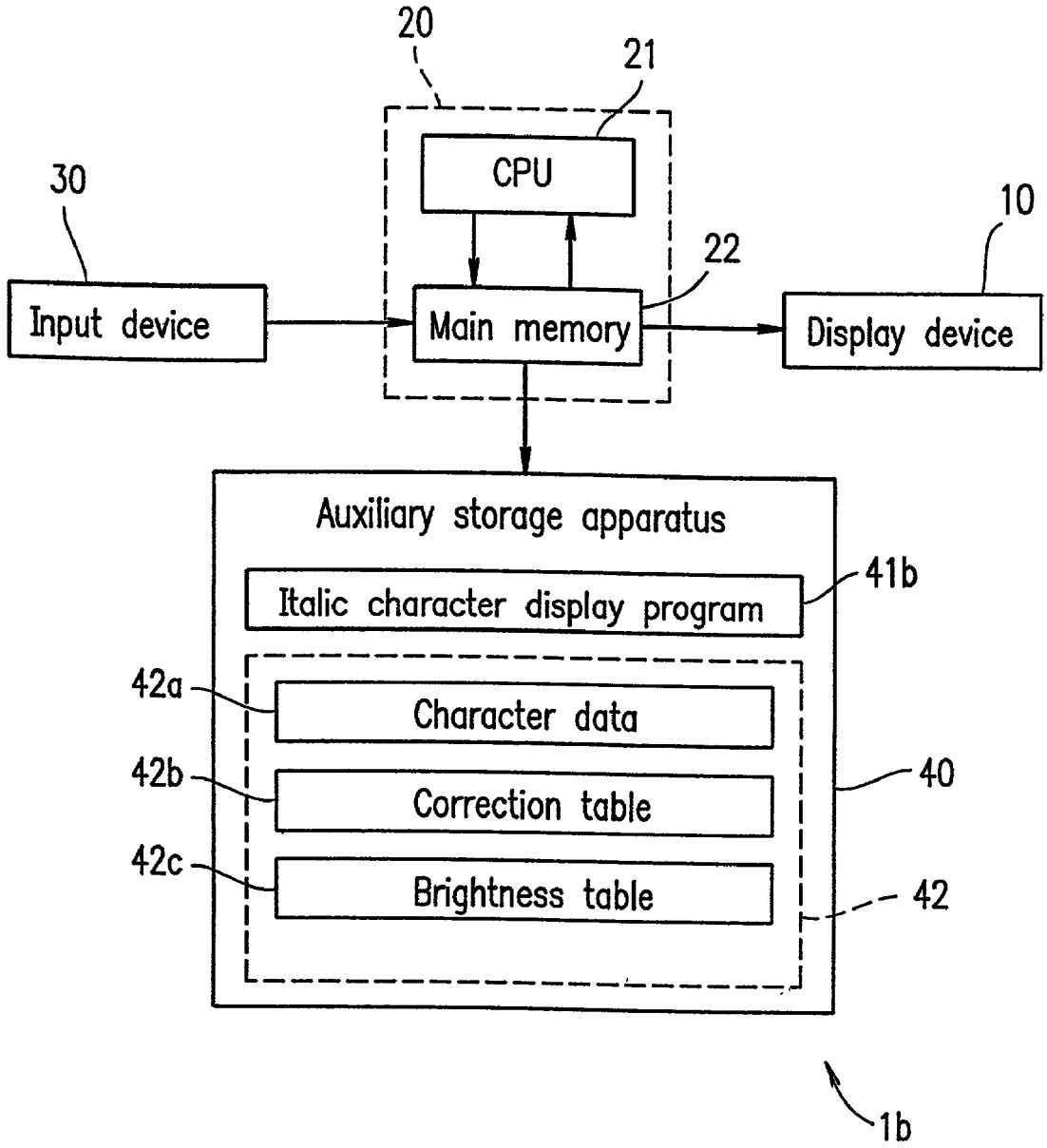
FIG. 26 illustrates a structure of a character display apparatus 1*b* according to embodiment 2 of the present invention.

FIG. 26 shows a structure of a character display apparatus 1*b* according to embodiment 2 of the present invention. In FIG. 26, like elements are indicated by like reference numerals used in FIG. 3, and detailed descriptions thereof are omitted.

The auxiliary storage apparatus 40 stores an italic character display program 41*b* and data 42 which is required to execute the italic character display program 41*b*. The data 42 includes character data 42*a*, a correction table 42*b*, and a brightness table 42*c*. As the auxiliary storage apparatus 40, any type of storage apparatus can be used so long as it can store the italic character display program 41*b* and data 42.

FIG. 27 shows a brightness table 92 which is an example of the brightness table 42*c* stored in the auxiliary storage apparatus 40.

The brightness table 92 is previously stored in the auxiliary storage apparatus 40, whereby the color element level of sub-pixels can be readily converted. In the brightness table 92, the eight color element levels (color element level 7 through color element level 0) are assigned over the range of brightness levels of 0 to 255 at substantially regular intervals.

FIG. 28 illustrates a correction table 90 as an example of the correction table 42*b* stored in the auxiliary storage apparatus 40. The correction table 90 defines a correction pattern. The correction pattern indicates that the color element levels of sub-pixels arranged in the right- or left-hand side (X or −X direction) vicinity of a sub-pixel corresponding to the basic portion of the italic character are set to "5", "2" and "1" in this order from the sub-pixel closest to the basic portion of the italic character to the farthest one from the basic portion of the italic character. Thus, the correction pattern is used to set the color element level of each sub-pixel which is arranged in the vicinity of a sub-pixel corresponding to the basic portion of the italic character.

Figure 29:
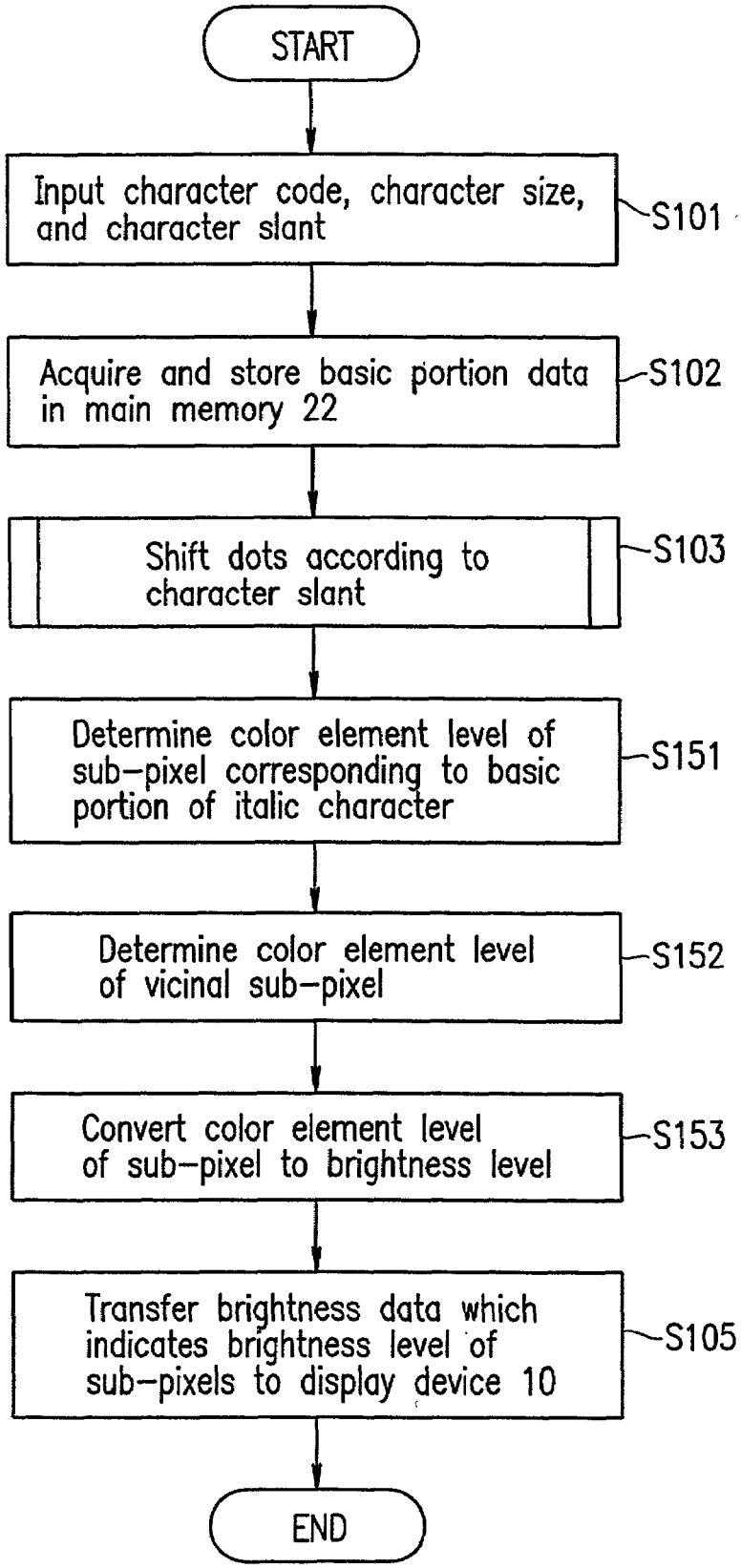
FIG. 29 is a flowchart illustrating the procedure of an italic character display program 41*b*.

FIG. 29 illustrates a procedure for processing the italic character display program 41*b*. The italic character display program 41*b* is executed by the CPU 21. In FIG. 29, the same steps are indicated by like reference numerals used for the steps in the procedure shown in FIG. 7, and detailed descriptions thereof are omitted. The additional steps in the procedure for processing the display program 41*b* will now be described.

Step S151: The color element level of the sub-pixel corresponding to the basic portion of the italic character is set to the maximum color element level. For example, where the color element level of a sub-pixel is represented through eight levels, i.e., level 7 to level 0, the color element level of the sub-pixel corresponding to the basic portion of the italic character is set to level 7.

Step S152: The color element level of each sub-pixel arranged in the vicinity of the sub-pixel corresponding to the basic portion of the italic character is set according to the correction table 42*b* to one of seven levels, i.e., level 6 to level 0.

The color element level of a sub-pixel which does not correspond to the basic portion of the italic character and which is not positioned in the vicinity of a sub-pixel corresponding to the basic portion of the italic character is set to a default color element level (e.g., brightness level 0).

Step S153: The color element level of each sub-pixel is converted to a brightness level. Such a conversion is performed by using, for example, the brightness table 42*a* stored in the auxiliary storage apparatus 40.

Figure 30:
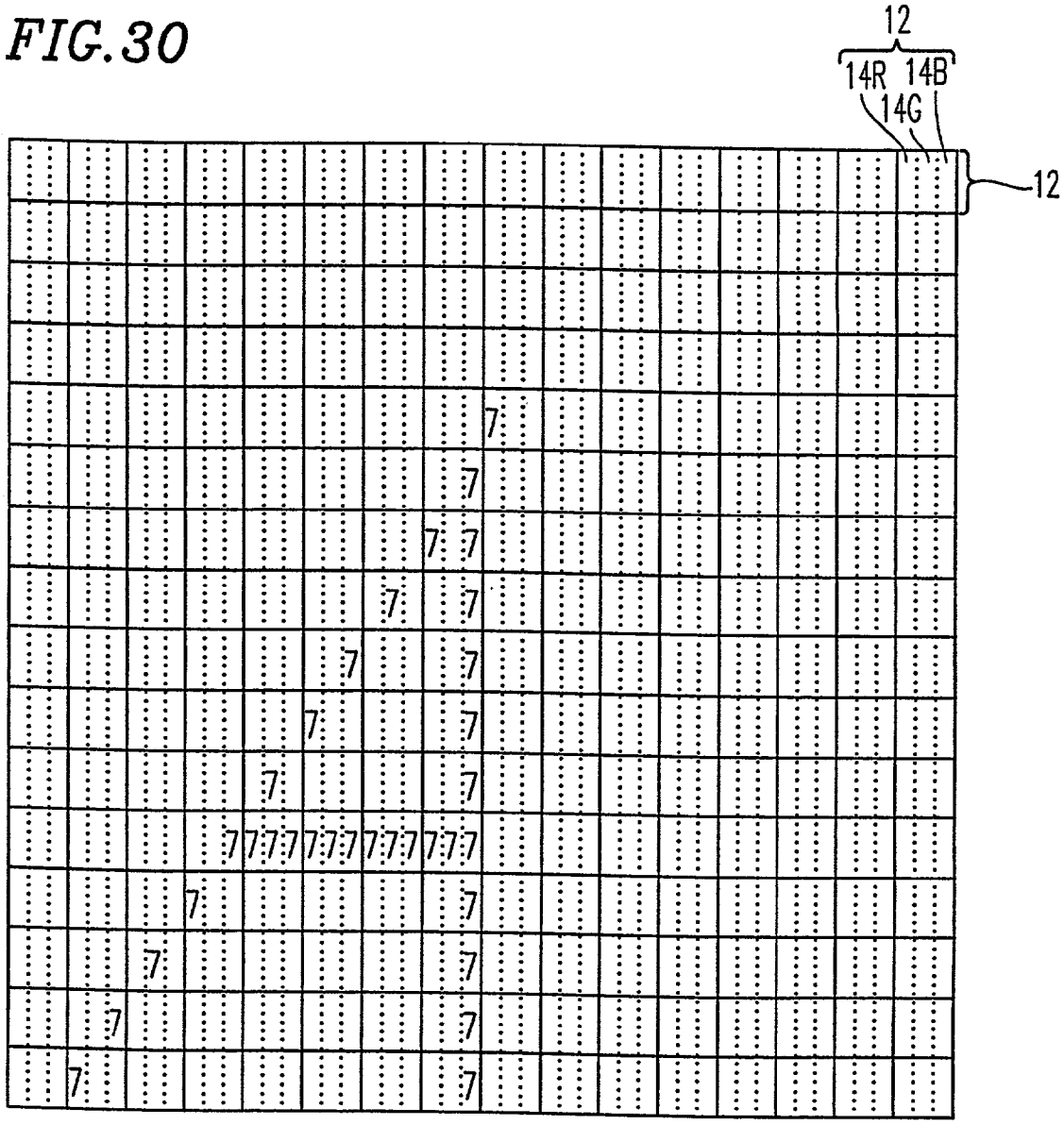
FIG. 30 shows a setting example of the color element level of sub-pixels corresponding to a basic portion of an italic character "A" of the English language alphabet.

FIG. 30 shows a setting example of the color element level of sub-pixels corresponding to a basic portion of an italic character "A". In the example illustrated in FIG. 30, the color element level of sub-pixels corresponding to the basic portion of the italic character "A" is set to the color element level 7. Such processing for setting the color element level of the sub-pixels is performed at step S151 in the procedure shown in FIG. 29. The basic portion of the italic character is shown in FIG. 10.

Figure 31:
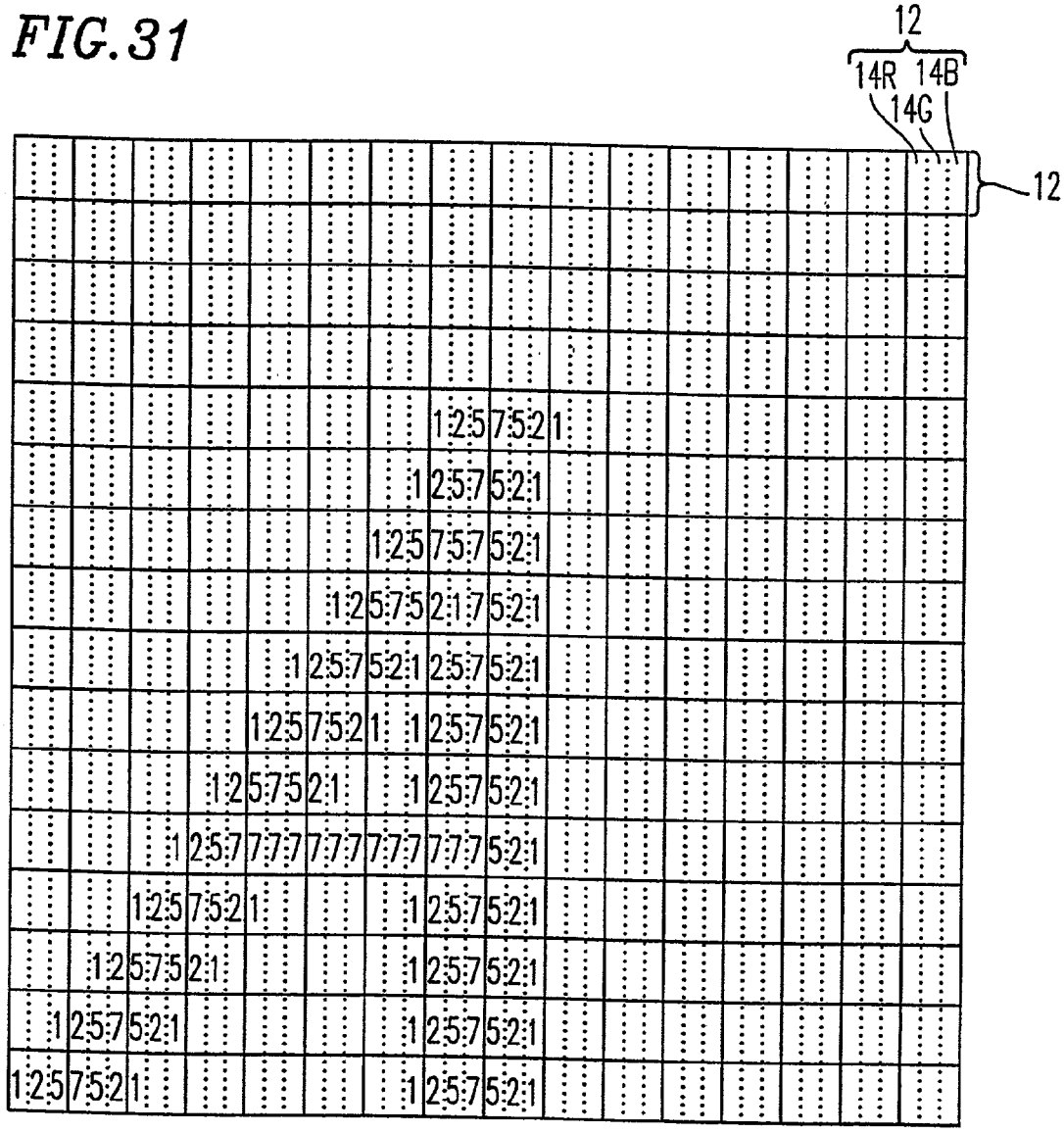
FIG. 31 shows a setting example of the color element level of sub-pixels in the vicinity of the sub-pixels corresponding to a basic portion of the italic character "A".

FIG. 31 shows a setting example of the color element level of sub-pixels in the vicinity of the sub-pixels corresponding to a basic portion of the italic character "A". In the example illustrated in FIG. 31, the color element levels of sub-pixels arranged in the vicinity of a sub-pixel corresponding to the basic portion of the italic character "A" are set to "5", "2" and "1" in this order from the sub-pixel closest to the basic portion of the italic character to the farthest one from the basic portion of the italic character. Such processing for setting the color element level of the sub-pixels is performed at step S152 in the procedure shown in FIG. 29. In the examples illustrated in FIGS. 30 and 31, the italicized basic portion data shown in FIG. 10 is used as the basic portion data.

Figure 32:
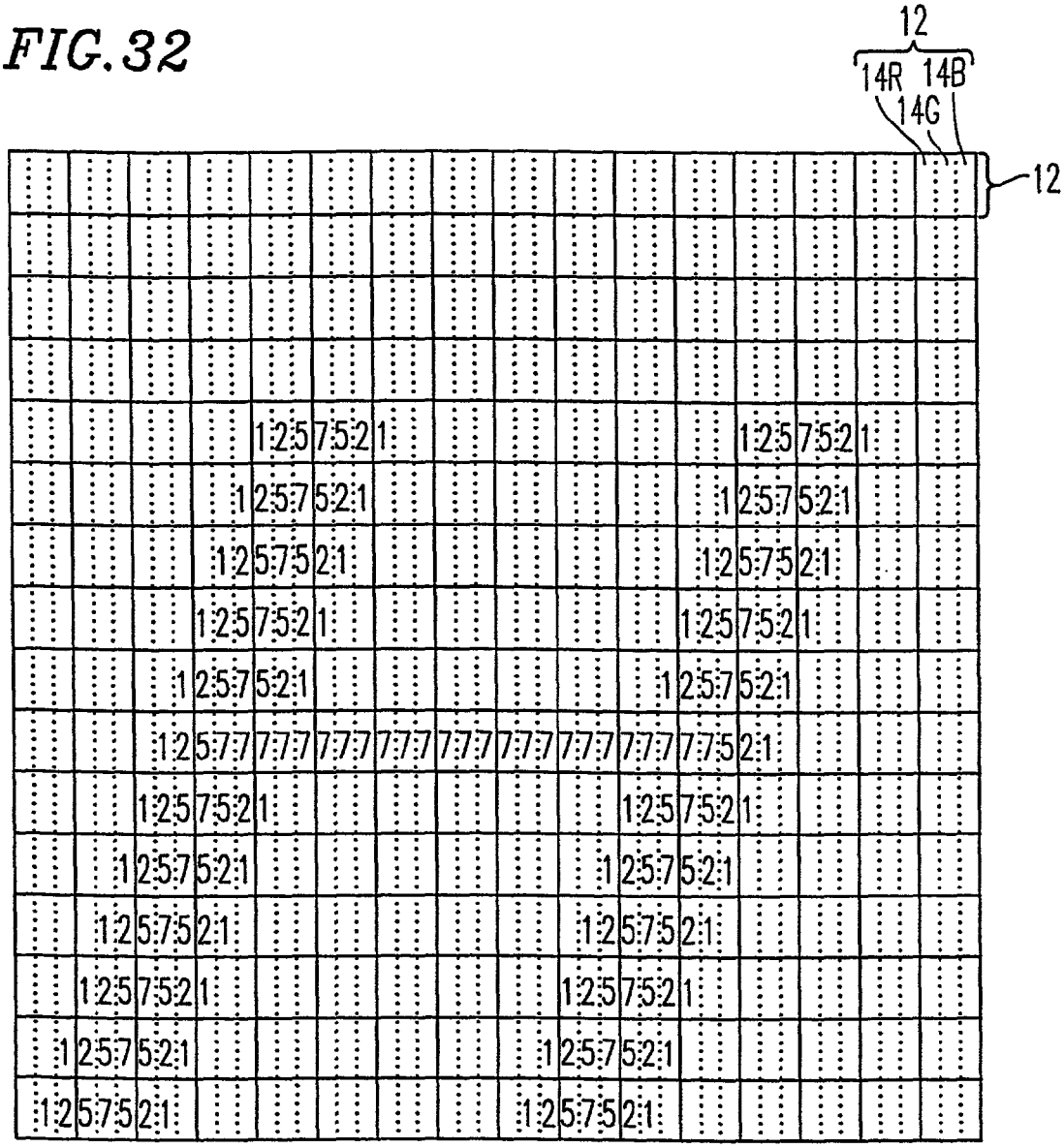
FIG. 32 shows an example of the color element level arrangement of sub-pixels corresponding to a basic portion of an italic character "H" of the English language alphabet and sub-pixels arranged in the vicinity of the sub-pixels corresponding to the basic portion of the italic character "H".

FIG. 32 shows an example of the color element level arrangement of sub-pixels corresponding to a basic portion of an italic character "H" and sub-pixels arranged in the vicinity of the sub-pixels corresponding to the basic portion of the italic character "H". In the example illustrated in FIG. 32, the italicized basic portion data shown in FIG. 9 is used as the basic portion data.

Figure 33:
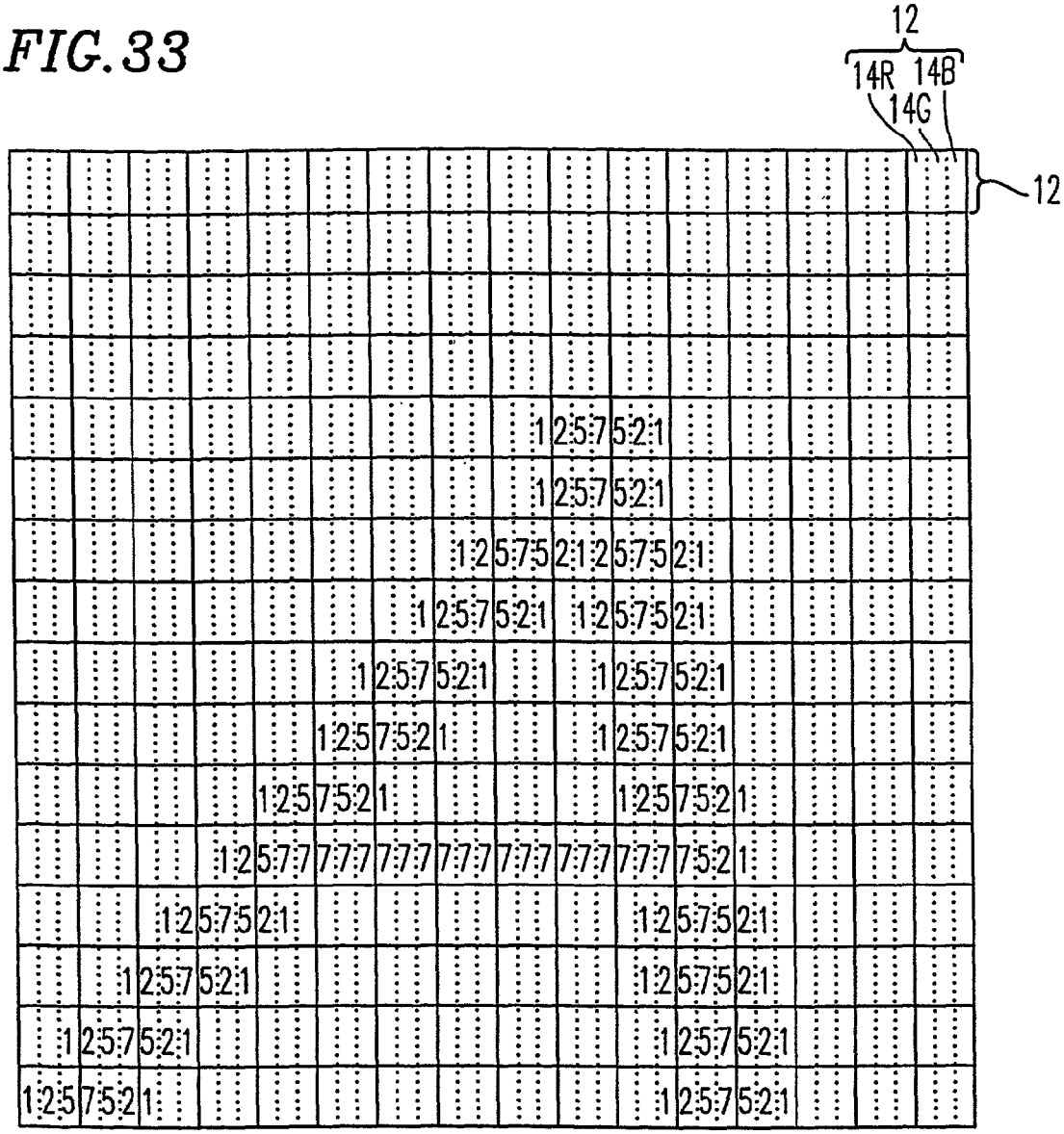
FIG. 33 shows an example of the color element level arrangement of sub-pixels corresponding to a basic portion of an italic character "A" and sub-pixels arranged in the vicinity of the sub-pixels corresponding to the basic portion of the italic character "A".

FIG. 33 shows an example of the color element level arrangement of sub-pixels corresponding to a basic portion of an italic character "A" and sub-pixels arranged in the vicinity of the sub-pixels corresponding to the basic portion of the italic character "A". In the example illustrated in FIG. 33, the italicized basic portion data shown in FIG. 11 is used as the basic portion data.

In the examples illustrated in FIGS. 31 through 33, the correction pattern defined in the correction table 90 is used to set the color element level of sub-pixels in the vicinity of the sub-pixels corresponding to the basic portion of the italic character. According to the correction pattern defined by the correction table 90, the color element levels of sub-pixels arranged in the horizontal vicinity of a sub-pixel corresponding to the basic portion of the italic character are set to "5", "2" and "1" in this order from the sub-pixel closest to the basic portion of the italic character to the farthest one from the basic portion of the italic character. In place of such a setting method, the color element levels of sub-pixels horizontally adjacent to a sub-pixel corresponding to the basic portion of the italic character may be set while considering whether sub-pixels vertically adjacent to the sub-pixel corresponding to the basic portion of the italic character correspond to the basic portion of the italic character.

FIG. 34 shows a correction table 94 as another example of the correction table 42*b* stored in the auxiliary storage apparatus 40. The correction table 94 defines correction patterns 1 and 2. The color element levels of sub-pixels horizontally adjacent to a sub-pixel corresponding to the basic portion of the italic character may be set by using the correction table 94 while considering whether sub-pixels vertically adjacent to the sub-pixel corresponding to the basic portion of the italic character correspond to the basic portion of the italic character.

How to selectively use correction pattern 1 and correction pattern 2 is described with reference to FIGS. 35A, 35B, 36A and 36B.

Figure 35A:
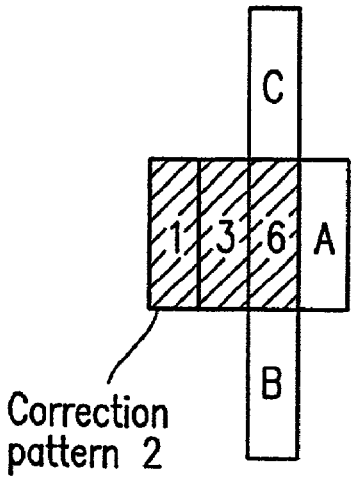
FIGS. 35A and 35B illustrate how to determine the color element level for sub-pixels arranged adjacent to the left side of a sub-pixel which corresponds to the basic portion of the italic character.
Figure 35B:
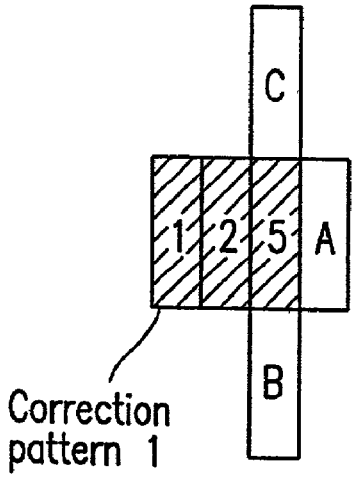

FIGS. 35A and 35B illustrate how to determine the color element level for sub-pixels arranged adjacent to the left side of a sub-pixel which corresponds to the basic portion of the italic character.

Referring to FIGS. 35A and 35B, the sub-pixel A corresponding to the basic portion of the italic character is assumed to be a reference sub-pixel, the sub-pixel located on the left lower side of the current sub-pixel A is assumed to be a sub-pixel B, and the sub-pixel located on the left upper side of the reference sub-pixel A is assumed to be a sub-pixel C.

When at least one of the sub-pixel B and the sub-pixel C corresponds to the basic portion of the character, the color element level of the sub-pixel adjacent to the left side of the sub-pixel A is determined according to the correction pattern 2 of the correction table 94 (FIG. 34). This corresponds to the case illustrated in FIG. 35A. The correction pattern 2 is a pattern: "6", "3", "1". Therefore, the color element levels of the three sub-pixels adjacent to the left side of the sub-pixel A are set to "6", "3" and "1" in this order, respectively, from the sub-pixel closest to the sub-pixel A to the farthest one from the sub-pixel A.

When neither sub-pixel B nor sub-pixel C corresponds to the basic portion of the italic character, the color element levels of the three sub-pixels adjacent to the left side of the sub-pixel A are determined according to the correction pattern 1 of the correction table 94. This corresponds to the case illustrated in FIG. 35B. The correction pattern 1 is a pattern: "5", "2", "1". Therefore, the color element levels of the three sub-pixels adjacent to the left side of the sub-pixel A are set to "5", "2" and "1" in this order, respectively, from the sub-pixel closest to the sub-pixel A to the farthest one from the sub-pixel A.

Figure 36A:
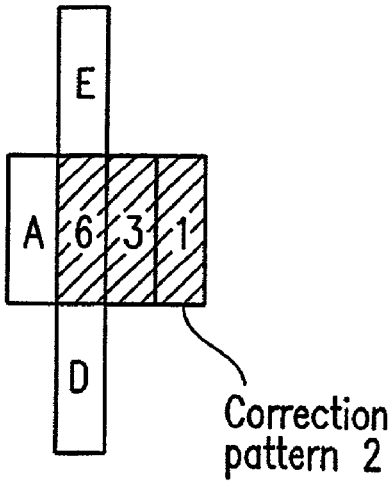
FIGS. 36A and 36B illustrate how to determine the color element level for sub-pixels arranged adjacent to the right side of a sub-pixel which corresponds to the basic portion of the character.
Figure 36B:
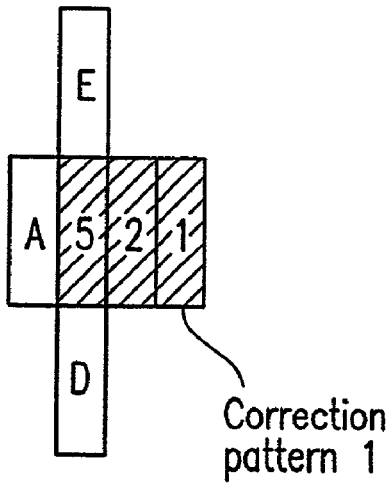

FIGS. 36A and 36B illustrate how to determine the color element level for sub-pixels arranged adjacent to the right side of a sub-pixel which corresponds to the basic portion of the character.

Referring to FIGS. 36A and 36B, the sub-pixel A corresponding to the basic portion of the italic character is assumed to be a current sub-pixel, the sub-pixel located on the right lower side of the reference sub-pixel A is assumed to be a sub-pixel D, and the sub-pixel located on the right upper side of the reference sub-pixel A is assumed to be a sub-pixel E.

When at least one of the sub-pixel D and the sub-pixel E corresponds to the basic portion of the italic character, the color element level of the sub-pixel adjacent to the right side of the sub-pixel A is determined according to the correction pattern 2 of the correction table 94 (FIG. 34). This corresponds to the case illustrated in FIG. 36A. The correction pattern 2 is a pattern: "6", "3", "1". Therefore, the color element levels of the three sub-pixels adjacent to the right side of the sub-pixel A are set to "6", "3" and "1" in this order, respectively, from the sub-pixel closest to the sub-pixel A to the farthest one from the sub-pixel A.

When neither sub-pixel D nor sub-pixel E corresponds to the basic portion of the italic character, the color element levels of the three sub-pixels adjacent to the right side of the sub-pixel A are determined according to the correction pattern 1 of the correction table 94. This corresponds to the case illustrated in FIG. 36B. The correction pattern 1 is a pattern: "5", "2", "1". Therefore, the color element levels of the three sub-pixels adjacent to the right side of the sub-pixel A are set to "5", "2" and "1" in this order, respectively, from the sub-pixel closest to the sub-pixel A to the farthest one from the sub-pixel A.

The correction table 94 shown in FIG. 34 is preferably used especially in a process for setting the color element levels of sub-pixels in the vicinity of a sub-pixel corresponding to the basic portion of the italic character. This is because jaggedness which may be generated in the basic portion of the italic character can be made less conspicuous to the human eye.

The principle that use of the correction table 94 can render jaggedness, which may be generated in the basic portion of the italic character, less conspicuous to the human eye is described below with reference to FIGS. 37A through 37C.

FIG, 37A shows a portion of a basic portion of a character. In FIG. 37A, each hatched box represents a sub-pixel which corresponds to the basic portion of the character.

Figure 37A:
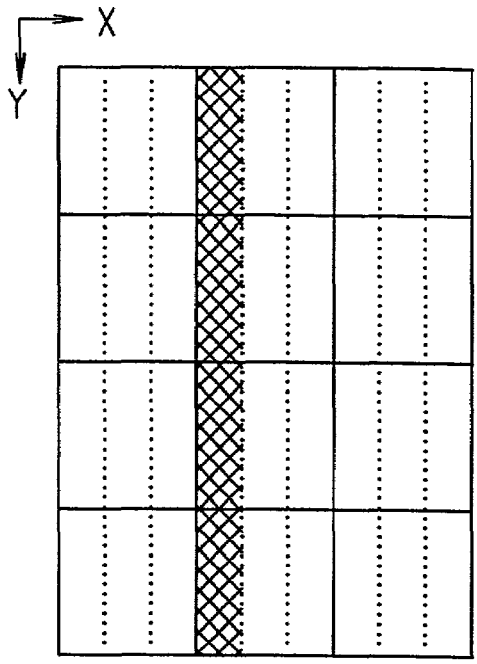
FIG. 37A shows a portion of a basic portion of a character.
Figure 37B:
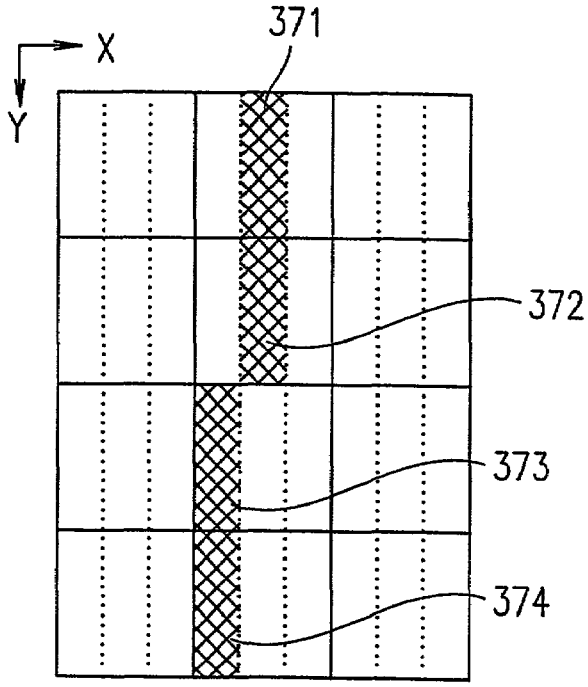
FIG. 37B shows a portion of a basic portion of an italic character which is obtained by deforming the basic portion of the character shown in FIG. 37A by italicization processing.

FIG. 37B shows a portion of a basic portion of an italic character which is obtained by deforming the basic portion of the character shown in FIG. 37A by italicization processing. In FIG. 37B, hatched boxes 371–374 represent sub-pixels corresponding to the basic portion of the italic character. In this italicization processing, the character slant is set to ⅙. In FIG. 37B, the hatched boxes (sub-pixels) 371–374 are arranged in a zigzag manner. That is, jaggedness is generated in the basic portion of the italic character.

Figure 37C:
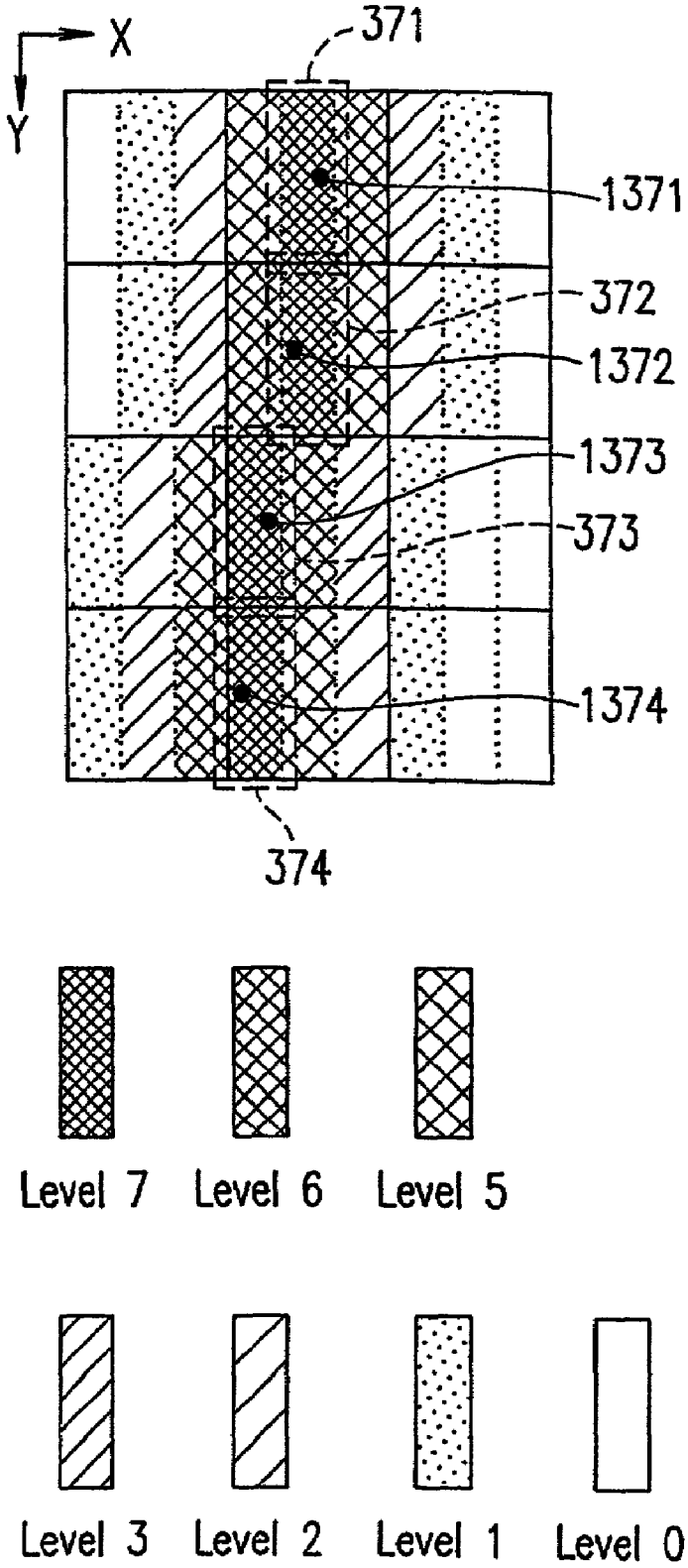
FIG. 37C shows an color level setting where the color element level of sub-pixels corresponding to the basic portion of the italic character shown in FIG. 37B is set to level 7, and the color element level of sub-pixels present in the vicinity of the sub-pixels corresponding to the basic portion is set based on the correction table 94 (FIG. 34).

FIG. 37C shows an color level setting where the color element level of sub-pixels corresponding to the basic portion of the italic character shown in FIG. 37B is set to level 7, and the color element level of sub-pixels present in the vicinity of the sub-pixels corresponding to the basic portion is set based on the correction table 94 (FIG. 34). As shown in FIG. 37C, the color element levels of the right-side (+X direction) neighborhood and the left-side (−X direction) neighborhood of each of sub-pixels 371–374 are set based on different correction patterns. Points 1371–1374 indicate apparent centers of the sub-pixels 371–374. "Apparent center" refers to a point observed by the human eye as a center of a sub-pixel corresponding to the basic portion of the italic character due to a visual effect which may be provided by the sub-pixel corresponding to the basic portion of the italic character and sub-pixels horizontally adjacent thereto. The points 1371–1374 are observed as being arranged in a line, not in a zigzag manner. As a result, jaggedness which may be generated in the basic portion of the italic character can be made less conspicuous to the human eye. Thus, the italic character can be displayed on the display device with high quality.

In general, an italic character includes many oblique lines. Especially when a character includes vertical lines as components thereof, all of such vertical lines are converted to oblique lines by italicization processing. Jaggedness which may be generated in such oblique lines can be made less conspicuous to the human eye by using an appropriate correction pattern. Thus, it is preferable to use a correction pattern in order to display an italic character with high quality.

Figure 38:
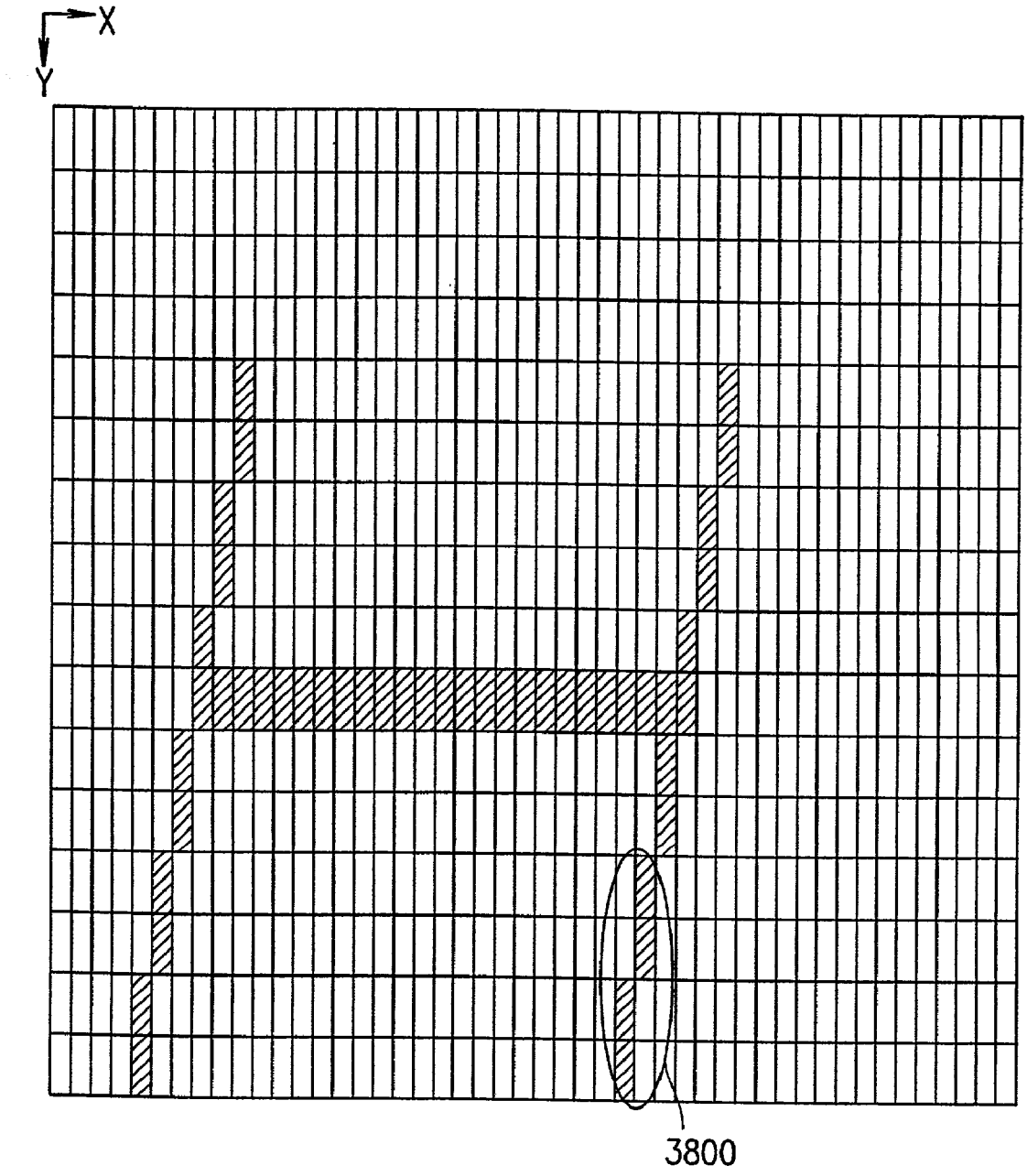
FIG. 38 shows italicized basic portion data obtained by performing italicization processing on the basic portion data shown in FIG. 4.

FIG. 38 shows italicized basic portion data obtained by performing the italicization processing of the present invention on the basic portion data shown in FIG. 4. In the example illustrated in FIG. 38, the character slant is set to ⅙. As shown in FIG. 38, jaggedness is generated in a basic portion of an italic character "H" (e.g., portion 3800).

Figure 39:
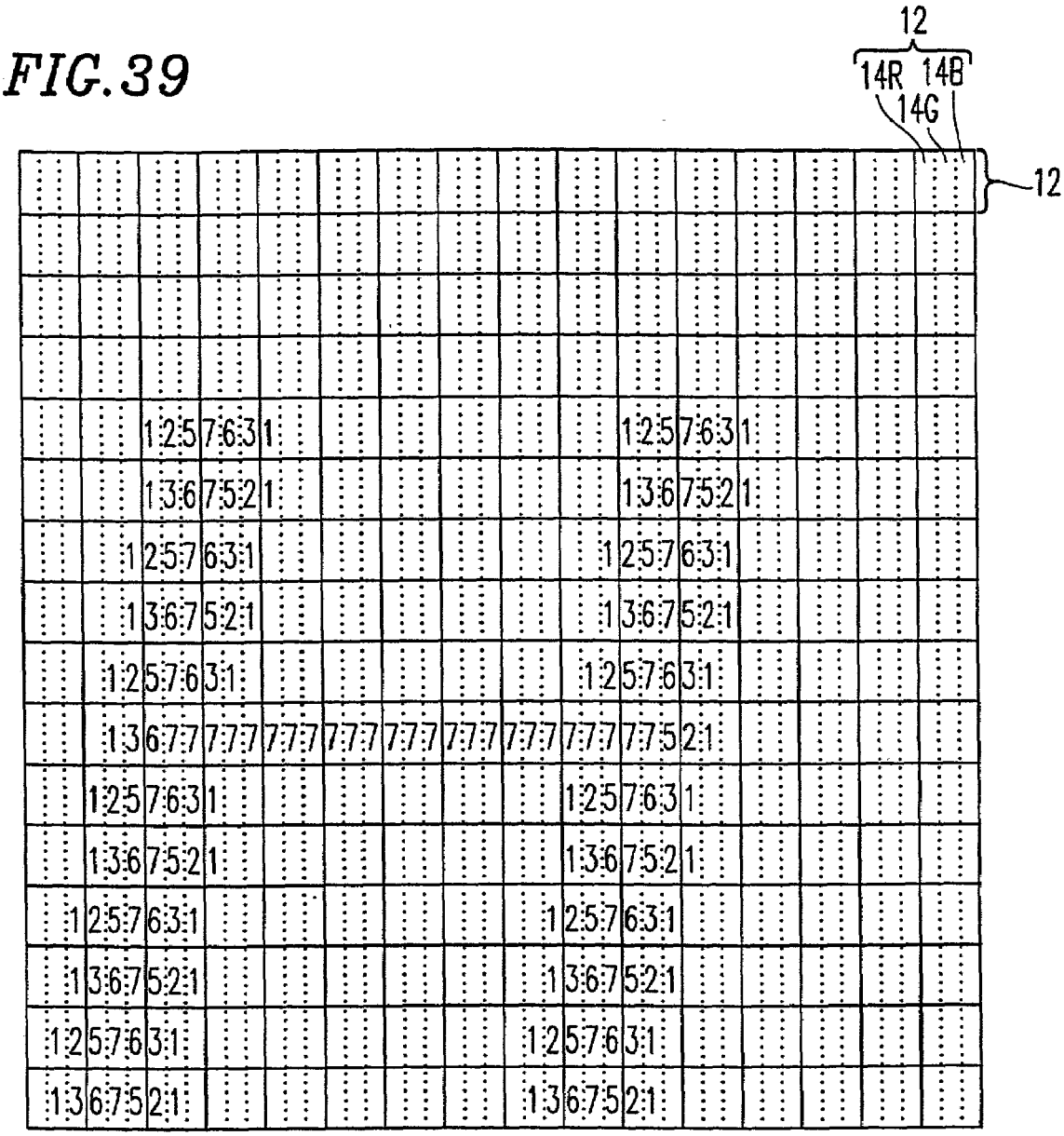
FIG. 39 shows an example of the color element level arrangement of sub-pixels corresponding to the basic portion of the italic character and sub-pixels present in the vicinity of the sub-pixels corresponding to the basic portion of the italic character, which is determined based on the italicized basic portion data shown in FIG. 38.

FIG. 39 shows an example of the color element level arrangement of sub-pixels corresponding to the basic portion of the italic character and sub-pixels present in the vicinity of the sub-pixels corresponding to the basic portion of the italic character, which is determined based on the italicized basic portion data shown in FIG. 38. The determination of the color element level of sub-pixels corresponding to the basic portion of the italic character and sub-pixels present in the vicinity of the sub-pixels corresponding to the basic portion of the italic character is achieved by using the correction table 94. By determining the color element levels as shown in FIG. 39, jaggedness which may be generated in the basic portion of the italic character can be made less conspicuous to the human eye.

For example, in the case where the number of sub-pixels included in the sub-pixel 12 is 3, and the character slant is set to ⅓, jaggedness generated in an oblique line of an italic version which corresponds to a vertical line of the character is less conspicuous to the human eye. In the example illustrated in FIG. 9, jaggedness is less conspicuous in a portion 489. This is because, when the character slant is set to ⅓, in the italicization processing, the shift amount for each of the dots which form a basic portion data is increased by 1 dot every time the distance between the reference line (e. g. , reference line 411 shown in FIG. 4) and the dot is increased by 1 dot. Thus, vertically-aligned dots included in basic portion data of a character (which correspond to a vertical line of the character) are arranged in a line in italicized basic portion data.

In this way, the italicization processing is performed such that the shift amount for each of the dots which form basic portion data is increased by 1 dot every time the distance between the reference line and the dot is increased by 1 dot. With such an arrangement, a character including many vertical lines as components thereof can be converted into an italic version with high quality. Since such italicization processing can make jaggedness which may be generated in the basic portion of the italic character less conspicuous to the human eye, an italic character can be displayed with high quality even in the character display apparatus 1*a* according to embodiment 1 where only a basic portion of an italic character is displayed.

Selection between the two correction patterns (correction patterns 1 and 2) defined by the correction table 94 (FIG. 34) is not limited to the above example illustrated with reference to FIGS. 35A, 35B, 36A and 36B. For example, in an alternative selection method, if a sub-pixel corresponding to a basic portion of an italic character is in an odd-numbered line (counted from the bottom of the italic character in italicized basic portion data), the color element levels of the right-side neighborhood sub-pixels are determined based on correction pattern 1, and the color element levels of the left-side neighborhood sub-pixels are determined based on correction pattern 2. If a sub-pixel corresponding to a basic portion of an italic character is in an even-numbered line (counted from the bottom of the italic character in italicized basic portion data), the color element levels of the right-side neighborhood sub-pixels are determined based on correction pattern 2, and the color element levels of the left-side neighborhood sub-pixels are determined based on correction pattern 1. Even with this selection method, the same effect as that obtained with the color element level arrangement of the sub-pixels shown in FIG. 39 can be obtained.

The correction table 94 shown in FIG. 34 defines two correction patterns. However, the number of correction patterns defined by the correction table is not limited to 2. The correction table can define any number of correction patterns.

Figure 40:
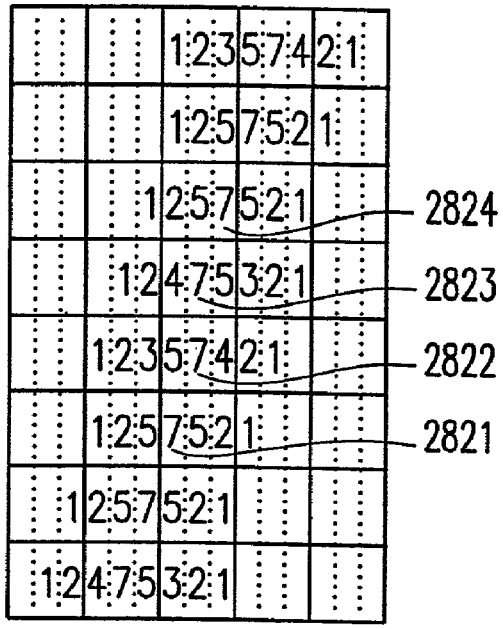
FIG. 40 shows another example of the color element level arrangement of sub-pixels present in the vicinity of the sub-pixels corresponding to the basic portion of the italic character.
Figure 41:
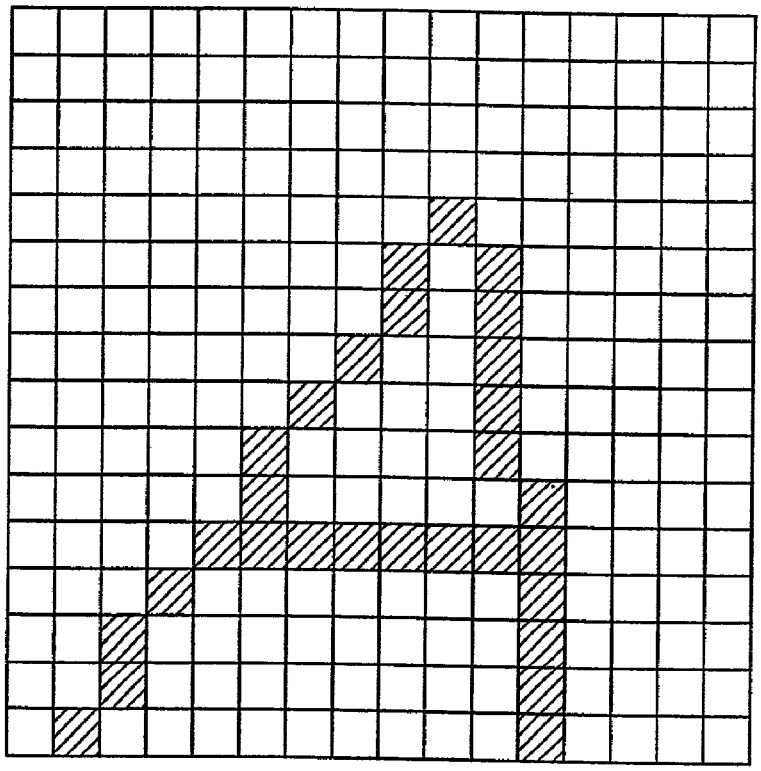
FIG. 41 shows an example of an italic character displayed on a display device based on a bit map which represents an italic version of a character "A" of the English language alphabet.

FIG. 40 shows another example of the color element level arrangement of sub-pixels present in the vicinity of the sub-pixels corresponding to the basic portion of the italic character. In FIG. 40, a number shown in each box corresponding to a sub-pixel indicates the color element level of the sub-pixel. A sub-pixel labeled with "7" is a sub-pixel corresponding to a basic portion of an italic character and has color element level 7. The color element levels for sub-pixels arranged adjacent to the left side of a sub-pixel 2821 are set to "5", "2" and "1" in this order from the sub-pixel closest to the basic portion of the italic character to the farthest one from the basic portion of the italic character. The color element levels for sub-pixels arranged adjacent to the right side of the sub-pixel 2821 are also set to "5", "2" and "1" in this order from the sub-pixel closest to the basic portion of the italic character to the farthest one from the basic portion of the italic character. A correction pattern for setting the color element levels of the sub-pixels to such a pattern of levels is referred to as a correction pattern (5, 2, 1) by way of explanation.

The color element levels for sub-pixels arranged adjacent to the left side of the sub-pixel 2822 are set based on a correction pattern (5, 3, 2, 1). The color element levels for sub-pixels arranged adjacent to the right side of the sub-pixel 2822 are set based on a correction pattern (4, 2, 1).

The color element levels for sub-pixels arranged adjacent to the left side of the sub-pixel 2823 are set based on the correction pattern (4, 2, 1). The color element levels for sub-pixels arranged adjacent to the right side of the sub-pixel 2823 are set based on the correction pattern (5, 3, 2, 1).

The color element levels for sub-pixels arranged adjacent to the left side of the sub-pixel 2824 are set based on a correction pattern (5, 2, 1). The color element levels for sub-pixels arranged adjacent to the right side of the sub-pixel 2824 are set based on the correction pattern (5, 2, 1).

In the example illustrated in FIG. 40, the color element levels of sub-pixels in the vicinity of a basic portion of an italic character are set by selectively using the three types of correction patterns. By selectively using correction patterns according to the slant of a line included in an italic character, jaggedness which may be generated in the basic portion of the italic character can be made less conspicuous to the human eye. As a result, the italic character can be displayed with high quality.

The width of a line (stroke) of an italic character may be changed by selectively using a plurality of correction patterns.

The function of the character display apparatuses 1*a* and 1*b* according to embodiments 1 and 2 of the present invention is not limited to displaying of an italic character. The character display apparatuses 1*a* and 1*b* may have a function of displaying a non-italic character on the display device 10 according to a known technique, as well as the function of displaying an italic character on the display device 10 according to the above-described italic character display principle of the present invention.

The italic character display principle of the present invention is applicable in displaying characters used in any language. For example, the italic character display principle of the present invention is applicable to displaying Chinese characters, the Hangul (Korean) alphabet, the Russian language alphabet, etc.

In the above-described embodiments, the brightness of a sub-pixel is controlled according to the color element level (e.g. , level 7 to level 0) associated therewith. That is, the brightness of a sub-pixel is used as a factor which indicates the intensity of the color element of the sub-pixel. Instead of controlling the brightness of a sub-pixel, it is alternatively possible to control one of the chroma, lightness, purity, and the like, associated with the color element. In such a case, instead of using the standard brightness table 92 illustrated in FIG. 27, the one of a chroma table indicating the relationship between the color element level and the chroma level of a sub-pixel, a lightness table indicating the relationship between the color element level and the lightness level of a sub-pixel, and a purity table indicating the relationship between the color element level and the purity level of a sub-pixel can be used. It is also within the scope of the present invention to control a combination of two or more parameters (e.g., the brightness, chroma, lightness, purity) associated with each color element according to the color element level (e.g., level 7 to level 0) of the sub-pixel.

According to the present invention, a character display apparatus and a character display method capable of displaying italic characters with high quality on a color display device, and a recording medium for use therewith can be provided.

According to the present invention, a bit map (basic portion data) which represents a basic portion of a character is acquired, and conversion (italicization processing) is performed on the bit map so as to acquire a bit map which represents a basic portion of an italic version of the character. Dots which form the basic portion data of the italic character correspond to sub-pixels of a display device in a one-to-one manner. The italicization processing itself is achieved with high definition. Thus, the italic character can be displayed with high quality.

According to the present invention, the color element level of at least one specific sub-pixel corresponding to a basic portion of an italic character is set to a predetermined color element level, and the color element level of at least one sub-pixel adjacent to the at least one specific sub-pixel corresponding to the basic portion of the italic character is appropriately controlled. In this way, colors of the italic character other than black can be made less conspicuous to the human eye, and accordingly, jaggedness which may be generated in the basic portion of the italic character can be made less conspicuous to the human eye.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A character display apparatus, comprising:

a display device having a plurality of pixels; and a control section for controlling the display device, wherein each of the plurality of pixels includes a plurality of sub-pixels arranged along a predetermined direction, one of a plurality of color elements being pre-assigned to each of the plurality of sub-pixels;

the control section:

acquires a first bit map which represents a basic portion of a character, performs predetermined conversion of the first bit map so as to generate a second bit map which represents a basic portion of an italic character, and sets the intensity of a color element of at least one specific sub-pixel corresponding to the basic portion of the italic character to a predetermined value and sets the intensity of at least one sub-pixel adjacent to the at least one specific sub-pixel corresponding to the basic portion of the italic character to a value different from the predetermined value based on the second bit map so as to display the italic character on the display device;

dots which form the first bit map correspond to the plurality of sub-pixels in a one-to-one manner;

dots which form the second bit map correspond to the plurality of sub-pixels in a one-to-one manner; and the second bit map is generated from the first bit map by shifting each dot forming the first bit map by a shift amount which is in proportion to a distance from a reference line running along the predetermined direction set in the first bit map to a dot.

2. A character display apparatus, comprising:

a display device having a plurality of pixels; and a control section for controlling the display device, wherein each of the plurality of pixels includes a plurality of sub-pixels arranged along a predetermined direction, one of a plurality of color elements being pre-assigned to each of the plurality of sub-pixels;

the control section:

acquires a first bit map which represents a basic portion of a character, performs predetermined conversion of the first bit map so as to generate a second bit map which represents a basic portion of an italic character, and sets the intensity of a color element of at least one specific sub-pixel corresponding to the basic portion of the italic character to a predetermined value based on the second bit map so as to display the italic character on the display device;

dots which form the first bit map correspond to the plurality of sub-pixels in a one-to-one manner;

dots which form the second bit map correspond to the plurality of sub-pixels in a one-to-one manner;

the second bit map is generated from the first bit map by shifting each dot forming the first bit map by a shift amount which is in proportion to a distance from a reference line running along the predetermined direction set in the first bit map to a dot, the intensity of each of the plurality of color elements is represented by a plurality of color element levels in a stepwise fashion;

each of the plurality of sub-pixels has one of the plurality of color element levels;

the control section sets a color element level of the at least one specific sub-pixel corresponding to the basic portion of the italic character to a predetermined color element level; and the control section sets a color element level of at least one sub-pixel adjacent to the at least one specific sub-pixel corresponding to the basic portion of the italic character to a color element level different from the predetermined color element level.

3. A character display apparatus, comprising:

a display device having a plurality of pixels; and a control section for controlling the display device, wherein each of the plurality of pixels includes a plurality of sub-pixels arranged along a predetermined direction, one of a plurality of color elements being pre-assigned to each of the plurality of sub-pixels;

the control section:

acquires a first bit map which represents a basic portion of a character, performs predetermined conversion of the first bit map so as to generate a second bit map which represents a basic portion of an italic character, and sets the intensity of a color element of at least one specific sub-pixel corresponding to the basic portion of the italic character to a predetermined value based on the second bit map so as to display the italic character on the display device;

dots which form the first bit map correspond to the plurality of sub-pixels in a one-to-one manner;

dots which form the second bit map correspond to the plurality of sub-pixels in a one-to-one manner;

the second bit map is generated from the first bit map by shifting each dot forming the first bit map by a shift amount which is in proportion to a distance from a reference line running along the predetermined direction set in the first bit map to a dot, wherein the shift amount for each dot forming the first bit map is determined such that the shift amount is increased by 1 dot every time the distance from the reference line to a dot is increased by 1 dot.

4. A character display method for displaying a character on a display device having a plurality of pixels wherein each of the plurality of pixels includes a plurality of sub-pixels arranged along a predetermined direction, and one of a plurality of color elements is pre-assigned to each of the plurality of sub-pixels, the character display method comprising steps of:

acquiring a first bit map which represents a basic portion of a character;

performing predetermined conversion on the first bit map so as to generate a second bit map which represents a basic portion of an italic character; and setting the intensity of a color element of at least one specific sub-pixel corresponding to the basic portion of the italic character to a predetermined value and setting the intensity of at least one sub-pixel adjacent to the at least one specific sub-pixel corresponding to the basic portion of the italic character to a value different from the predetermined value based on the second bit map so as to display the italic character on the display device, wherein dots which form the first bit map correspond to the plurality of sub-pixels in a one-to-one manner, and dots which form the second bit map correspond to the plurality of sub-pixels in a one-to-one manner; and the second bit map is generated from the first bit map by shifting each dot forming the first bit map by a shift amount which is in proportion to a distance from a reference line running along the predetermined direction set in the first bit map to a dot.

5. A recording medium which can be read by an information display apparatus including a display device having a plurality of pixels and a control section for controlling the display device wherein each of the plurality of pixels includes a plurality of sub-pixels arranged along a predetermined direction, and one of a plurality of color elements is pre-assigned to each of the plurality of sub-pixels, the recording medium storing a program which allows the control section to execute a process including steps of:

acquiring a first bit map which represents a basic portion of a character;

performing predetermined conversion on the first bit map so as to generate a second bit map which represents a basic portion of an italic character; and setting the intensity of a color element of at least one specific sub-pixel corresponding to the basic portion of the italic character to a predetermined value and setting the intensity of at least one sub-pixel adjacent to the at least one specific sub-pixel corresponding to the basic portion of the italic character to a value different from the predetermined value based on the second bit map so as to display the italic character on the display device, wherein dots which form the first bit map correspond to the plurality of sub-pixels in a one-to-one manner, dots which form the second bit map correspond to the plurality of sub-pixels in a one-to-one manner, and the second bit map is generated from the first bit map by shifting each dot forming the first bit map by a shift amount which is in proportion to a distance from a reference line running along the predetermined direction set in the first bit map to a dot.

6. A character display method for displaying a character on a display device having a plurality of pixels wherein each of the plurality of pixels includes a plurality of sub-pixels arranged along a predetermined direction, and one of a plurality of color elements is pre-assigned to each of the plurality of sub-pixels, the character display method comprising steps of:

acquiring a first bit map which represents a basic portion of a character;

performing predetermined conversion on the first bit map so as to generate a second bit map which represents a basic portion of an italic character; and setting the intensity of a color element of at least one specific sub-pixel corresponding to the basic portion of the italic character to a predetermined value based on the second bit map so as to display the italic character on the display device, wherein dots which form the first bit map correspond to the plurality of sub-pixels in a one-to-one manner, dots which form the second bit map correspond to the plurality of sub-pixels in a one-to-one manner, and the second bit map is generated from the first bit map by shifting each dot forming the first bit map by a shift amount which is in proportion to a distance from a reference line running along the predetermined direction set in the first bit map to a dot.

7. A recording medium which can be read by an information display apparatus including a display device having a plurality of pixels and a control section for controlling the display device wherein each of the plurality of pixels includes a plurality of sub-pixels arranged along a predetermined direction, and one of a plurality of color elements is pre-assigned to each of the plurality of sub-pixels, the recording medium storing a program which allows the control section to execute a process including steps of:

acquiring a first bit map which represents a basic portion of a character;

performing predetermined conversion on the first bit map so as to generate a second bit map which represents a basic portion of an italic character; and setting the intensity of a color element of at least one specific sub-pixel corresponding to the basic portion of the italic character to a predetermined value based on the second bit map so as to display the italic character on the display device, wherein dots which form the first bit map correspond to the plurality of sub-pixels in a one-to-one manner, dots which form the second bit map correspond to the plurality of sub-pixels in a one-to-one manner, the second bit map is generated from the first bit map by shifting each dot forming the first bit map by a shift amount which is in proportion to a distance from a reference line running along the predetermined direction set in the first bit map to a dot the intensity of each of the plurality of color elements is represented by a plurality of color element levels in a stepwise fashion;

each of the plurality of sub-pixels has one of the plurality of color element levels;

the control section sets a color element level of the at least one specific sub-pixel corresponding to the basic portion of the italic character to a predetermined color element level; and the control section sets a color element level of at least one sub-pixel adjacent to the at least one specific sub-pixel corresponding to the basic portion of the italic character to a color element level different from the predetermined color element level.

* * * * *